US005622073A

United States Patent [19]

Hiruta et al.

[11] Patent Number: 5,622,073

[45] Date of Patent: Apr. 22, 1997

[54] SIX HIGH ROLLING MILL

[75] Inventors: Toshiki Hiruta; Kunio Kitamura; Ikuo Yarita, all of Chiba, Japan

[73] Assignee: Kawasaki Steel Corporation, Kobe, Japan

[21] Appl. No.: 321,593

[22] Filed: Oct. 12, 1994

Related U.S. Application Data

[63] Continuation of Ser. No. 961,934, filed as PCT/JP92/00639, May 18, 1992 published as WO92/20471, Nov. 26, 1992, abandoned.

[30] Foreign Application Priority Data

| | | | |
|---|---|---|---|
| May 21, 1991 | [JP] | Japan | 3-144152 |
| May 16, 1991 | [JP] | Japan | 3-139428 |
| May 16, 1991 | [JP] | Japan | 3-139431 |
| Jul. 4, 1991 | [JP] | Japan | 3-189467 |
| Jul. 4, 1991 | [JP] | Japan | 3-189468 |
| Jul. 4, 1991 | [JP] | Japan | 3-189469 |
| Jul. 4, 1991 | [JP] | Japan | 3-189470 |
| Jan. 7, 1992 | [JP] | Japan | 4-000942 |

[51] Int. Cl.[6] ..... B21B 27/02

[52] U.S. Cl. ..... 72/247; 72/252.5

[58] Field of Search ..... 72/241.2, 241.4, 72/247, 252.5

[56] References Cited

U.S. PATENT DOCUMENTS

| | | | |
|---|---|---|---|
| 4,194,382 | 3/1980 | Kajiwara | 72/241.8 |
| 4,369,646 | 1/1983 | Kajiwara | 72/241.8 |
| 4,519,233 | 5/1985 | Feldmann et al. | 72/243.6 |
| 4,781,051 | 11/1988 | Schultes et al. | 72/241.4 |
| 4,841,761 | 6/1989 | Stoy et al. | 72/241.2 |

FOREIGN PATENT DOCUMENTS

| | | | |
|---|---|---|---|
| 0258482 | 3/1988 | European Pat. Off. . | |
| 3638331 | 5/1988 | Germany . | |
| 0013442 | 1/1979 | Japan . | |
| 0039007 | 3/1982 | Japan | 72/241.8 |
| 0187207 | 11/1983 | Japan . | |
| 0056905 | 4/1984 | Japan . | |
| 0282717 | 12/1987 | Japan . | |
| 0157703 | 6/1989 | Japan | 72/241.8 |

OTHER PUBLICATIONS

Patent Abstracts of Japan, vol. 16, No. 132 (M-1229) Dated: 3 Apr. 1992 & JP-A-03 294 006 (Kawasaki) Dated: 25 Dec. 1991 *abstract; figures 2A,3A,3B*.

Patent Abstracts of Japan, vol. 12, No. 218 (M-711) Dated: 22 Jun. 1988 & JP-A-63 016 802 (Kawasaki) Dated: 23 Jan. 1988 *abstract; figures 8,9*.

Patent Abstracts of Japan, vol. 11, No. 380 (M-650) Dated: 11 Dec. 1987 & JP-A-62 151 203 (Kawasaki) Dated: 6 Jul. 1987 *abstract*.

*Primary Examiner*—Lowell A. Larson
*Assistant Examiner*—Thomas C. Schoeffler
*Attorney, Agent, or Firm*—Dvorak and Traub

[57] ABSTRACT

In a six high rolling mill comprising each pair of upper and lower work rolls, intermediate rolls and backup rolls, at least the intermediate rolls of the work and intermediate rolls being adapted for shifting in axial directions thereof, each of the intermediate rolls has a barrel length longer than that of the backup roll such that barrel ends of the intermediate roll extend beyond barrel ends of the-backup roll at maximum and minimum shifted positions of the intermediate roll, thereby providing a six high rolling mill having a high mill rigidity.

9 Claims, 43 Drawing Sheets

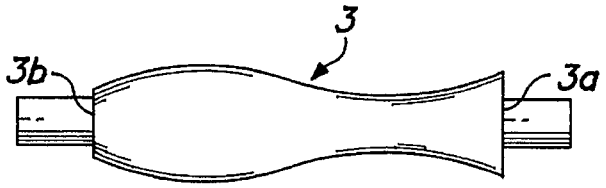
FIG. 2A
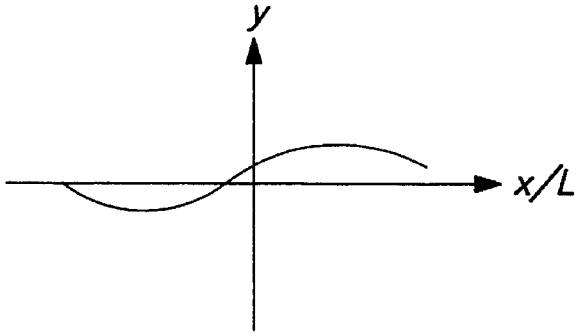
FIG. 2B
FIG. 4
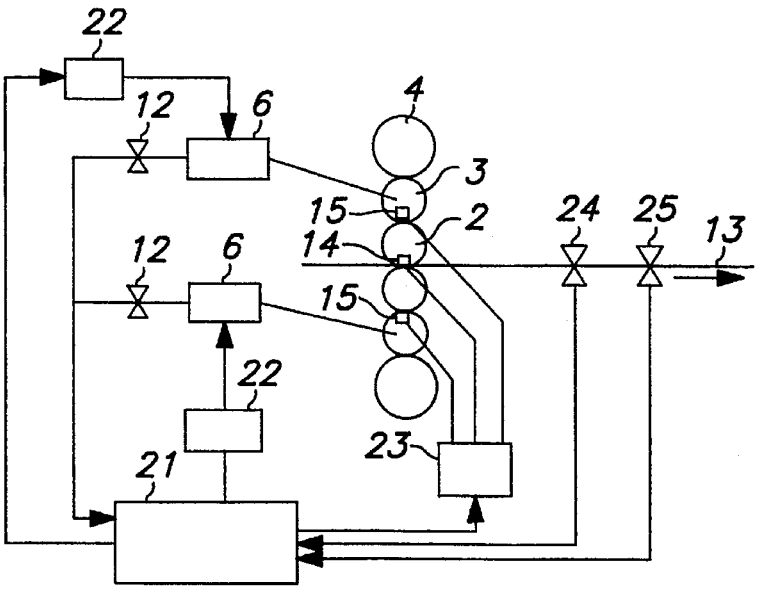

Sheet crown (μm)
60
50
40
30
20
10
0
10
20
30
40
50
60
70
80
90
100
Number of rolled sheets
○ : Conventional rolling mill
● : Inventive rolling mill
— : Target crown Distance from edge (mm)
0
50
100
150
Sheet thickness difference at 100mm from edge (μm)
5
0
-5
-10
-15
-20
○ : Conventional rolling mill
● : Inventive rolling mill

| | Shape |
|---|---|
| Sine · cosine curve shape |  |
| 2th, 4th, 6th order function curve shape |  |

SIX HIGH ROLLING MILL

This application is a continuation of application Ser. No. 07/961,934, filed as PCT/JP92/00639, May 18, 1992, published as WO92/20471, Nov. 26, 1992, now abandoned.

TECHNICAL FIELD

This invention relates to a hot rolling mill, in particular to a hot finish rolling mill for hot rolling a sheet bar rolled by a rough rolling mill into a thickness of a product, and to a six high rolling mill for cold rolling strip sheet rolled by the hot finish rolling mill, in particular, to precisely control a sheet crown which is defined as a difference in the sheet thickness between a central portion in sheet width and portions in the vicinity of edges, thereby preventing the sheet edges from extremely reducing to thin thickness by edge drop.

BACKGROUND ART

Generally, when a hot rolled steel sheet is produced by means of a hot finish rolling mill, rolls are deflected due to rolling load, thereby sheet thickness at a central portion in sheet width becomes thicker than sheet thickness at portions in the vicinity of opposite edges of the rolled sheet, that is a sheet crown is formed in the rolled sheet. By the way, the sheet crown, if the sheet crown becomes large, makes it difficult to provide an adequate sheet profile in cold rolling in the next step, which also provides deficiency in the shape and unavoidably results in reduction in yield, so that it is required for the hot finish rolling mill to make the sheet crown as small as possible.

Thus, for a purpose of controlling the shape of sheet to reduce the sheet crown, for example, JP-A-62-10722 discloses a six high rolling mill to be installed in a post-stage stand, wherein a rolling mill array includes intermediate rolls having a constant diameter over the full length thereof arranged between backup rolls and work rolls, respectively, and these intermediate rolls are adapted to shift in the mutually opposite axial direction, thereby the ability to control the sheet crown is enhanced. Furthermore, JP-A-57-91807 discloses a rolling mill in which an S-shaped crown is formed on any one of a work roll, an intermediate roll or a backup roll, and the roll having the S-shaped crown is shifted in the axial direction, thereby the ability for controlling the sheet crown is enhanced.

However, in the former prior art disclosed in JP-A-62-10722, the length of the intermediate roll is made approximately the same as each length of the backup roll and the work roll, so that when the intermediate roll is shifted in order to make the sheet crown small, the length of contact of the intermediate roll with the backup roll and the work roll becomes short, and the mill rigidity of the rolling mill decreases, and hence, there has been such a problem that when the rolling load changes due to temperature deviation in the sheet bar or the like, the roll gap between a pair of work rolls greatly changes, and no predetermined accuracy in the sheet thickness can be provided, and there has been such a problem that when the center in sheet width deviates from the center of the rolling mill due to deviation of the sheet bar or the like, meanderings resulting from the difference in rigidity of right and left portions of the rolling mill take place, sometimes it is fallen into impossibility of rolling from occurring of reduction ears caused by miss rolling.

In addition, there has been such another problem that spalling occurs on the surfaces of rolls resulting from the increase in pressure between rolls on account of the short length of contact of the intermediate roll, and the service life of the rolls decrease.

It is noted that the problem mentioned above can be avoided by decreasing the shift amount of the intermediate rolls, but the ability for controlling the crown of the work rolls in the rolling mill is greatly limited.

And also in the later prior art disclosed in JP-A-57-91807, there has been such a problem, when the profile control is performed by shifting intermediate rolls provided with an S-shaped crown, the control of crown becomes impossible due to the abrasion of rolls.

Furthermore, when the profile control is performed by producing a curved roll crown on the intermediate roll or the backup roll, it becomes necessary to enlarge the roll crown in order to ensure a large control amount for the crown, but when a sheet bar having a relatively narrow width is rolled with small rolling load by providing such a large roll crown, non-contact portions are generated between the backup roll and the intermediate roll or between the backup roll and the work roll, and the mill rigidity of the rolling mill becomes low, which unavoidably results in the decrease in accuracy of the sheet thickness. In addition, there has been another problem that when the non-contact portions are generated, meander and reduction ears occur in the rolled sheet as a result of a difference of rigidity in the axial direction of the rolls and as a result sometimes rolling of sheet becomes impossible.

DISCLOSURE OF THE INVENTION

This invention solves all such problems in the prior art and provides a six high rolling mill adapted for controlling both the sheet crown and edge drop of sheet to prevent decrease in mill rigidity of the rolling mill and meander of sheet resulting from the great shifting of the intermediate roll and to attain increase in service life of rolls.

A six high rolling mill according to the present invention comprising pairs of upper and lower work rolls, intermediate rolls and backup rolls, at least the intermediate rolls among the intermediate and backup rolls being adapted for shifting in mutually opposite axial directions, wherein each of the intermediate rolls has a barrel length longer than that of the backup roll such that the opposite ends of the barrel of the intermediate roll protrude beyond the opposite end of the barrel of the backup roll still in the maximum and minimum shifting positions of the intermediate roll, and has a roll crown such that roll crowns of the pair of the upper and lower intermediate rolls are in point symmetry relationship.

In a preferred embodiment of the present invention, the barrel length of the intermediate roll may be 1.2–2.5 times longer than that of the backup roll and the barrel length of the work roll must be longer than that of the intermediate roll and preferably 1.4–2.5 times longer than that of the backup roll.

The shape of the roll crown in the intermediate roll may be advantageously selected from S shape, one end taper shape by which the barrel diameter is gradually reduced toward one end of the roll barrel and opposite ends taper shape by which the barrel diameter is gradually reduced toward the opposite ends from the center of the barrel length. The "S" shaped roll crown may be defined by one pitch portion of a high order curve formed by a high order function not lower than a third order function, a sine curve or approximate curves of the high order curve or the sine curve.

The work roll may be provided with a roll crown having a shape such as the one end taper shape defined by that the barrel diameter is gradually reduced toward one end of the roll barrel or the opposite ends taper shape defined by that the barrel diameter is gradually reduced toward the opposite ends from the center of the barrel length. Such work rolls and the intermediate rolls having one of the one end taper shaped roll crown and the opposite ends taper shaped roll crown as mentioned above may be appropriately combined to constitute the six high rolling mill.

The six high rolling mill according to the invention is able to reduce a load affected between rolls, in particular, barrel end portions of the intermediate and work rolls by providing the roll crown for the intermediate rolls, thereby improving the ability for controlling the crown. Particularly, the "S" shaped roll crown can effectively reduce the rolling load applied on the both edge portions of the sheet, and when the intermediate roll are respectively shifted in the opposite directions relative to each other in the spot symmetry relationship, the aforementioned function is more remarkably attained and as a result a greater crown control ability can be attained.

In the rolling mill according to the invention, since the intermediate roll has a barrel length longer than that of the backup roll as mentioned above, even if the intermediate roll is greatly shifted, the intermediate roll can always effectively contact the backup roll over the full length thereof so that the mill rigidity of the rolling mill is effectively prevented from decreasing due to profile control, therefore accuracy of the sheet thickness is greatly improved without any affection caused by variation in width of the sheet to be rolled. Furthermore, even if the sheet to be rolled has camber, the sheet is subjected to uniform reduction through the whole sheet width so that occurring of meander can be effectively reduced.

It should be noted that when the roll barrel of the intermediate roll has a length as long as the roll barrel of the backup roll, it is necessary to use a large roll crown so as to provide a large difference between the maximum diameter and minimum diameter of the roll barrel of the intermediate roll in order to attain a necessary crown control. As a result, a contact pressure generated between rolls which are contacted with each other in a line increases to occur spalling on the surfaces of the rolls and also reduce the service life of the rolls. Furthermore, when a sheet bar has a relatively narrow width and a rolling load is small, non-contact portions are generated between roll barrels of the intermediate and backup rolls or between roll barrels of the intermediate and work rolls. Thus, the mill rigidity of the rolling mill reduces and as a result, a necessary accuracy of the sheet thickness can not be obtained. Therefore, in order to remove the aforementioned problems, it is preferable that the barrel length of the intermediate roll is 1.2–2.5 times as long as the back roll.

Furthermore, the barrel length of the work roll must be longer than that of the intermediate roll, and preferably the barrel length of the work roll is 1.4–2.5 times as long as the backup roll so that the work roll always effectively contacts the intermediate roll in spite of a shift amount of the intermediate roll to improve the mill rigidity of the rolling mill and particularly reduce meandering of the sheet. Moreover, the service life of the roll is improved by increasing the contact range between rolls and restraining the contact pressure between rolls from increasing.

BRIEF DESCRIPTION OF DRAWING

FIGS. 2(*a*) and 2(*b*) are diagrammatic views illustrating a roll crown for an intermediate roll;

FIG. 4 is a block diagram of a control system of the rolling mill;

DETAILED DESCRIPTION OF THE INVENTION

This invention will be explained hereinafter on the basis of examples shown in drawings.

Figure 1:
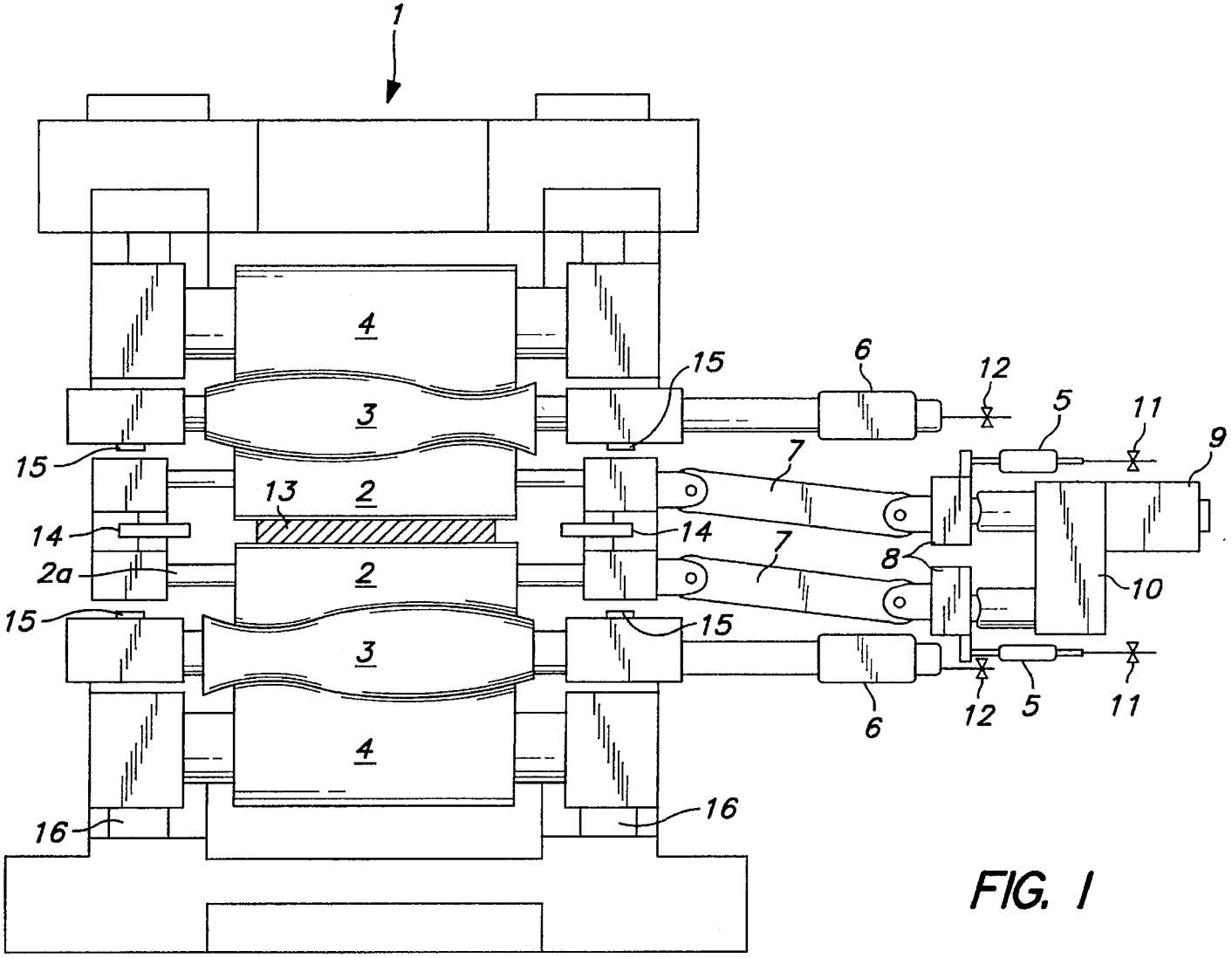
FIG. 1 is a schematic front view of a rolling mill according to the present invention.

FIG. 1 illustrates a six high rolling mill according to the present invention.

Referring to FIG. 1, a housing 1 is provided with pairs of upper and lower work rolls 2, intermediate rolls 3 and backup rolls 4, respectively. The both work rolls 2 are made capable of shifting in mutually opposite direction toward each of the axial directions thereof by means of shifting units 5 for each of them, and the both intermediate rolls 3 are also made capable of shifting in mutually opposite direction toward each of the axial directions by means of other shifting units 6 for each of them.

Each of the backup rolls 4 is constituted by so-called plain roll having a constant barrel diameter throughout the entire length, and each of the intermediate rolls 3 is constituted by a roll having a barrel length longer than that of the backup roll and a "S" shaped roll crown.

In this case, a forming curve of "S" shaped roll crown may be selected from curves which are represented by one pitch of a high order curve formed by a high order function not lower than a third order function, a sine curve and approximate curves of the high order curve or the sine curve. It is preferred that the "S" shaped roll crown to be applied for the intermediate rolls has a difference between maximum and minimum roll diameters not larger than 1 mm.

Figure 3A:
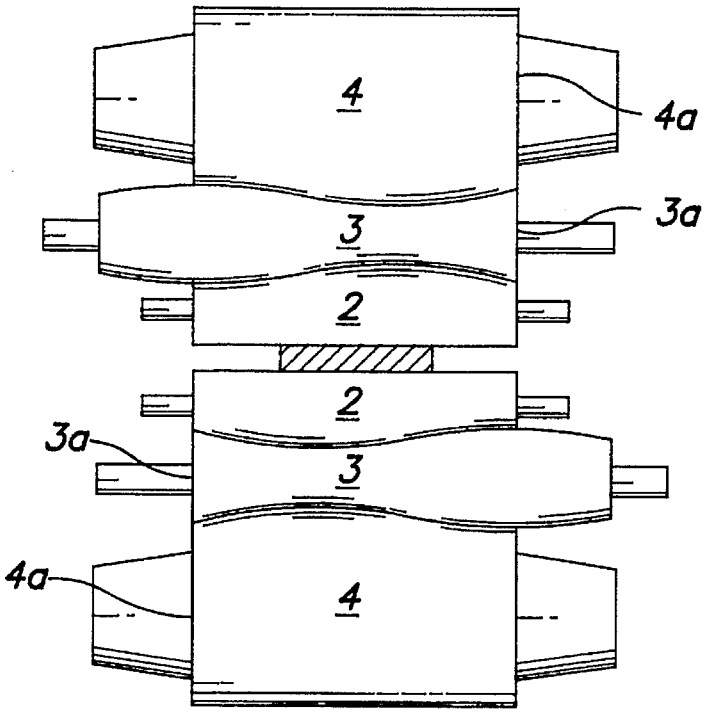
FIGS. 3(*a*) and 3(*b*) are schematic views illustrating the intermediate rolls in shifted positions.
Figure 3B:
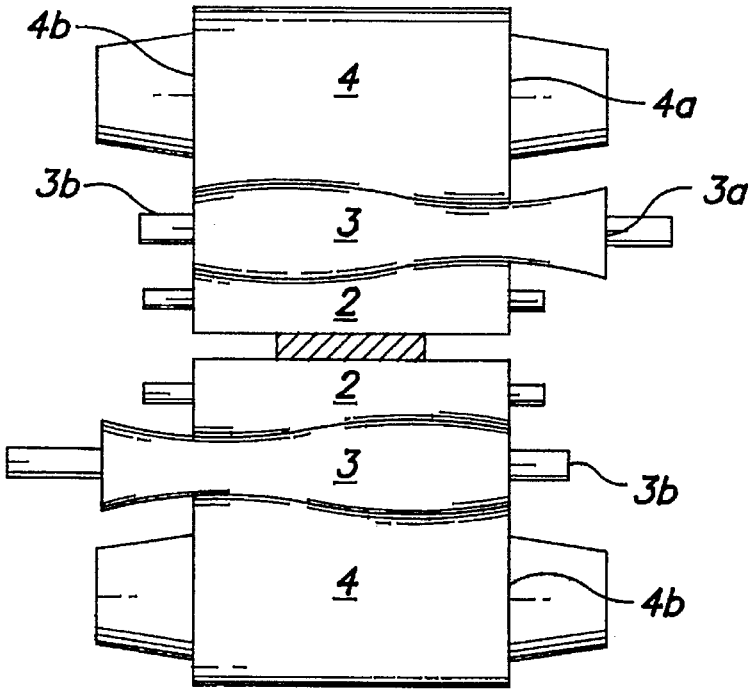

The intermediate rolls 3 with such a roll crown are arranged in mutually opposite position as shown in FIG. 1 and shifted in mutually opposite direction between maximum and minimum shift positions shown in FIG. 3(*a*) and (*b*) by means of shifting units 6.

In the minimum shift position shown in FIG. 3(*a*), one barrel end 3*a* of the intermediate roll 3 is just aligned to one barrel end 4*a* of the backup roll 4, while in the maximum shift position shown in FIG. 3(*b*) the other barrel end 3*b* of the intermediate roll 3 is just aligned to the other barrel end 4*b* of the backup roll 4.

As can be seen from FIGS. 1, 3(*a*) and 3(*b*), the work rolls 2 are plain rolls having a constant diameter and the same barrel length as that of the barrel length of the backup rolls.

Referring to FIG. 1, in the rolling mill with rolls 2, 3 and 4 arranged as mentioned above, each of the work rolls 2 is joined to a reduction gear 10 attached to a motor 9 successively through a spindle 7 and a pinion stand 8. In this case, the shifting position of the work roll 2 by the shifting unit 5 joined to the work roll 2 through the spindle 7 and the pinion stand 8 is detected by a position detecting unit 11 which can be, for example, a magnet scale, and the shifting position of the intermediate roll 3 by the shifting unit 6 joined to the intermediate roll 3 is detected by another position detecting unit 12 which can be also, for example, a magnet scale, respectively.

Incidentally, in the figure, 13, 14 and 15 indicate a rolled sheet as a product, a work roll bender and an intermediate roll bender, respectively, and 16 indicates a load cell.

FIG. 4 is a diagrammatic view of a control system of the rolling mill as described above.

In the figure, 21 indicates an arithmetic unit, and into this arithmetic unit 21 are inputted beforehand rolling conditions in one cycle such as a shape and a size of the tapered portion of the work roll 2, a roll crown and size of the intermediate roll 3, a plate width, a draft of each roll stand, a finish plate thickness, a target sheet crown, a target sheet shape and the like, and the arithmetic unit 21 calculates setting values of a shifting amount of the intermediate roll 3 and bending force of each of the roll benders 14 and 15 on the basis of such information and a cyclic shifting amount of the work roll 2 in order to provide a sheet crown and a sheet shape as the target.

And on the basis of the calculation result, each of a shifting control unit 22 and a bender control unit 23 controls the operations of the shifting unit 6 and the roll benders 14 and 15 there by each of the shifting amount of the intermediate roll 3 and the roll bending force is made as setting values to wait for the start of rolling in such a state.

On the other hand, during the rolling, on the basis of feedback signals from a sheet shape detecting unit 24 and a plate crown detecting unit 25 to the arithmetic unit 21, in order to realize the target sheet shape and the target sheet crown with high accuracy, the arithmetic unit 21 calculates corrected values of the intermediate roll shifting amount and the roll bending force, and the shifting control unit 22 and bender control unit 23 adjust the shift amount of the intermediate roll 3 and the bending force of the roll benders 14, 15 in accordance with the correction values.

When rolling is carried out by the aforementioned rolling mill, especially under the function of the roll crown acting on the intermediate roll 3, the rolling load given to the side edge portions of a sheet bar from the work roll can be very effectively lowered. Therefore, in addition to the actions of the roll benders 14, 15, not only the sheet crown can be controlled with high accuracy but by shifting the intermediate roll 3, its control range can be sufficiently extended.

Next, a method to give a roll crown to the intermediate roll 3 will be explained, by way of an example in which a roll crown is given in accordance with an equation of the third order as shown in FIGS. 2(*a*and 2(*b*).

That is, the lower roll profile of the intermediate roll 3 shown in FIG. 2(*a*) is the same as the curve shown in FIG. 2(*b*), and this curve can be expressed by the following equation (1).

$$y_1(x)=-a[\{x-(\delta+OF)\}/L]^3+b(x/L) \quad (1)$$

where y: generating line of the roll crown, a: coefficient of the third order, b: coefficient of the first order, x: coordinate of the barrel center, L: ½ of the barrel length of the intermediate roll, δ: shift amount of the intermediate roll (The start point is x=LB.), and OF: offset amount in the axial direction.

On the other hand, the upper roll profile of the intermediate roll 3 being in point symmetry to the lower roll profile with respect to a point can be expressed as following equation (2).

$$y_2(x)=-a[\{x+(\delta+OF)\}/L]^3+b(x/L) \quad (2)$$

From the aforementioned equations (1) and (2), a gap Δy between the upper and lower rolls is expressed by the following equation.

$$\Delta y(x)=y_1-y_2=2\cdot a\cdot\left(\frac{\delta+OF}{L}\right)\left[3\left(\frac{x}{L}\right)^2+\left(\frac{\delta+OF}{L}\right)^2\right] \quad (3)$$

Composite roll crown CR formed by the upper and lower intermediate rolls can be expressed by the following equation (4), wherein the mill center is set to be zero (0).

$$CR=\Delta y(O)-\Delta y(x)=-6a\{(\delta+OF)/L\}(x/L)^2 \quad (4)$$

The maximum shift amount $\delta_{max}$ to give the maximum composite roll crown can be expressed as follows.

$$\delta_{max}=L-L_B \quad (5)$$

where $L_B$: ½ of the barrel length of the backup roll. In order to make the composite crown of the upper and lower intermediate rolls to be zero when the shift amount is the minimum value of $\delta_{min}$ $\{=-(L-L_B)\}$, the offset amount OF must be as follows.

$$OF=L-L_B \quad (6)$$

In a normal hot rolling process, the minimum crown amount may be when the composite crown of the upper and lower rolls is zero. However, when it is necessary to make the minimum composite crown larger or smaller than zero, offset amount OF using the position where the shift amount of the intermediate roll is zero (x=L) as a starting point, may be determined as follows.

$$OF=C(L=L_B)$$

where C is a constant.

In order to reduce difference between the maximum and minimum diameters of the intermediate roll without changing the composite roll crown, it is effective to use the following equation obtained when equations (5) and (6) are substituted for equation (4).

$$CR=-6a\{(1+C)(L-L_B)/L^3\}\cdot x^3 \quad (8)$$

and to make the third order coefficient "a" to be minimum, therefore to make $(L-LB)/L^3$ to be maximum in the aforementioned equation. In order to make $(L-L_B)/L^3$ to be maximum, the following equation is applied.

$$L=1.5L_B \quad (9)$$

Accordingly, when the barrel length of the intermediate roll is made 1.5 times as long as that of the backup roll, the maximum and minimum diameter differences of the intermediate roll can be made small, that is, when an S-shaped roll crown is formed on the intermediate roll, the grinding amount can be reduced, so that the life of the intermediate roll can be lengthened in the process of roll grinding.

Figure 5A:
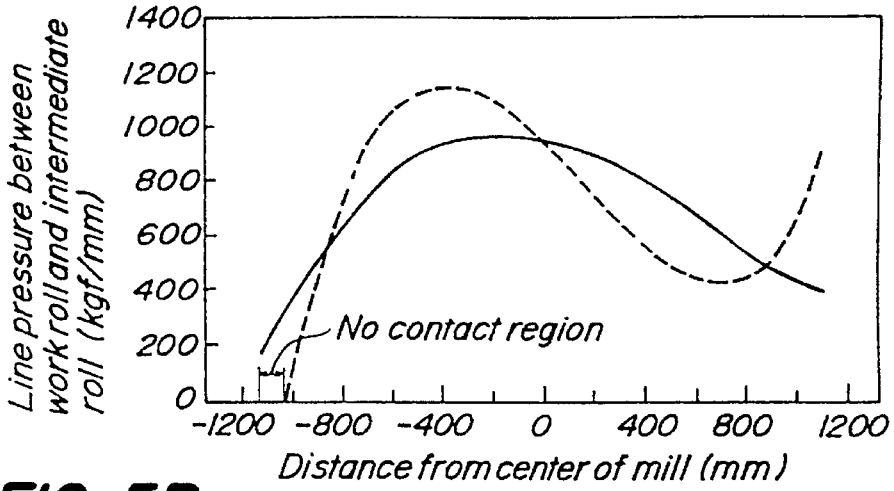
FIGS. 5(*a*), 5(*b*) and 5(*c*) show graphs showing a relationship between the pressure between rolls and the sheet crown.
Figure 5B:
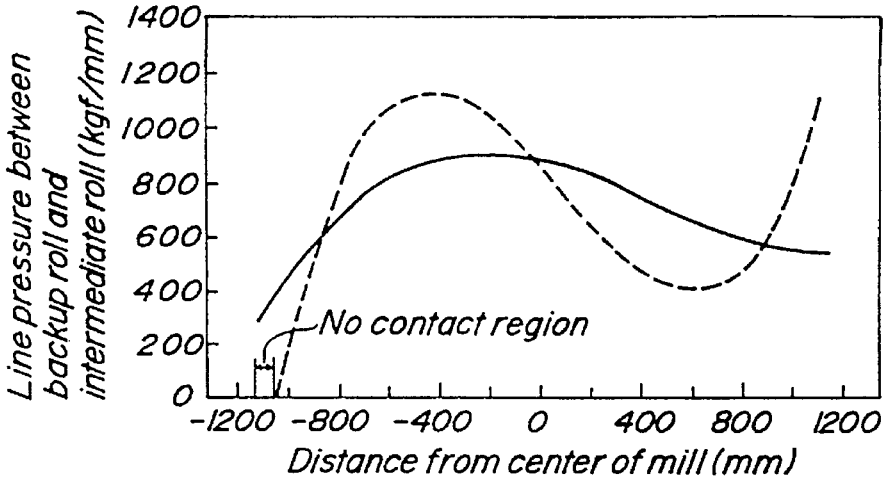
Figure 5C:
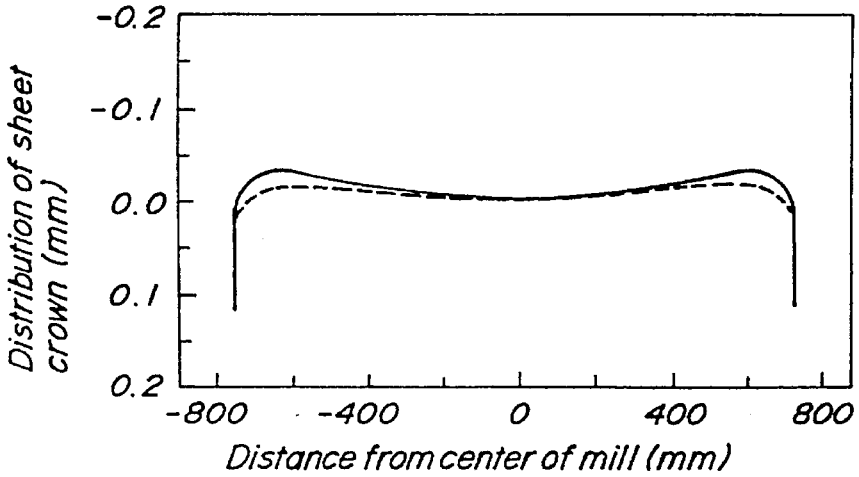

FIGS. 5(*a*), 5(*b*) and 5(*c*) show the result of a comparison of the pressure distribution between rolls and the sheet crown with a case using intermediate roll of L=1.1LB. As shown in FIGS. 5(*a*), 5(*b*) and 5(*c*), when the barrel length is $1.5L_B$ (solid line), the work roll is bent along the intermediate roll, so that the sheet crown is reduced as compared with a case in which the barrel crown is $1.1L_B$. Also, as shown in Table 1, it is apparent that the maximum pressure is smaller when the barrel length is $1.5L_B$, so that it contributes to improve the roll life.

TABLE 1

| Length of intermediate roll | Line pressure (kgf/mm) between intermediate and backup rolls | Line pressure (kgf/mm) between intermediate and work rolls |
|---|---|---|
| $1.5L_B$ | 911 | 986 |
| $1.1L_B$ | 1140 | 1155 |

EXPERIMENTAL EXAMPLE

Next, the results of an experiment about an intermediate roll especially barrel length will be explained as follows.

That is the barrel length of a work roll used was 2300 mm, its diameter was 680 mm, the barrel length of a backup roll used was 2300 mm, and its diameter was 1330 mm. The barrel length of an intermediate roll was variously changed in which the third order coefficient "a" of equation (8) was 0.833. Sheet bars, having width of 1500 mm and thickness of 5.2 mm, were rolled to the thickness of 4.16 mm, and various investigations were made.

Figure 6:
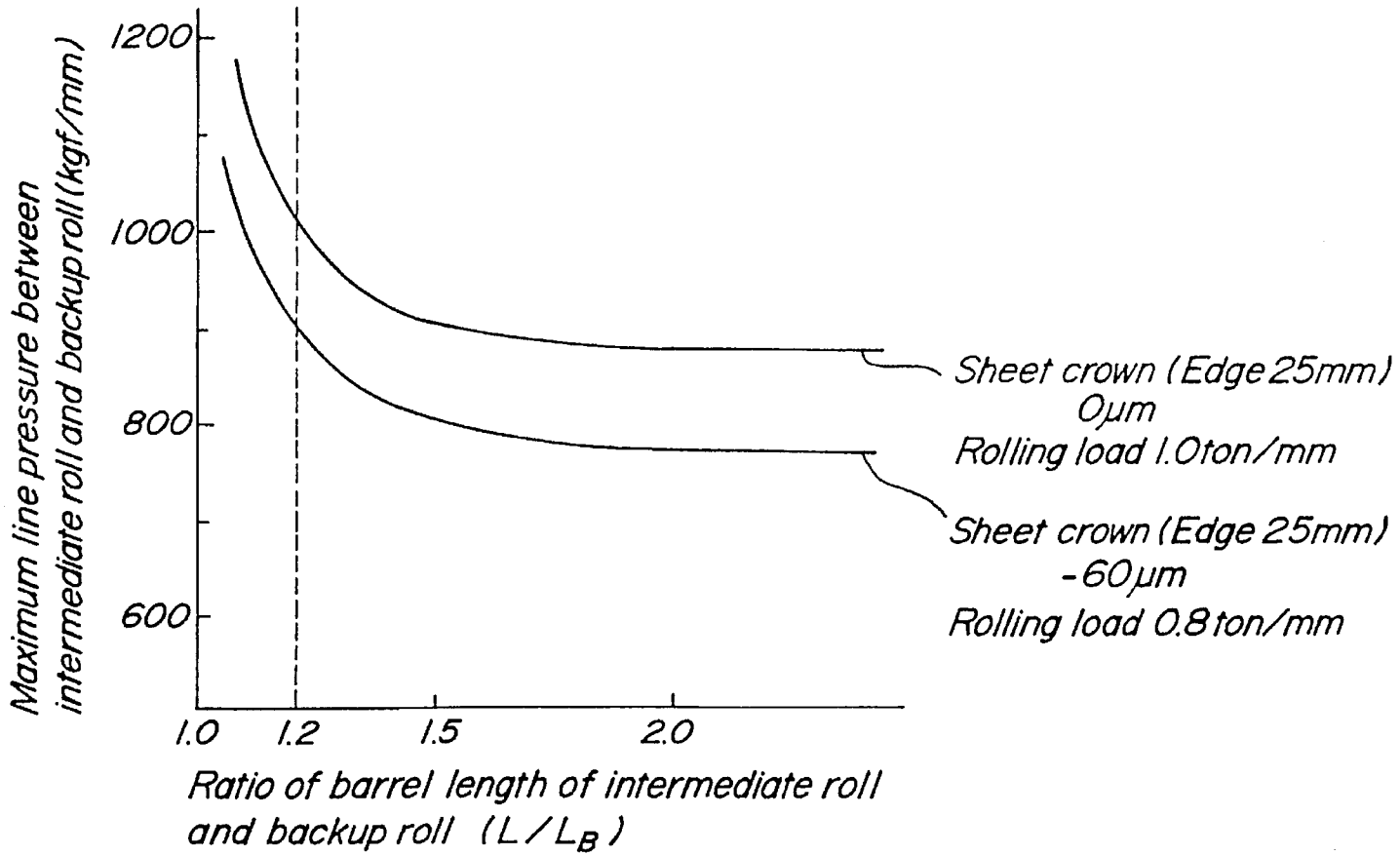
FIG. 6 is a graph showing a relationship between ratio of barrel length of the intermediate and backup rolls and the maximum pressure between rolls.

First, FIG. 6 shows a relation between the ratio ($L/L_B$) of the intermediate and backup roll barrel lengths, and the maximum pressure between the intermediate and backup rolls. As shown in the drawing, when the ratio ($L/L_B$) is increased not less than 1.2 times, the pressure is gently lowered, so that it is apparent that the intermediate roll of long barrel length is favorable.

Figure 7:
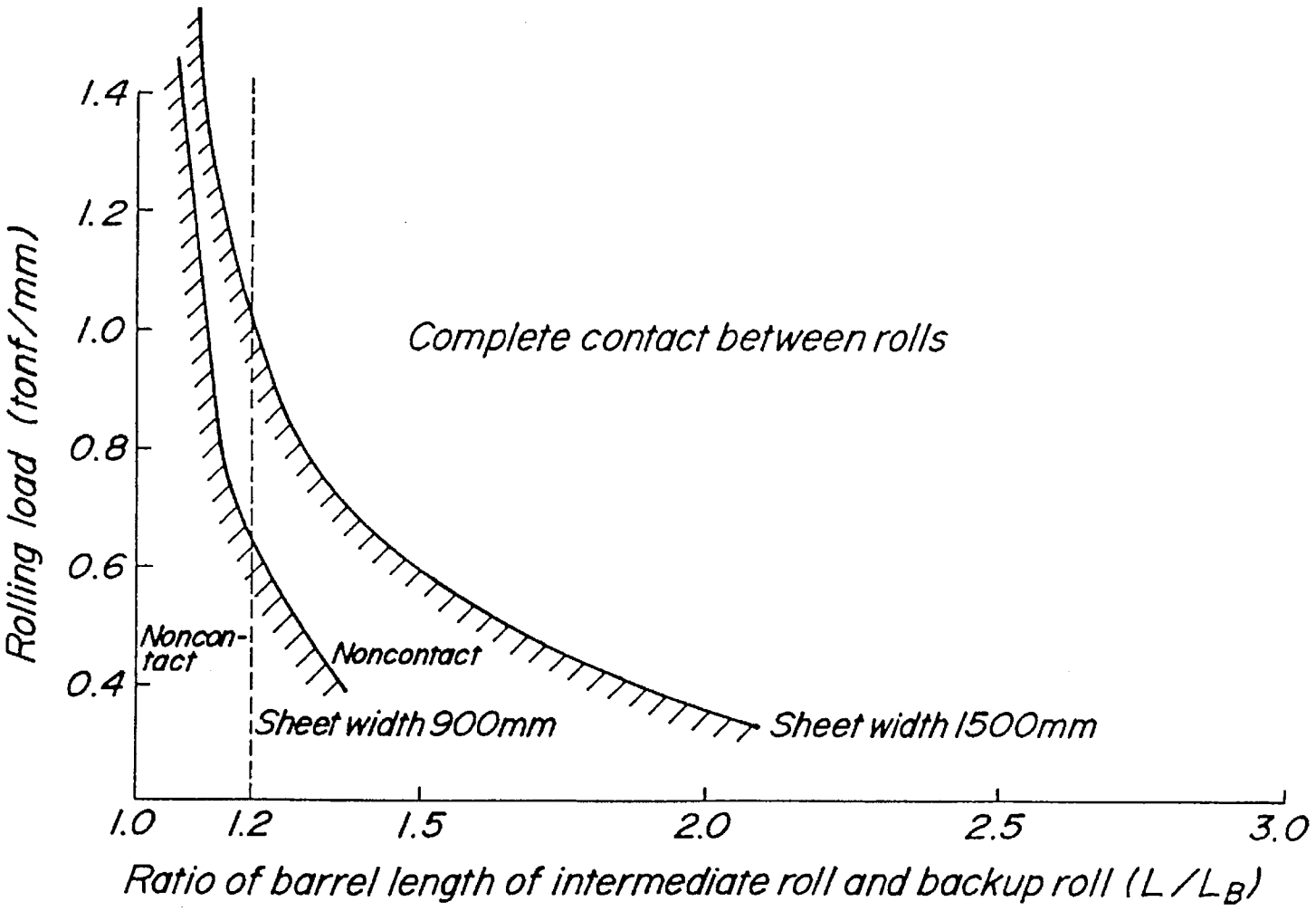
FIG. 7 is a graph showing contact conditions between rolls with respect to the ratio of barrel length of the intermediate and backup rolls.

FIG. 7 shows a contact condition between the intermediate and backup rolls with respect to a ratio of barrel length under the condition that the same sheet crown is obtained. As can be seen from FIG. 7, when the ratio is increased not less than 1.2 times, the occurrence of a noncontact region can be prevented, and it is effective to improve the sheet thickness accuracy and to inhibit the occurrence of meander and reduction ears of sheet.

Figure 8A:
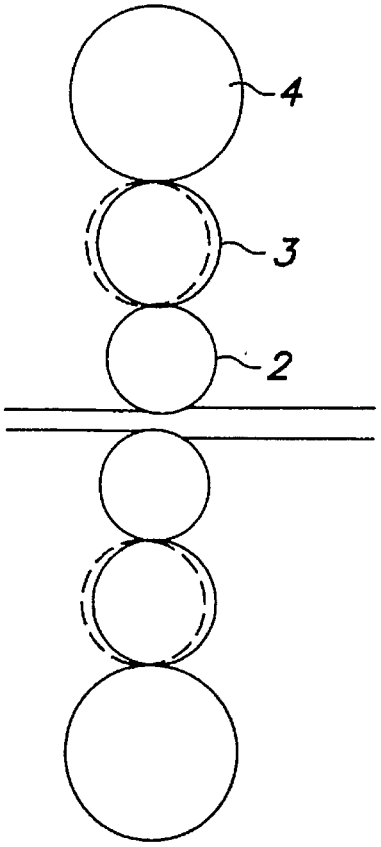
FIGS. 8(*a*) and 8(*b*) are diagrammatic views illustrating a bending of the intermediate roll.
Figure 8B:
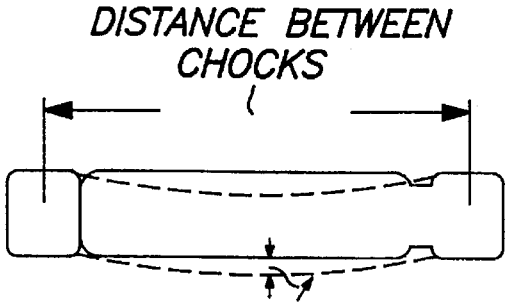
Figure 9:
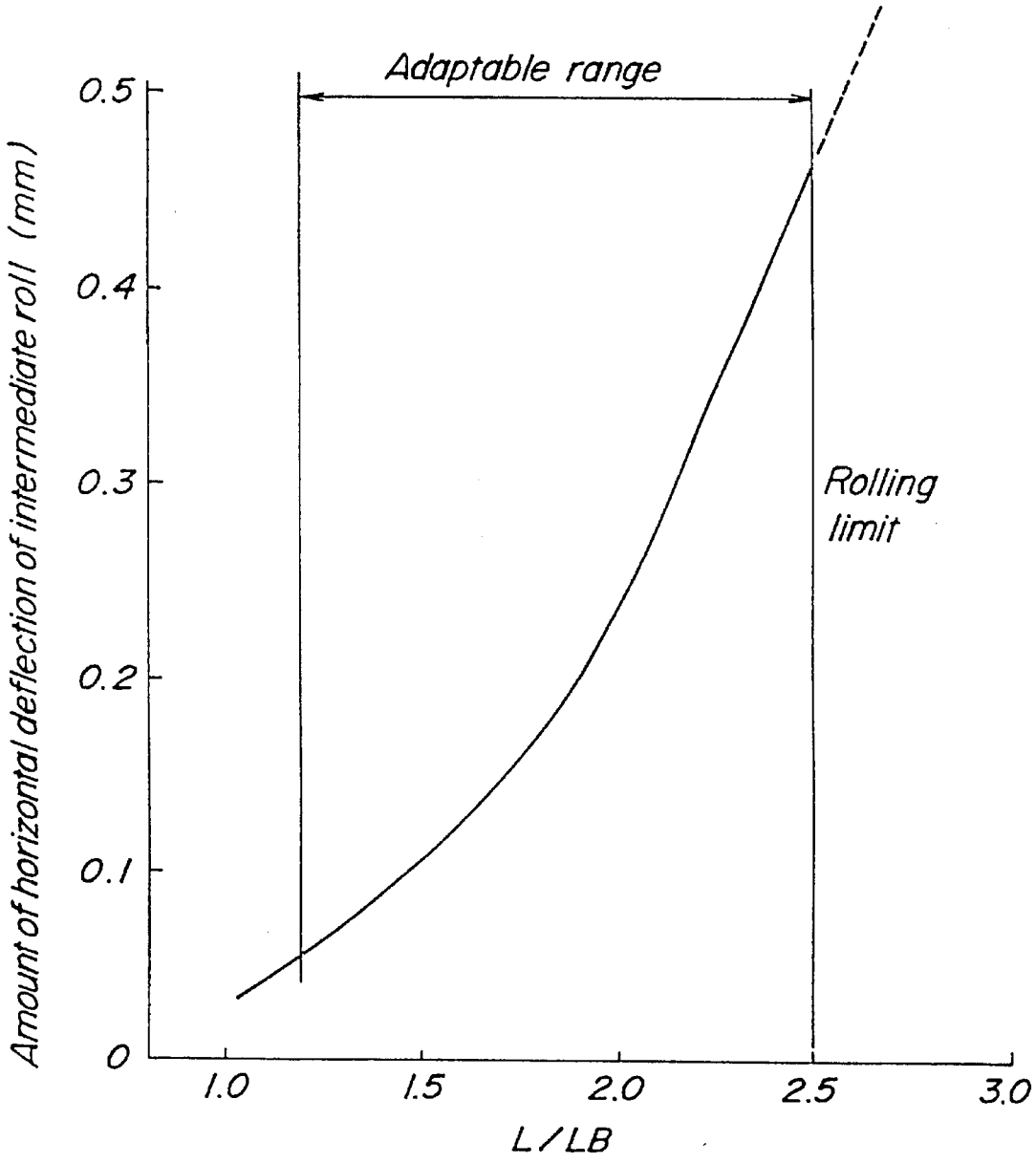
FIG. 9 is a graph showing a relationship between the ratio of barrel length of the intermediate and backup rolls and the deflection amount of the intermediate roll.

In general, when a gap is formed between a block installed in a mill housing for shifting an intermediate roll, and a chock of the intermediate roll (this gap is formed due to abrasion caused by the slide of the intermediate roll, and also due to defective accuracy of the machine), a deflection is generated in the intermediate roll 2 as shown in FIG. 8(*a*). FIG. 9 shows a relation between the horizontal deflection amount t and the ratio ($L/L_B$) of barrel length of the intermediate and backup rolls under the condition that the aforementioned gap is 3 mm, wherein the maximum displacement amount t between the chocks shown in FIG. 8(*b*) is defined as the horizontal deflection amount.

As shown in FIG. 9, the more the ratio is increased, the more the horizontal deflection amount is increased. When the horizontal deflection amount is increased, a gap between the upper and lower work rolls is changed, and when the horizontal deflection amount of the upper intermediate roll and that of the lower intermediate roll becomes different, a roll gap between the upper and lower work rolls becomes varied in the axial direction, therefore the sheet crown and the sheet profile fluctuate during the rolling operation. For that reason, in order to reduce the barrel length ratio, the intermediate roll length is preferred to be short. However, in the case where the horizontal bending amount is to the extent of 0.45 mm, it has little influence on the sheet crown and profile, so that it causes no problem in a normal rolling operation. Further, the aforementioned gap is usually controlled to be not more than 3 mm. Therefore, it is apparent that when the barrel of the intermediate roll is not more than 2.5 times as long as the backup roll, the rolling can be carried out.

SPECIFIC EXAMPLE

A comparative example will be explained as follows in which a crown distribution with respect to the number of rolled sheets and others were investigated in a case using a rolling mill according to the present invention and also in a case using a conventional rolling mill.

Rolling Mill of the Present Invention

In a rolling mill train in which the six high rolling mills structured as shown in FIG. 1 were arranged in three rolling stands in the rear stage, sheet bars of 900 to 1600 mm width and 40 mm thickness, were rolled to a low carbon steel thin sheet of 1.6 to 3.2 mm finished thickness, and then the sheet crown was measured every 5 coils at a position spaced from the edge by 25 mm.

In this case, the barrel length of the work rolls as 2300 mm, that of the intermediate roll was 3450 mm, and that of the backup roll was 2300 mm. Also, a difference between the maximum and minimum diameters of the intermediate roll was 0.8 mm, and the intermediate roll was shifted within a range from 0 mm to 700 mm.

Rolling Mill of the Prior Art

In a rolling mill train in which six high mills were arranged in three rolling stands in the rear stage including the final rolling stand, provided with work rolls, intermediate rolls and backup rolls, all of them being plain rolls and the barrel length of them being 2300 mm while the intermediate rolls were being shifted, rolling operations were carried out in the same manner as the rolling mill of the invention, and the sheet crown was measured in the same manner.

RESULTS OF EXPERIMENTS

Figure 10:
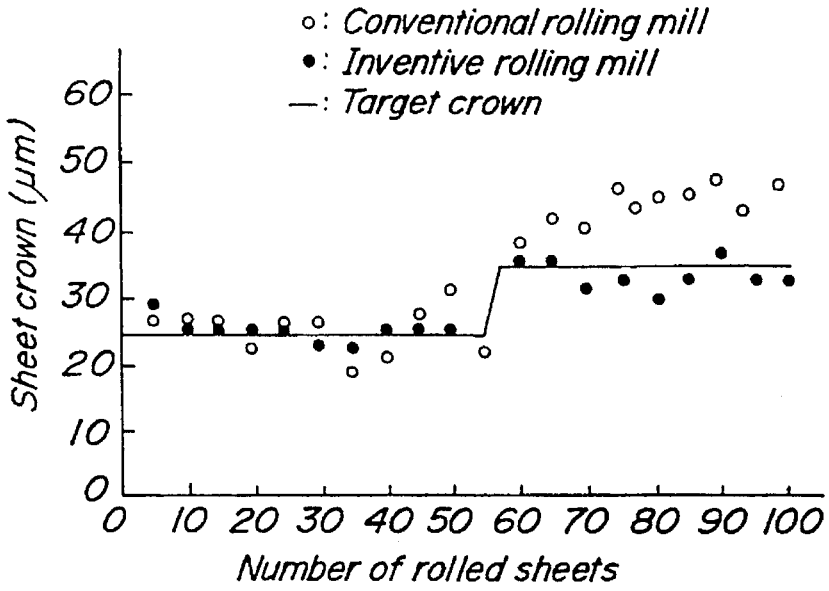
FIG. 10 is a graph showing a distribution of sheet crown with respect to the number of rolled sheets.

Results of measurement are shown in the graph of FIG. 10.

According to the results shown in FIG. 10, when the rolling mill of the present invention was used, it is apparent that a highly accurate sheet rolling operation to obtain a sheet crown close to a target sheet crown was able to be carried out even when the target crown was changed. In this case, the rolling schedule with respect to the sheet width of the rolling mill of the present invention was set to be the same as that of the rolling mill of the prior art.

The frequency of occurring of reduction ears, accuracy of sheet thickness, and average value of sheet crown are shown in Table 2 in the case where 100,000 tons of sheets were rolled in a thin cycle rolling schedule using the aforementioned rolling mills of the invention and conventional rolling mills. According to this table, both the sheet thickness accuracy and the pass property (decrease in the occurrence of reduction ears) of the rolling mill of the invention are far superior to those of the conventional rolling mill.

TABLE 2

| | Average crown $E_{25}$ (μm) | Sheet thickness accuracy 1σ (μm) | Frequency of ears (time) |
|---|---|---|---|
| Inventive rolling mill | 40 | ±46 | 2 |
| Conventional rolling mill | 45 | ±60 | 11 |

In the rolling mill as described above, it is preferable to supply lubricant to gaps between the backup and intermediate rolls and/or the intermediate and work rolls.

Figure 11:
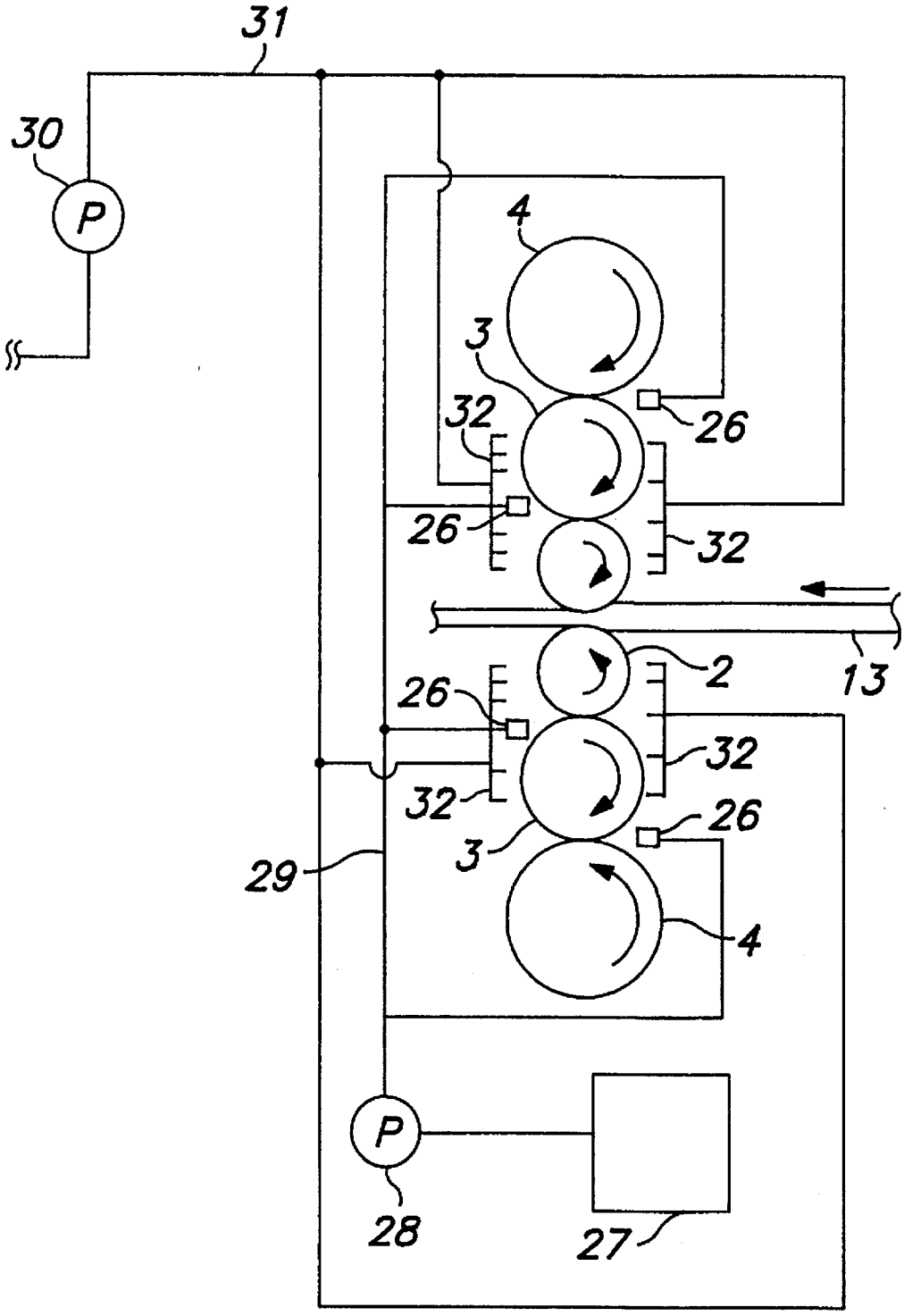
FIG. 11 is a diagrammatic view illustrating a supply of lubricant.

Referring to FIG. 11, lubricant supplying nozzles 26 are arranged to direct lubricant from these nozzles to a gap between the backup roll 4 and the intermediate roll 3 and a gap between the intermediate roll 3 and the work roll 2. The lubricant is supplied to the lubricant supplying nozzles 26 through supply pipes 29 from a lubricant tank 27 by means of a pump 28. Furthermore, coolant is supplied to the intermediate rolls 3 and the work rolls 2 from cooling nozzles 32 through coolant supply pipes 31 by means of a coolant pump 30. The preferred lubricant is highly concentrated emulsion of basic oil including a high pressure agent, but when the lubricant is also used for cooling the rolls, a lubricant having a low concentration may be used.

Figure 12:
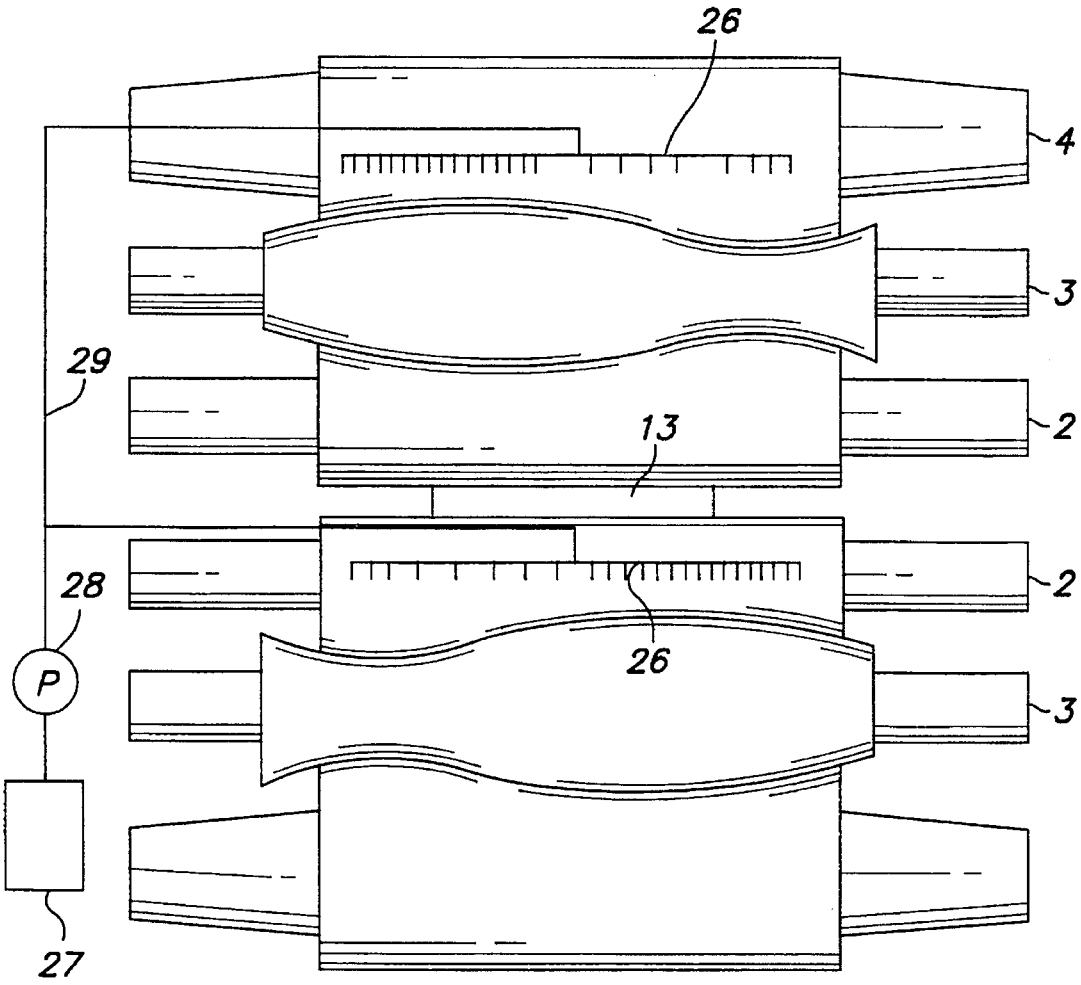
FIG. 12 is a diagrammatic view illustrating a supply of lubricant.

Referring to FIG. 12, the distance between the lubricant supply nozzles 26 for the barrel portion having large diameter of the intermediate roll 3 is preferably smaller than that for the barrel portion having small diameter to increase the supply amount of lubricant. Instead of increasing of lubricant supply amount, the concentration of the lubricant may be varied in the axial direction of the intermediate roll to obtain the same effect as mentioned above.

The rolling mill shown in FIG. 1 was used to roll the sheet bars as mentioned above with use of lubricant of 10% emulsion and coolant of industrial water in a manner as shown in FIG. 11 and at least 120 strips were rolled without occurring of roll seizure. In comparison example using only industrial water as coolant, the sheet bars were rolled in the same manner as mentioned above with using only industrial water as coolant, the roll seizure occurred on the work roll and the intermediate roll when 100 strips have been rolled and rolling operation was stopped.

In the rolling mill including the intermediate roll provided with the roll crown, distribution of the contact pressure between rolls is varied to vary the bending of the work roll, thereby being possible to control the sheet crown, therefor the shape of sheet. Thus, the amount of crown control is not varied by the change of rolling load. Accordingly, when the diameter of the work roll is small, the deflection amount of the center line of the work roll is greatly varied so that the amount of crown control generated by shifting the intermediate roll becomes large. While, when the diameter of the work roll is large, change in the deflection amount of the center line of the work roll is small so that the amount of crown control generated by shifting the intermediate roll becomes small.

Figure 13:
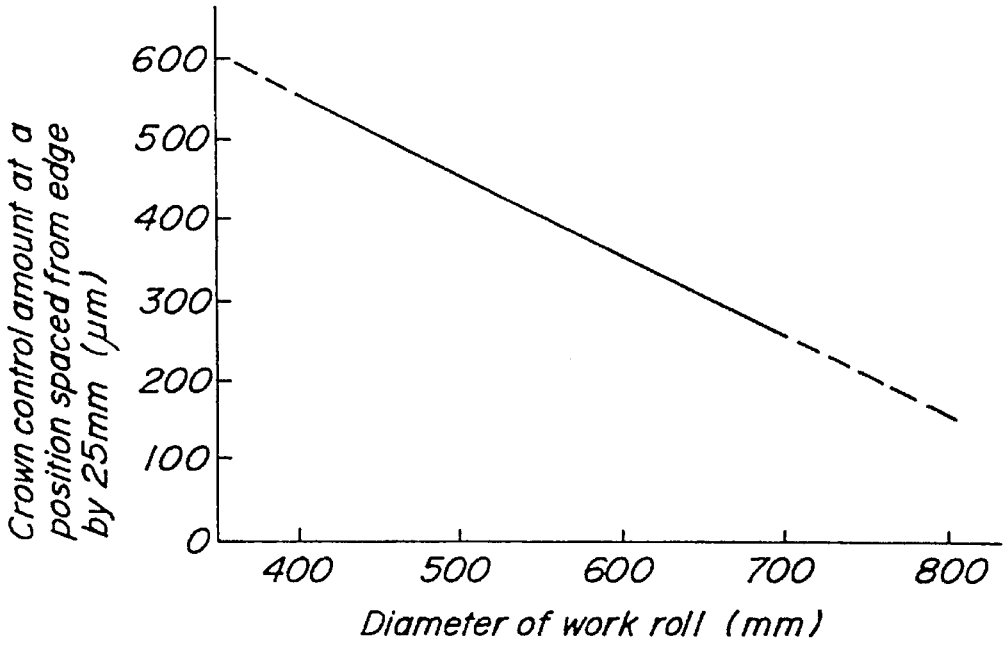
FIG. 13 is a graph showing a relationship between the diameter of the work roll and crown control amount.

Results of test carried on rolled sheets of 1500 mm width with respect to the diameter of work roll and the amount of crown control are shown in FIG. 13. As can be seen from FIG. 13, when the diameter of the work roll is small, preferably not more than 700 mm, the amount of crown control becomes large, but when the diameter of the work roll is smaller than 400 mm, the amount of horizontal bending of the work roll becomes large and the roll profile becomes wrong so that the work roll is difficult to be driven and the effect caused by bending of the work roll is decreased. Accordingly, the diameter of the work roll of at least of 400 mm is desirable.

EXAMPLE 2

Figure 14:
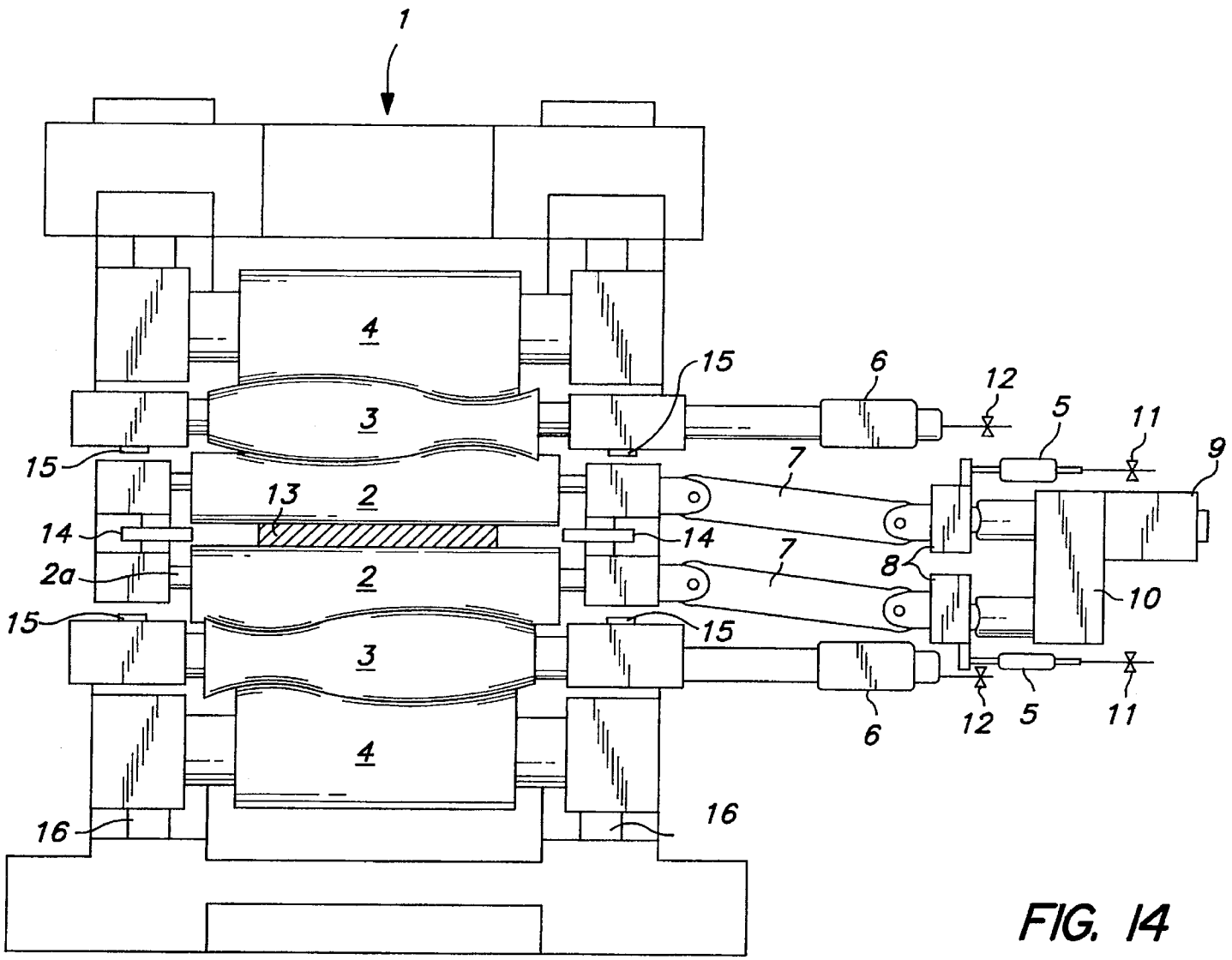
FIG. 14 is a schematic front view illustrating a rolling mill.

FIG. 14 shows a rolling mill which is improved in the mill rigidity by extending the roll barrel of the work roll 2 to make its barrel length longer than that of the intermediate roll 3 in the six high rolling mill shown in FIG. 1. The mill rigidity of the rolling mill is determined by an amount of gap between work rolls when the rolling load is changed. The amount of gap is influenced by the deflection of the backup rolls, the elastic deformation of the housing and others and the flat deformation between rolls. When the barrel length of the work roll is long and then the region contacting the work roll and the intermediate roll is long, the mill rigidity of the rolling mill is great since the contacting pressure between rolls is smaller than that of the case of a shorter contacting region even if the rolling load is changed. Therefor, when the barrel length of the work roll is long, even if the sheet passes in a position deviated from the center of the rolling mill, the variation in the pressure between rolls is small and then the difference between the amounts of deformation at the left and right side with respect to the center line of the sheet is small. Accordingly the work roll having a long roll barrel is effective for preventing from meandering of sheet occurring of reduction ears.

It should be noted that a preferred range of the barrel length is 1.5–2.5 times as long as that of the backup roll as described above, and a reason of such limited range is substantially the same as the aforementioned reason for the intermediate roll.

A comparative test will be explained in connection with a crown distribution with respect to the number of rolled sheets and others which were investigated in a case using the rolling mill according to this example and also in a case using a conventional rolling mill.

In a hot finish rolling mill train in which the six high rolling mills structured as shown in FIG. 14 were arranged in three rolling stands in the rear stage, sheet bars were rolled under the same conditions as in the aforementioned Example 1, and then the sheet crown was measured every 5 coils at a position spaced from the edge by 25 mm.

In this case, the barrel length of the work roll was 3400 mm, that of the intermediate roll was 3000 mm, and that of the backup roll was 2300 mm. Also, a difference between the maximum and minimum diameters of the intermediate roll was 0.8 mm, and the intermediate roll was shifted within a range from 0 mm to 700 mm.

It is noted that a specification of the conventional rolling mill used in this comparative test is the same as in the case of the Example 1.

RESULTS OF EXPERIMENTS

Figure 15:
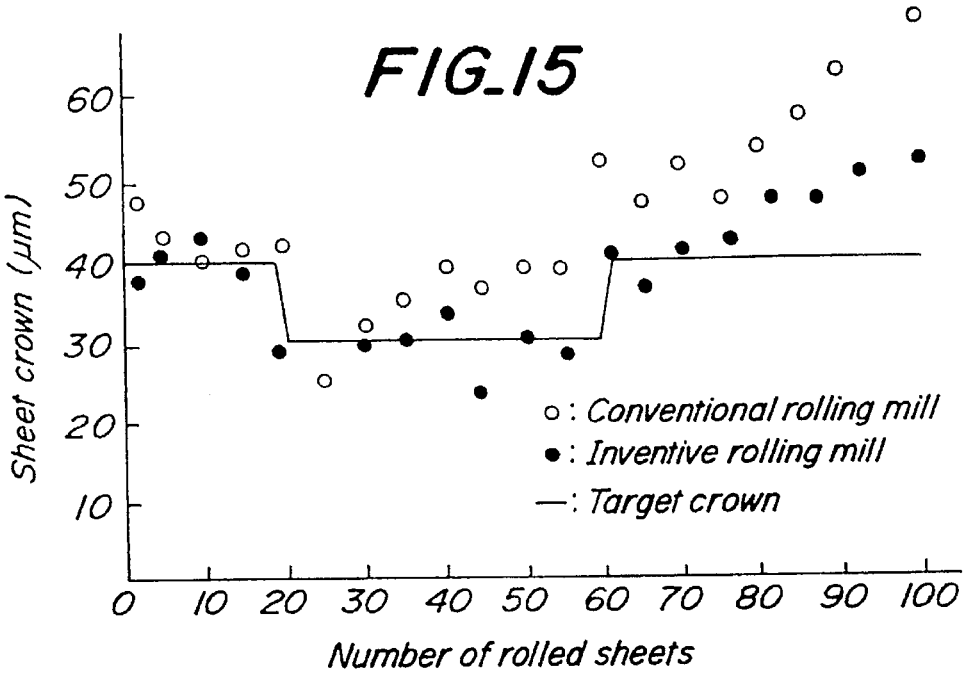
FIG. 15 is a graph showing a distribution of sheet crown with respect to the number of rolled sheets.

Results of measurement are shown in the graph of FIG. 15. According to the results shown in FIG. 15, when the rolling mill of the present invention was used, it is apparent that a highly accurate sheet rolling operation to obtain a sheet crown extremely close to a target sheet crown was able to be carried out even when the target crown was changed.

The frequency of occurring reduction ears, accuracy of sheet thickness, and average value of sheet crown are shown in Table 3 in the case where 100,000 tones of sheets were rolled in a thin cycle rolling schedule using the aforementioned rolling mills of the invention and conventional rolling mills. According to this table, both the sheet thickness accuracy and the pass property (decrease in the occurrence of reduction ears) of the rolling mill of the invention are far superior to those of the conventional rolling mill.

TABLE 3

| | Average Crown $E_{25}$ (μm) | Sheet thickness accuracy 1σ (μm) | Frequency of ears (time) |
|---|---|---|---|
| Inventive rolling mill | 45 | ±38 | 1 |
| Conventional rolling mill | 50 | ±60 | 11 |

In a cold rolling mill train consisting of four rolling stands in which the six high rolling mills structured as shown in FIG. 1 were arranged in the first rolling stand, sheet bars of 900 to 1600 mm width and 2–3 mm thickness, were rolled to a low carbon steel thin sheet of 1.6 to 0.5 mm finished thickness, and then the sheet thickness deviation was investigated at a position spaced from the edge by 100 mm.

In this case, the barrel length of the work roll was 2000 mm, that of the intermediate roll was 2700 mm, and that of the backup roll was 2000 mm. Also, a difference between the maximum and minimum diameters of the intermediate roll was 0.8 mm, and the intermediate roll was shifted within a range from 0 mm to 700 mm.

Rolling Mill of the Prior Art

A six high mill is arranged in the first rolling stand and provided with work rolls, intermediate rolls and backup rolls, all of them being plain rolls and the barrel length of them being 2000 mm while the intermediate rolls were being shifted, rolling operations were carried out in the same manner as the rolling mill of the invention, and the sheet thickness deviation was measured in the same manner.

RESULTS OF EXPERIMENTS

Figure 16:
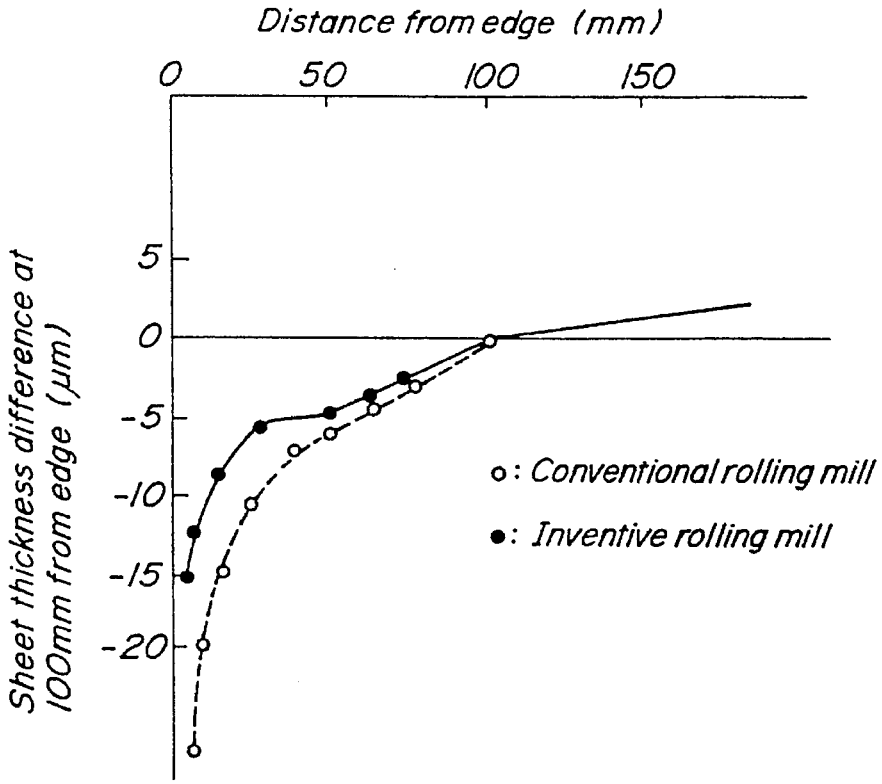
FIG. 16 is a graph showing amount of occurred edge drops.

Results of measurement are shown in the graph of FIG. 16. According to the results shown in FIG. 16, when the rolling mill of the present invention was used, it is apparent that occurring of edge drop is reduced.

The frequency of occurring of reduction ears and amount of edge drop are shown in Table 4 in the case where 100,000 tons of sheets were rolled by use of the aforementioned rolling mills of the invention and conventional rolling mills. According to this table, both the sheet thickness accuracy and the pass property (decrease in the occurrence of reduction ears) of the rolling mill of the invention are far superior to those of the conventional rolling mill. The amount of edge drop is defined by thickness deviations at positions spaced from the edge by 100 mm and 7.5 mm.

TABLE 4

| | Amount of edge drop (μm) | Frequency of ears (time) |
|---|---|---|
| Inventive rolling mill | 12 | 0 |
| Conventional rolling mill | 15 | 3 |

In case of applying the six high rolling mill according to the present invention for cold rolling sheet, in particular for controlling the edge drop in the sheet, since deformation of the sheet in a direction of sheet width decreases as the sheet passes through the rear stands in the cold rolling mill train, the six high rolling mill should be arranged in the first stand, and preferably the six high rolling mills are applied for the rear stands in order from the first stand. The strip sheet is subjected to a tension between the stands of the cold rolling mill train so that the meander of the sheet is restrained, but if the hot rolled sheet has a large camber and wedge, the reduction ear sometimes occurs owing to the camber and wedge. In the rolling mill of the present invention, however the intermediate roll has a long roll barrel to secure the mill rigidity so that it is possible to prevent the reduction ear from occurring in the sheet.

Next, a six high rolling mill including intermediate rolls having a roll crown which is tapered toward one end or both ends will be described.

EXAMPLE 4

Figure 17:
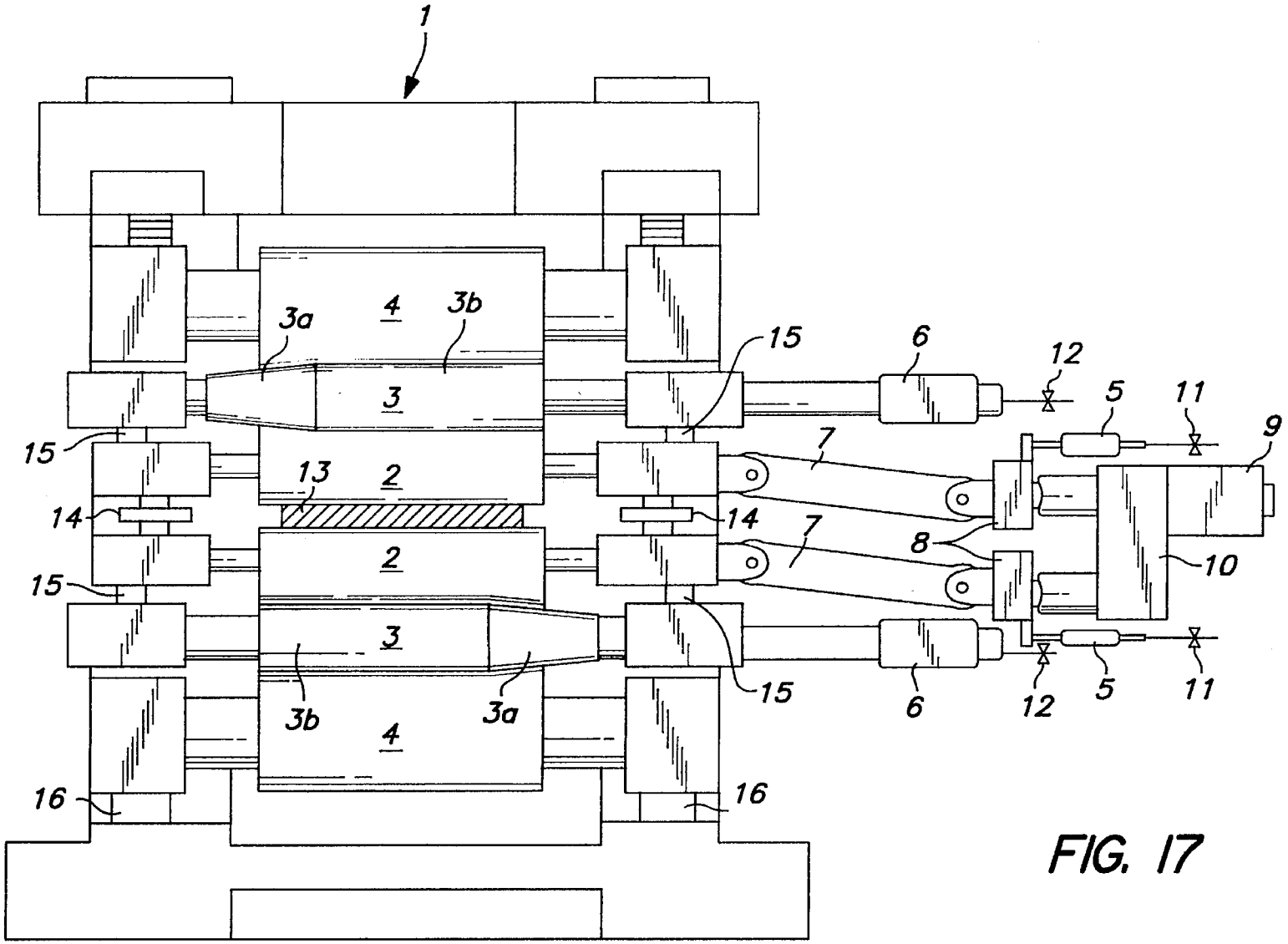
FIG. 17 is a schematic front view illustrating a rolling mill.

FIG. 17 illustrates a rolling mill having a construction similar to the rolling mill shown in FIG. 1, except that each of intermediate rolls 3 has a roll crown which is tapered toward one end of the roll barrel. That is each of the intermediate rolls 3 has a tapered barrel end portion 3*a* at mutually opposite sides and a plain barrel portion 3*b* extending over the greater part of the barrel length from the tapered barrel end portion *a* and having a constant diameter.

Furthermore, the roll barrel of each of the intermediate rolls 3 has such a barrel length that the roll barrel contacts with the roll barrel of the backup roll 4 over the full length thereof in the maximum shifted position of the intermediate roll and the tapered barrel end portion 3*a* of the intermediate roll 3 extends beyond the barrel end of the backup roll 4 in no shift position of the intermediate roll.

Under a rolling load, the tapered barrel end portion 3*a* contacts with at least the backup roll 4, usually both the work roll 2 and backup roll 4 even if the work roll 2 is shifted to effectively reduce the contact pressure between these rolls. Therefor, the sheet crown can be controlled by appropriately selecting positions contacting the tapered barrel end portion 3*a* with the work roll 2 and the backup roll 4 by shifting the intermediate roll 3, if necessary.

Figures 18A, 18B:
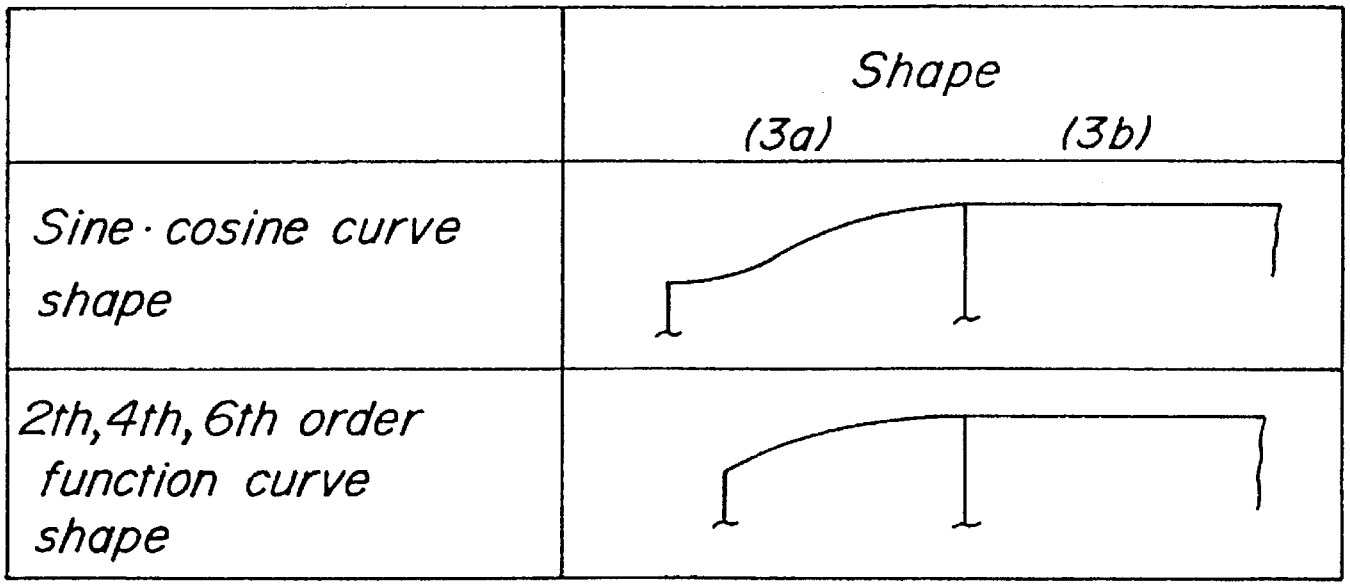
FIGS. 18(*a*) and 18(*b*) are diagrammatic views illustrating a tapered portion of a roll.

The contour shape of the tapered portion 3*a* of the intermediate rolls 3 may be made not only of the tapered shapes shown in FIG. 17, but also sine or cosine curve shapes as shown in FIG. 18(*a*), or a curve shape defined by a high order function such as second order, fourth order, sixth order or more high order function as shown in FIG. 18(*b*) depending on a required sheet crown, the maximum shift amount of the intermediate roll or the like.

Figure 19:
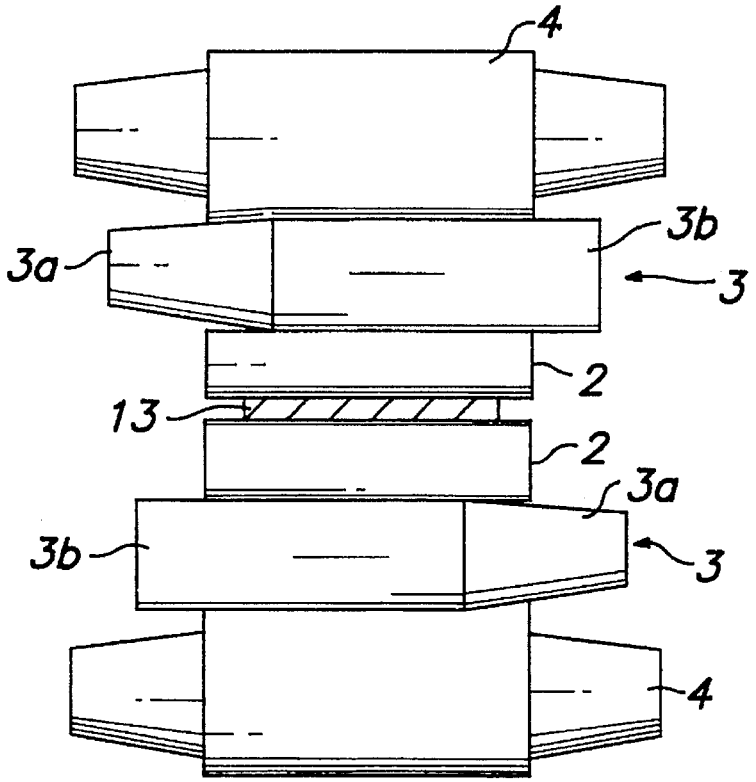
FIG. 19 is a schematic view illustrating intermediate rolls in shifted position.

In such a rolling mill, when the intermediate roll 3 is shifted in point symmetry, for example, as shown in FIG. 19, the contact pressure of the barrel portion of each of the rolls 2 and 4 which contacts with the tapered portion 3*a* of the intermediate roll 3 can be reduced extremely effectively, and owing to this fact, in combination with the action of the roll benders 14 and 15, the plate crown can be optionally controlled over a wide range.

Figure 20:
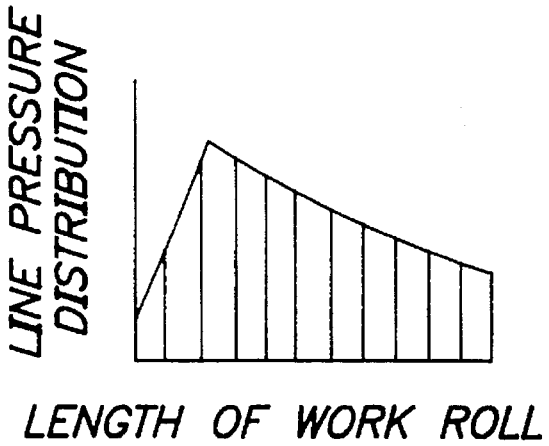
FIG. 20 is a graph showing a distribution of pressure between rolls.

FIG. 20 is a graph showing a distribution of contact pressure between the upper side work roll 2 and the intermediate roll 3, wherein in the contact state of the both rolls 2 and 3, the pressure acting from the intermediate roll 3 to the work roll 2 at the contact portion of the work roll 2 with the tapered portion 3*a* decreases as its diameter becomes small corresponding to the tapered shape of the tapered portion 3*a*, which becomes the smallest value at the barrel end of the work roll 2. Therefore, the work roll 2 is curved into a shape forming a convex form downwardly all over the roll, the sheet crown of the sheet 13 is effectively reduced as compared with a case in which the intermediate roll 3 is not shifted.

Thus, according to this rolling mill, especially the intermediate roll 3 has the length which is longer than that of the backup roll 4, and even when the intermediate roll 3 is shifted, the contact length of the intermediate roll 3 between the backup roll 3 and the intermediate roll 3 between the work roll 2 do not change, and the mill rigidity of the rolling mill does not change, so that the sheet thickness accuracy of the hot finish rolling is greatly improved, and even when the center of a sheet bar has deviated from the center line of the rolling mill, the change in pressure at the right and left side portions of the rolling mill becomes smaller than that in the prior art, and the change in roll flattening amount between rolls becomes small further the sheet wedge becomes small, so that the camber of the sheet can be effectively reduced.

Also in this case, even in a state in which the intermediate roll 3 is not shifted at all, the tapered portion 3*a* of the intermediate roll 3 contacts with the barrel end portion of each of the work roll 2 and the backup roll 4, so that the occurrence of the sheet crown can be effectively reduced.

EMBODICAL EXAMPLE

A comparative test will be explained hereinafter, in which a crown distribution with respect to the number of rolled sheets and others were investigated in a case using a rolling mill according to the present invention and also in a case using a conventional rolling mill.

Rolling Mill of the Present Invention

In a rolling mill train in which the six high rolling mills structured as shown in FIG. 17 were arranged in three rolling stands in the rear stage, sheet bars of 900 to 1600 mm width and 40 mm thickness, were rolled to a low carbon steel thin sheet of 1.6 to 3.2 mm finished thickness, and then the sheet crown was measured every 5 coils at a position spaced from the edge by 25 mm.

In this case, the barrel lengths of the work roll and backup roll were 2300 mm respectively, and that of the intermediate roll was 3000 mm. Also, a tapered portion of the intermediate roll was tapered by $1.6\times10^{-3}$ (0.32 mm/200 mm per diameter), and the intermediate roll was shifted within a range from 0 mm to 700 mm.

Rolling Mil of the Prior Art

In a rolling mill train in which six high mills were arranged in three rolling stands in the rear stage including the final rolling stand, provided with work rolls, intermediate rolls and backup rolls, all of them being plain rolls and the barrel length of them being 2300 mm while the intermediate rolls were being shifted, rolling operations were carried out in the same manner as the rolling mill of the invention, and the sheet crown was measured in the same manner.

RESULTS OF EXPERIMENTS

Figure 21:
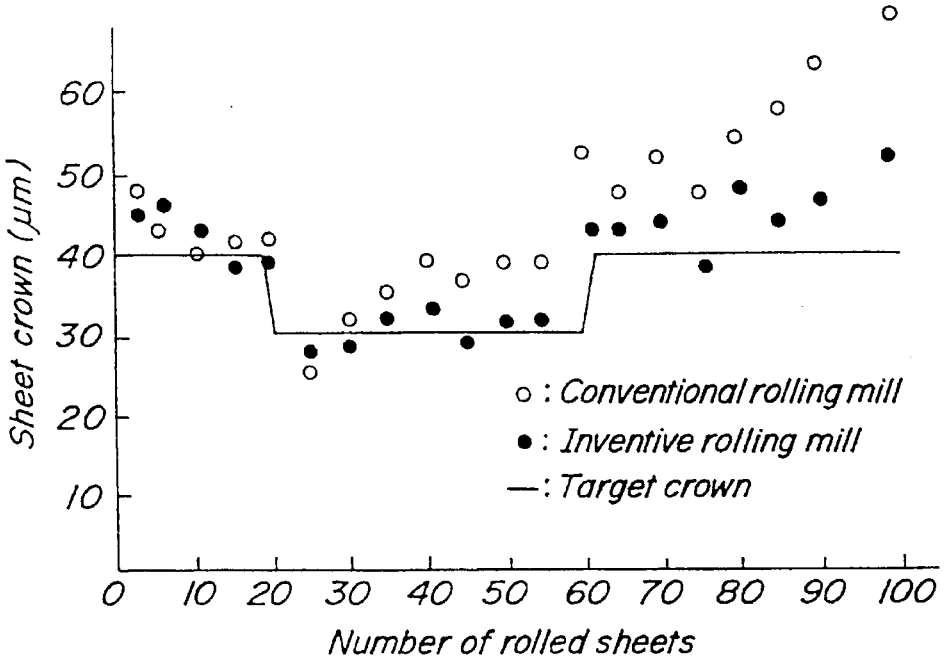
FIG. 21 is a graph showing a distribution of sheet crown with respect to the number of rolled sheets.

Results of measurement are shown in the graph of FIG. 21. According to the results shown in FIG. 21, when the rolling mill of the present invention was used, it is apparent that a highly accurate sheet rolling operation to obtain a sheet crown extremely close to a target sheet crown was able to be carried out even when the target sheet crown was changed. In this case, the rolling schedule with respect to the sheet width of the rolling mill of the present invention was set to be the same as that of the rolling mill of the prior art.

The frequency of occurring reduction ears, accuracy of sheet thickness, and average value of sheet crown are shown in Table 5 in the case where 100,000 tons of sheets were rolled. According to this table, both the sheet thickness accuracy and the pass property (decrease in the occurrence of reduction ears) of the rolling mill of the invention are far superior to those of the conventional rolling mill.

TABLE 5

| | Average Crown $E_{25}$ (μm) | Sheet thickness accuracy 1σ (μm) | Frequency of ears (time) |
|---|---|---|---|
| Inventive rolling mill | 44 | ±43 | 5 |
| Conventional rolling mill | 50 | ±60 | 12 |

EXAMPLE 5

Figure 22:
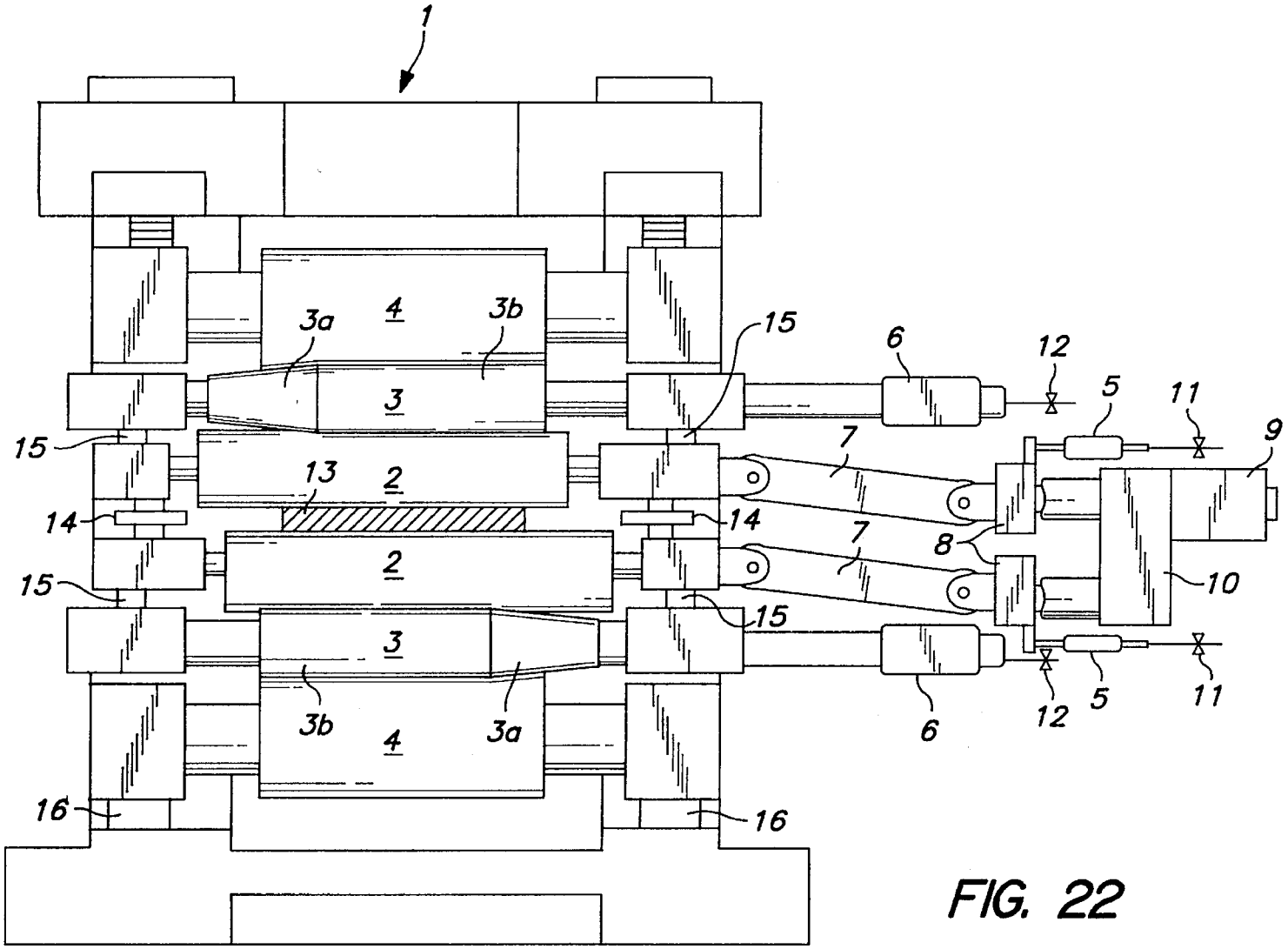
FIG. 22 is a schematic front view illustrating a rolling mill.

FIG. 22 illustrates a rolling mill similar to the six high rolling mill shown in FIG. 17, except that the barrel length of the work roll 2 is longer than that of the intermediate roll 3.

A comparative test was carried out in which a crown distribution with respect to the number of rolled sheets and others were investigated in a case using a rolling mill according to the present invention and also in a case using a conventional rolling mill.

Rolling Mill of the Present Invention

In a hot finish rolling mill train in which the six high rolling mills structured as shown in FIG. 22 were arranged in three rolling stands in the rear stage, sheet bars were rolled under the same condition as in the aforementioned Example 4, and then the sheet crown was measured every 5 coils at a position spaced from the edge by 25 mm.

In this case, the barrel length of the work roll was 3400 mm, that of the intermediate roll was 3000 mm, and that of the backup roll was 2300 mm. Also, the intermediate roll is provided with the same taper shaped crown as in the Example 4, and the intermediate roll was shifted within a range from 0 mm to 700 mm. It is noted that a specification of the conventional rolling mill used in this comparative test is the same as in the case of the Example 4.

RESULTS OF EXPERIMENTS

Figure 23:
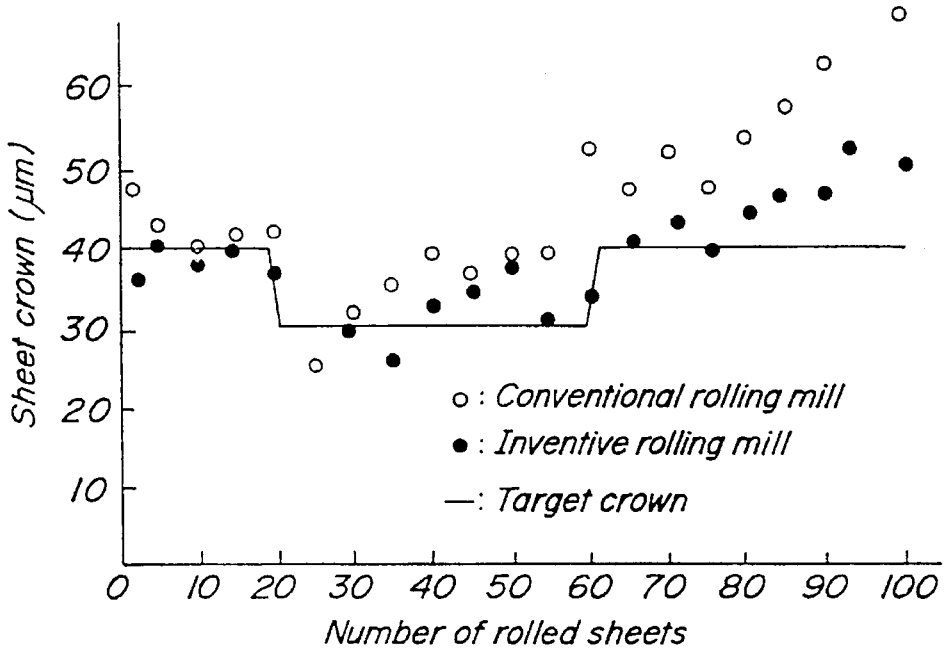
FIG. 23 is a graph showing a distribution of sheet crown with respect to the number of rolled sheets.

Results of measurement are shown in the graph of FIG. 23. According to the results shown in FIG. 23, when the rolling mill of the present invention was used, it is apparent that a highly accurate sheet rolling operation to obtain a sheet crown extremely close to a target sheet crown was able to be carried out even when the target crown was changed.

The frequency of occurring of reduction ears, accuracy of sheet thickness, and average value of sheet crown are shown in Table 6 in the case where 100,000 tons of sheets were rolled by using the aforementioned rolling mills of the invention and conventional rolling mills. According to this table, both the sheet thickness accuracy and the pass property (decrease in the occurrence of reduction ears) of the rolling mill of the invention are far superior to those of the conventional rolling mill.

TABLE 6

| | Average Crown $E_{25}$ (μm) | Sheet thickness accuracy 1σ (μm) | Frequency of ears (time) |
|---|---|---|---|
| Inventive rolling mill | 46 | ±36 | 3 |
| Conventional rolling mill | 50 | ±60 | 12 |

EXAMPLE 6

Figure 24:
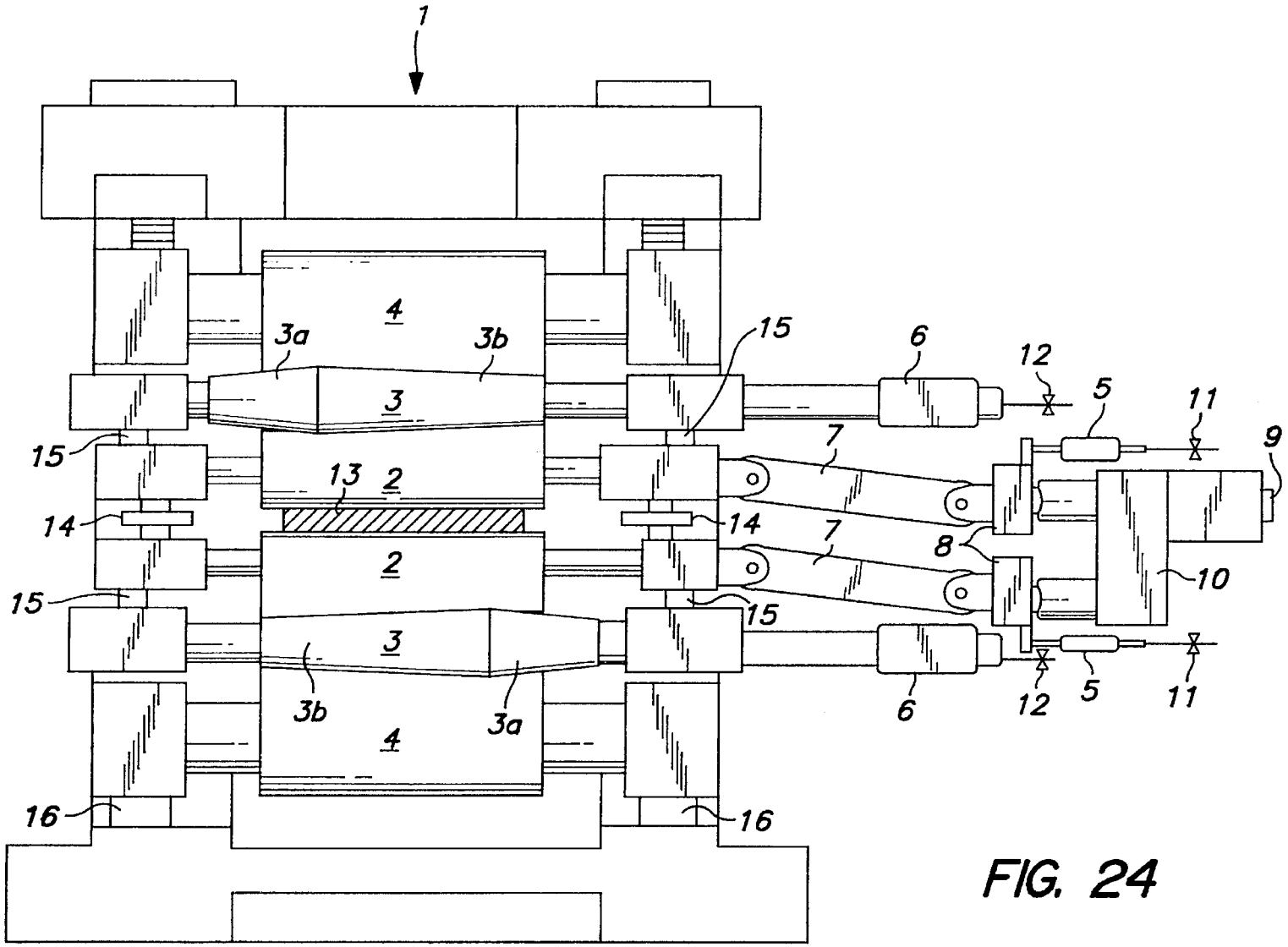
FIG. 24 is a schematic front view illustrating a rolling mill.

FIG. 24 illustrates a rolling mill having a construction similar to the rolling mill shown in FIG. 1, except that each of intermediate rolls 3 has a roll crown which is tapered from the center of the roll barrel toward the opposite barrel ends. That is, each of the intermediate rolls has a tapered end portion 3*a* and a gently tapered end portion 3*b* to form an asymmetric convex roll crown. Each of the intermediate roll 3 has such a barrel length that the roll barrel contacts with the roll barrel of the backup roll 4 over the full length thereof in the maximum shifted position of the intermediate roll.

Under a rolling load, the tapered portion 3*a* contacts with at least the backup roll 4, usually, both the work roll 2 and backup roll 4 even if the work roll 2 is shifted to effectively reduce the contact pressure between these rolls. Therefor, the sheet crown can be controlled by appropriately selected a position of a boundary between the tapered portions 3*a* and 3*b* by shifting the intermediate roll 3, if necessary.

Figure 25:
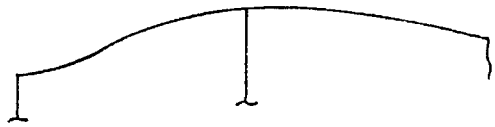
FIG. 25 is a diagrammatic view illustrating a tapered portion of a roll.
Figure 25:
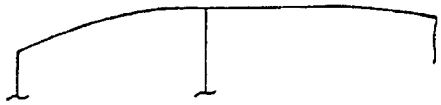

The contour shape of the roll crown of the intermediate roll may be made not only the tapered shape shown in FIG. 24, but also a sine or cosine curve shape as shown in FIG. 25 or a curve shape defined by a high order function such as second order, fourth order, sixth order or more high order function as shown in FIG. 25 depending on a required sheet crown, the maximum shift amount of the intermediate roll or the like. Moreover, the contour shape of both the tapered portions may be a similar shape or different shape.

Figure 26:
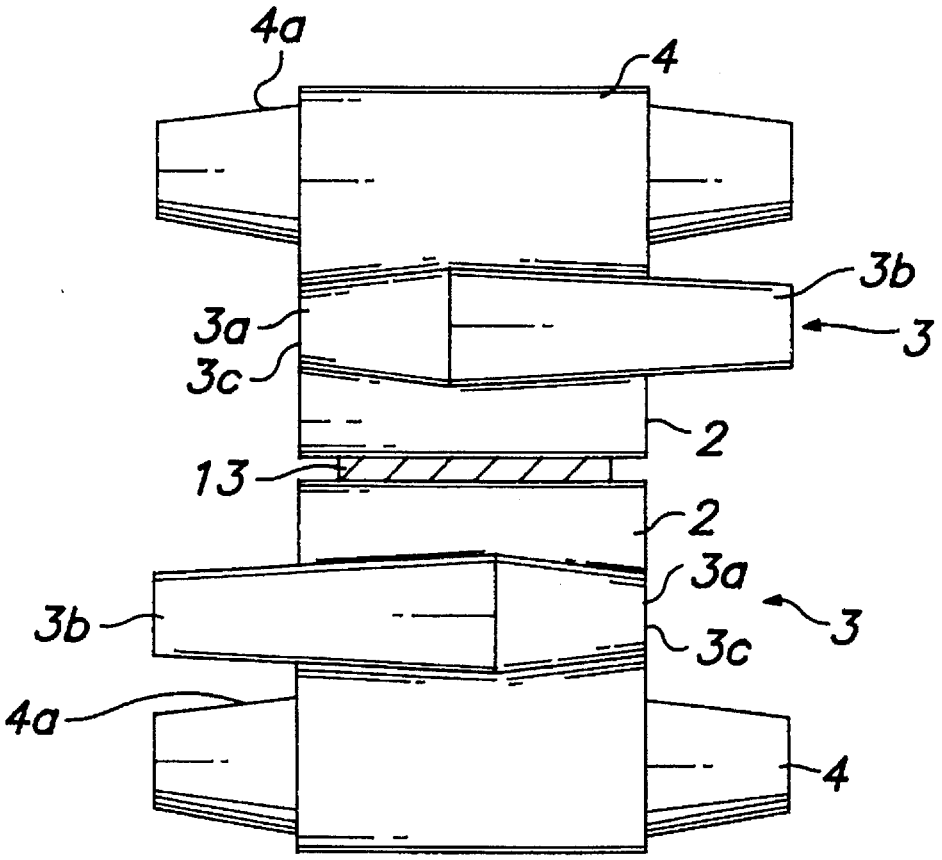
FIG. 26 is a schematic view illustrating intermediate rolls in shifted position.

In such a rolling mill, when the intermediate roll 3 is shifted in point symmetry, for example, as shown in FIG. 26, the contact pressure of the barrel portion of each of the rolls 2 and 4 which contacts with the tapered portions 3*a* and 3*b* of the intermediate roll 3 can be reduced extremely effectively, and owing to this fact, in combination with the action of the roll benders 14 and 15, the sheet crown can be optionally controlled over a wide range, if necessary..

Particularly, in case of providing the roll crown tapered toward the opposite ends of the roll barrel, the boundary between the tapered portions 3*a* and 3*b* can coincide with the center in the axial direction of the roll barrel of the backup roll 4 in the maximum shift position in which the barrel end 4*a* of the backup roll 4 coincides with the barrel end 3*c* of the intermediate roll 3 as shown in FIG. 26, thereby causing the rigidity of the rolling mill in the axial direction of the roll to make uniform.

A distribution of contact pressure between the upper work roll 2 and the upper intermediate roll 3 in this rolling mill is the same as that shown in FIG. 20, that is, the pressure acting from the intermediate roll 3 to the work roll 2 at the contact portion of the work roll 2 with the tapered portion 3*a* decreases as its diameter becomes small corresponding to the tapered shape of the tapered portion 3*a*, which becomes the smallest value at the barrel end of the work roll 2. Therefore, the work roll 2 is curved into a shape forming a convex form downwardly all over the roll, and the sheet crown of the sheet 13 is effectively reduced as compared with a case in which the intermediate roll 3 is not shifted.

EMBODICAL EXAMPLE

A comparative test will be explained hereinafter, in which a crown distribution with respect to the number of rolled sheets and others were investigated in a case using a rolling mill according to the present invention and also in a case using a conventional rolling mill.

Rolling Mill of the Present Invention

In a rolling mill train in which the six high rolling mills structured as shown in FIG. 24 were arranged in three rolling stands in the rear stage, sheet bars of 900 to 1600 mm width and 40 mm thickness, were rolled to a low carbon steel thin sheet of 1.6 to 3.2 mm finished thickness, and then the sheet crown was measured every 5 coils at a position spaced from the edge by 25 mm.

In this case, the barrel lengths of the work roll and backup roll were 2300 mm, respectively, and that of the intermediate roll was 3000 mm. Also, tapered portions 3*a* and 3*b* of the intermediate roll were tapered by $1.6\times10^{-3}$ (0.32 mm/200 mm per diameter) and $0.1\times10^{-3}$ (0.02 mm/200 mm per diameter), respectively, and the intermediate roll was shifted within a range from 0 mm to 700 mm.

Rolling Mill of the Prior Art

In a rolling mill train in which six high mills were arranged in three rolling stands in the rear stage including the final rolling stand, provided with work rolls, intermediate rolls and backup rolls, all of them being plain rolls and the barrel length of them being 2300 mm while the intermediate rolls were being shifted, rolling operations were carried out in the same manner as the rolling mill of the invention, and the sheet crown was measured in the same manner.

RESULTS OF EXPERIMENTS

Figure 27:
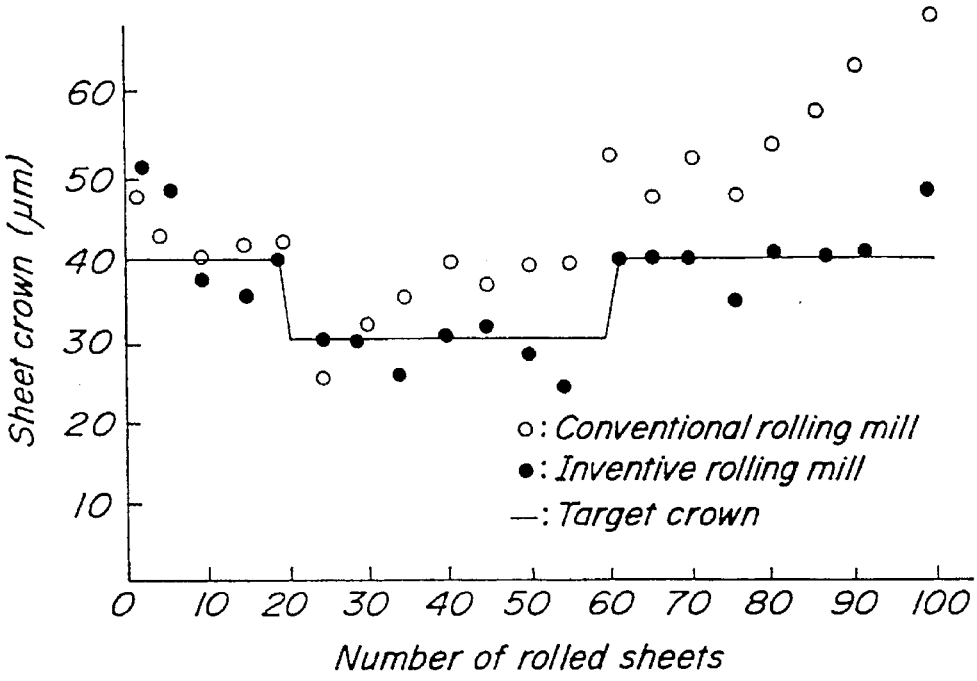
FIG. 27 is a graph showing a distribution of sheet crown with respect to the number of rolled sheets.

Results of measurement are shown in the graph of FIG. 27. According to the results shown in FIG. 27, when the rolling mill of the present invention was used, it is apparent that a highly accurate sheet rolling operation to obtain a sheet crown extremely close to a target sheet crown was able to be carried out even when the target sheet crown was changed. In this case, the rolling schedule with respect to the sheet width of the rolling mill of the present invention was set to be the same as that of the rolling mill of the prior art.

The frequency of occurring reduction ears, accuracy of sheet thickness, and average value of sheet crown are shown in Table 7 in the case where 100,000 tons of sheets were rolled. According to this table, both the sheet thickness accuracy and the pass property (decrease in the occurrence of reduction ears) of the rolling mill of the invention are far superior to those of the conventional rolling mill.

TABLE 7

| | Average Crown $E_{25}$ (μm) | Sheet thickness accuracy 1σ (μm) | Frequency of ears (time) |
|---|---|---|---|
| Inventive rolling mill | 42 | ±40 | 4 |
| Conventional rolling mill | 50 | ±60 | 12 |

EXAMPLE 7

Figure 28:
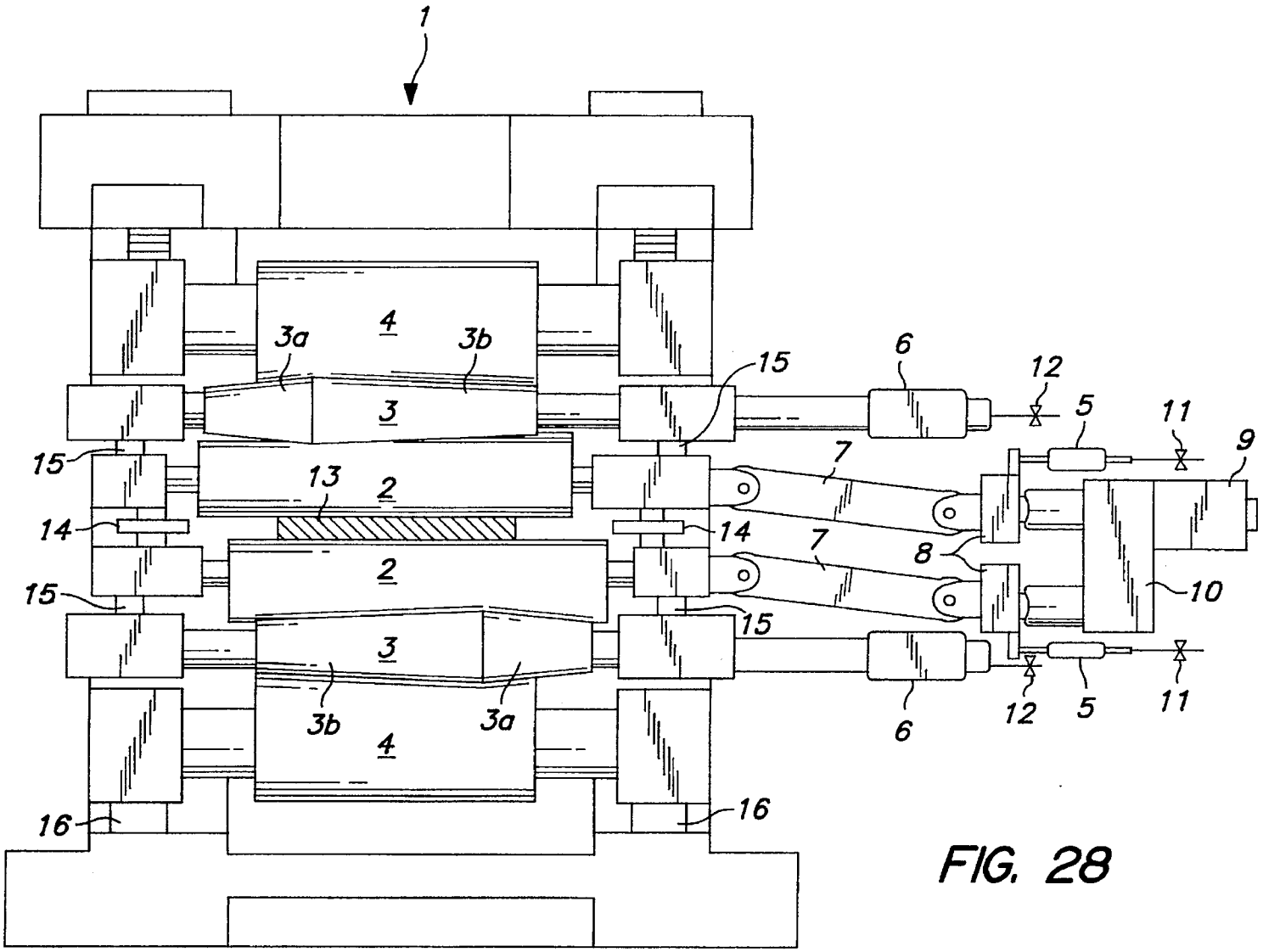
FIG. 28 is a schematic front view illustrating a rolling mill.

FIG. 28 illustrates a rolling mill similar to the six high rolling mill shown in FIG. 24, except that the barrel length of the work roll 2 is longer than that of the intermediate roll 3.

A comparative test was carried out in which a crown distribution with respect to the number of rolled sheets and others were investigated in a case using a rolling mill according to the present invention an also in a case using a conventional rolling mill.

Rolling Mill of the Present Invention

In a hot finish rolling mill train in which the six high rolling mills structured as shown in FIG. 28 were arranged in three rolling stands in the rear stage, sheet bars were rolled under the same condition as in the aforementioned Example 1, and then the sheet crown was measured every 5 coils at a position spaced from the edge by 25 mm.

In this case, the barrel length of the work roll was 3400 mm, that of the intermediate roll was 3000 mm, and that of the backup roll was 2300 mm. Also, the intermediate roll is provided with the same taper shaped crown as in the Example 6, and the intermediate roll was shifted within a range from 0 mm to 700 mm. It it noted that a specification of the conventional rolling mill used in this comparative test is the same as in the case of the Example 6.

RESULTS OF EXPERIMENTS

Figure 29:
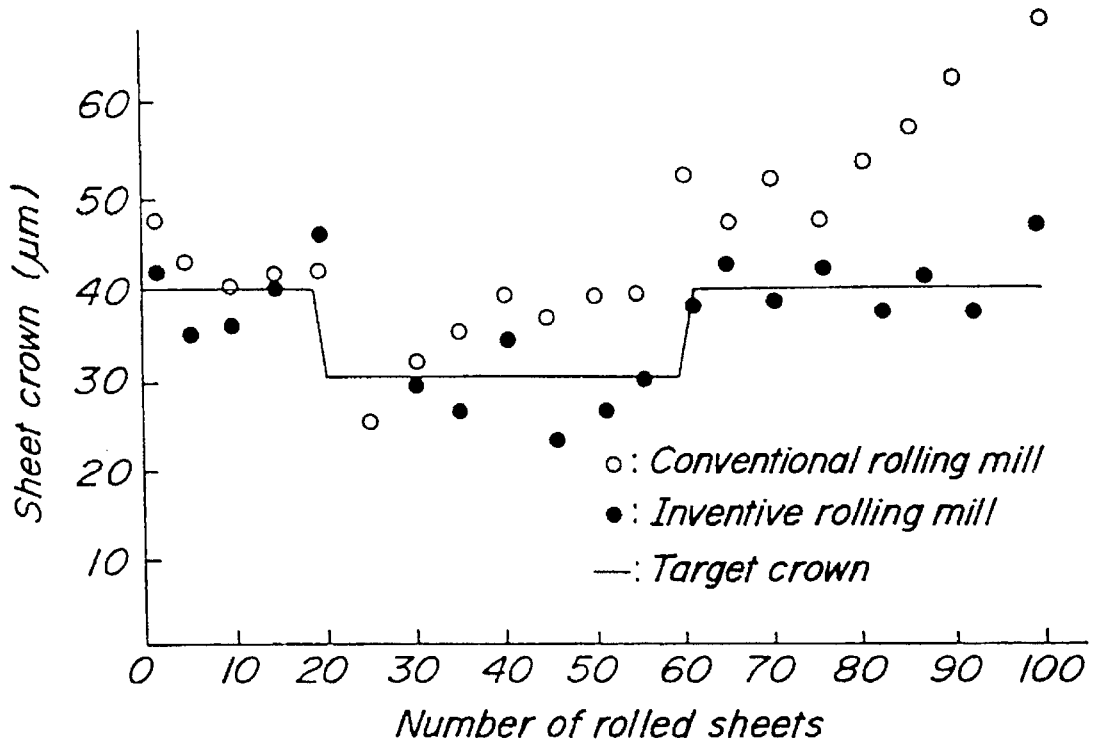
FIG. 29 is a graph showing a distribution of sheet crown with respect to the number of rolled sheets.

Results of measurement are shown in the graph of FIG. 29. According to the results shown in FIG. 29, when the rolling mill of the present invention was used, it is apparent that a highly accurate sheet rolling operation to obtain a sheet crown extremely close to a target sheet crown was able to be carried out even when the target crown was changed.

The frequency of occurring of reduction ears, accuracy of sheet thickness, and average value of sheet crown are shown in Table 8 in the case where 100,000 tons of sheets were rolled by using the aforementioned rolling mills of the invention and conventional rolling mills. According to this table, both the sheet thickness accuracy and the pass property (decrease in the occurrence of reduction ears) of the rolling mill of the invention are far superior to those of the conventional rolling mill.

TABLE 8

| | Average Crown $E_{25}$ (μm) | Sheet thickness accuracy 1σ (μm) | Frequency of ears (time) |
|---|---|---|---|
| Inventive rolling mill | 45 | ±39 | 2 |
| Conventional rolling mill | 50 | ±60 | 12 |

Various rolling mills having roll crowns of "S" shape, one end taper shape and both ends taper shape formed on the intermediate roll have been described, but various roll crowns can be combined as will be described hereinafter.

EXAMPLE 8

Figure 30:
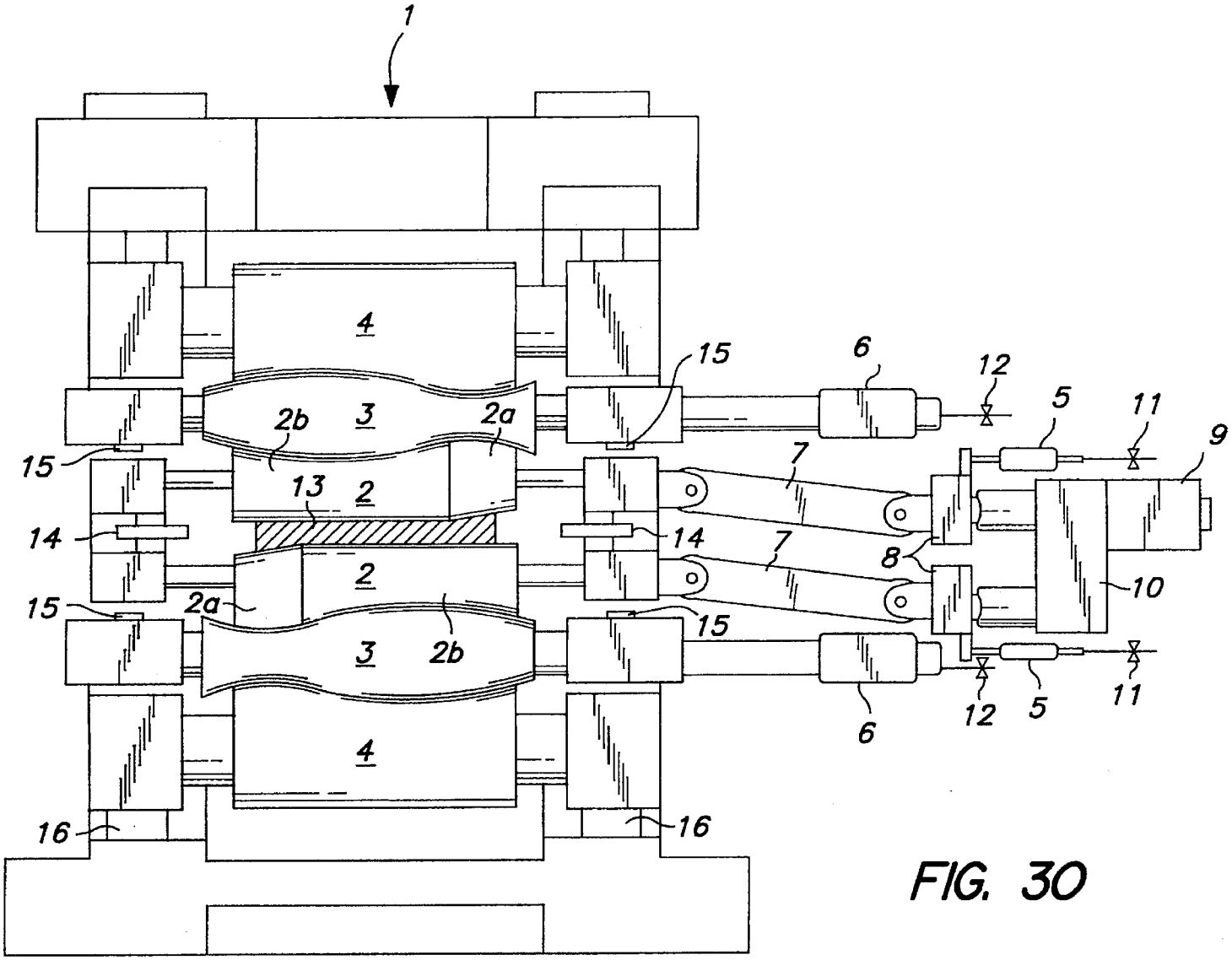
FIG. 30 is a schematic front view illustrating a rolling mill.

FIG. 30 illustrates a six high rolling mill in which the intermediate rolls 3 are provided with the "S" shape roll crowns, respectively, and the work rolls 2 are provided with the one end taper shape roll crowns, respectively.

Figure 31A:
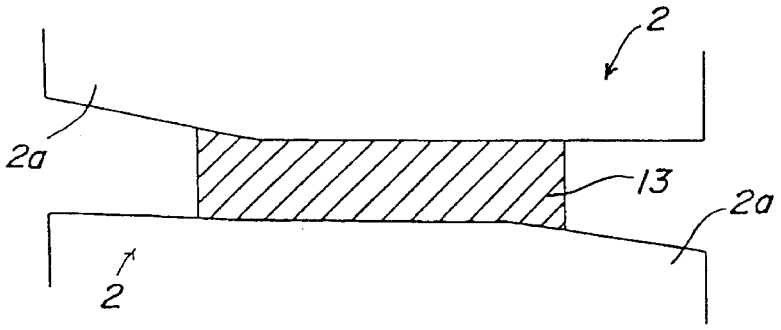
FIGS. 31(*a*) and 31(*b*) are diagrammatic views illustrating the work rolls in shifted position.
Figure 31B:
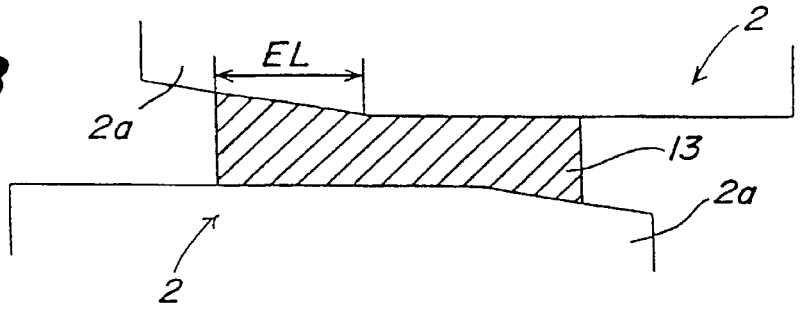
Figure 32:
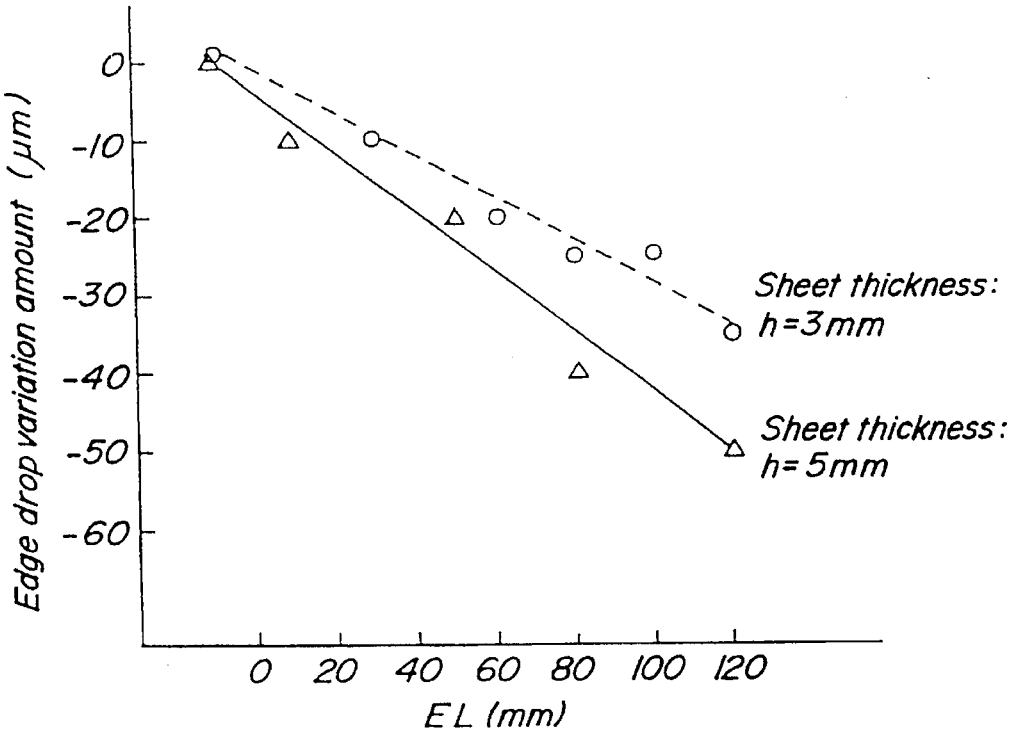
FIG. 32 is a graph showing a variation of the edge drop.

In this rolling mill, when the work rolls 2 are shifted from positions shown in FIG. 31(*a*) to positions shown in FIG. 31(*b*), respectively, roll gaps between the tapered portions 2*a* of the upper and lower work rolls 2 are directly increased at both edge portions of the sheet 13 to be rolled so that the edge drop can be reduced. As can be seen from FIG. 32, the edge drop can be modified by regulating a distance EL from the starting point of the tapered portion 2*a* to the edge of the sheet (referring to FIG. 31) so that the edge drop can be controlled in accordance with a predetermined target amount of edge drop.

A comparative test was carried out in which a crown distribution with respect to the number of rolled sheets and others investigated in a case using a rolling mill according to the present invention and also in a case using a conventional rolling mill.

Rolling Mill of the Present Invention

In a rolling mill train in which the six high rolling mills structured as shown in FIG. 30 were arranged in three rolling stands in the rear stage, sheet bars of 900 to 1600 mm width and 40 mm thickness, were rolled to a low carbon steel thin sheet of 1.6 to 3.2 mm finished thickness, and then the sheet crown was measured every 5 coils at a position spaced from the edge by 25 mm.

In this case, the barrel lengths of the work roll and backup roll were 2300 mm respectively, and that of the intermediate roll was 3000 mm. Also, a difference between the maximum and minimum diameters of "S" shape roll crown formed on the intermediate roll was 0.8 mm, the tapered portion 2*a* of the work roll was tapered by a $8\times10^{-3}$ (0.16 mm/200 mm per diameter) and the intermediate roll was shifted within a range from 0 mm to 700 mm.

Rolling Mill of the Prior Art

In a rolling mill train in which six high mills were arranged in three rolling stands in the rear stage including the final rolling stand, provided with work rolls, intermediate rolls and backup rolls, all of them being plain rolls and the barrel length of them being 2300 mm while the intermediate rolls were being shifted, rolling operations were carried out in the same manner as the rolling mill of the invention, and the sheet crown was measured in the same manner.

RESULTS OF EXPERIMENTS

Figure 33:
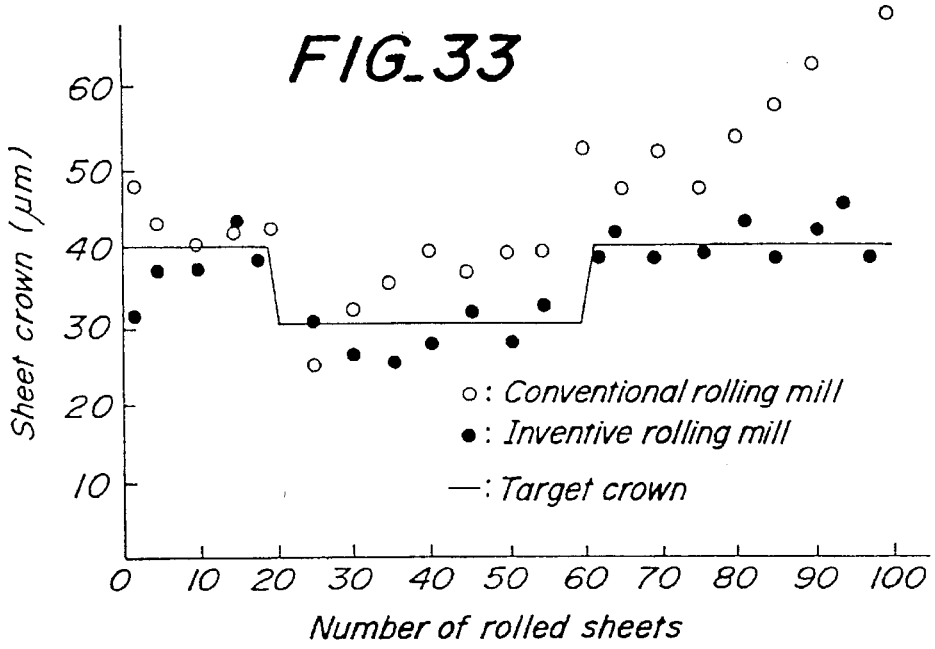
FIG. 33 is a graph showing a distribution of sheet crown with respect to the number of rolled sheets.

Results of measurement are shown in the graph of FIG. 33. According to the results shown in FIG. 33, when the rolling mill of the present invention was used, it is apparent that a highly accurate sheet rolling operation to obtain a sheet crown extremely close to a target sheet crown was able to be carried out even when the target sheet crown was changed. In this case, the rolling schedule with respect to the sheet width of the rolling mill of the present invention was set to be the same as that of the rolling mill of the prior art.

The frequency of occurring of reduction ears, amount of edge drop, accuracy of sheet thickness, and average value of sheet crown are shown in Table 9 in the case where 100,000 tons of sheets were rolled. According to this table, both the sheet thickness accuracy and the pass property (decrease in the occurrence of reduction ears) of the rolling mill of the invention are far superior to those of the conventional rolling mill. The amount of edge drop is measured by a different between sheet thickness at positions spaced from one sheet edge by 100 mm and 25 mm.

TABLE 9

| | Average Crown $E_{25}$ (μm) | Sheet thickness accuracy 1σ (μm) | Amount of edge drop (μm) | Frequency of ears (time) |
|---|---|---|---|---|
| Inventive rolling mill | 38 | ±43 | 26 | 6 |
| Conventional rolling mill | 50 | ±60 | 39 | 12 |

EXAMPLE 9

In a cold rolling mill train consisting of four rolling stands in which the six high rolling mills structured as shown in FIG. 30 were arranged in the first rolling stand, sheet bars of 900 to 1600 mm width and 2–3 mm thickness, were rolled to a low carbon steel thin sheet of 0.5 mm finished thickness, and then the sheet thickness deviation was investigated at a position spaced from the edge by 100 mm.

In this case, the barrel length of the work roll was 2000 mm, that of the intermediate roll was 2700 mm, and that of the backup roll was 2000 mm. Also, a difference between the maximum and minimum diameters of the intermediate roll was 0.8 mm, and the intermediate roll was shifted within a range from 0 mm to 700 mm.

Rolling Mill of the Prior Art

A six high mill is arranged in the first rolling stand and provided with work rolls, intermediate rolls and backup rolls, all of them being plain rolls and the barrel length of them being 2000 mm while the intermediate rolls were being shifted, rolling operations were carried out in the same manner as the rolling mill of the invention, and the sheet thickness deviation was measured in the same manner.

RESULTS OF EXPERIMENTS

Figure 34:
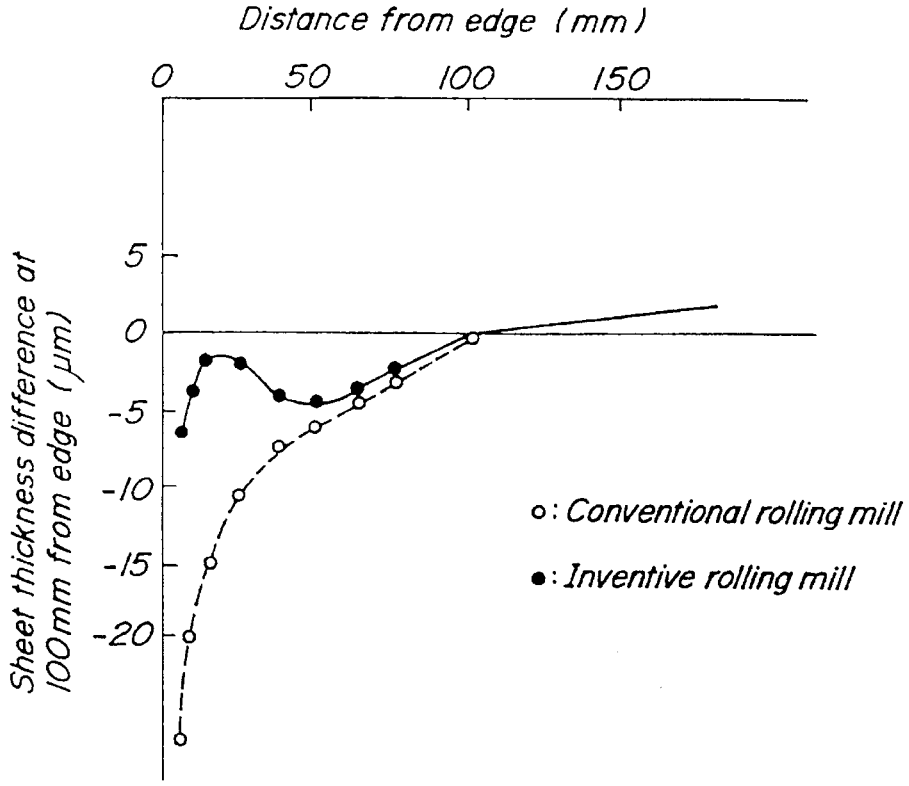
FIG. 34 is a graph showing an amount of occurred edge drop.

Results of measurement are shown in the graph of FIG. 34. According to the results shown in FIG. 34, when the rolling mill of the present invention was used, it is apparent that occurring of edge drop is greatly reduced.

The frequency of occurring of reduction ears and amount of edge drop are shown in Table 10 in the case where 100,000 tons of sheets were rolled by use of the aforementioned rolling mills of the invention and conventional rolling mills. According to this table, both the sheet thickness accuracy and the pass property (decrease in the occurrence of reduction ears) of the rolling mill of the invention far superior to those of the conventional rolling mill.

TABLE 10

| | Amount of edge drop (μm) | Frequency of ears (time) |
|---|---|---|
| Inventive rolling mill | 3 | 0 |
| Conventional rolling mill | 15 | 3 |

EXAMPLE 10

Figure 35:
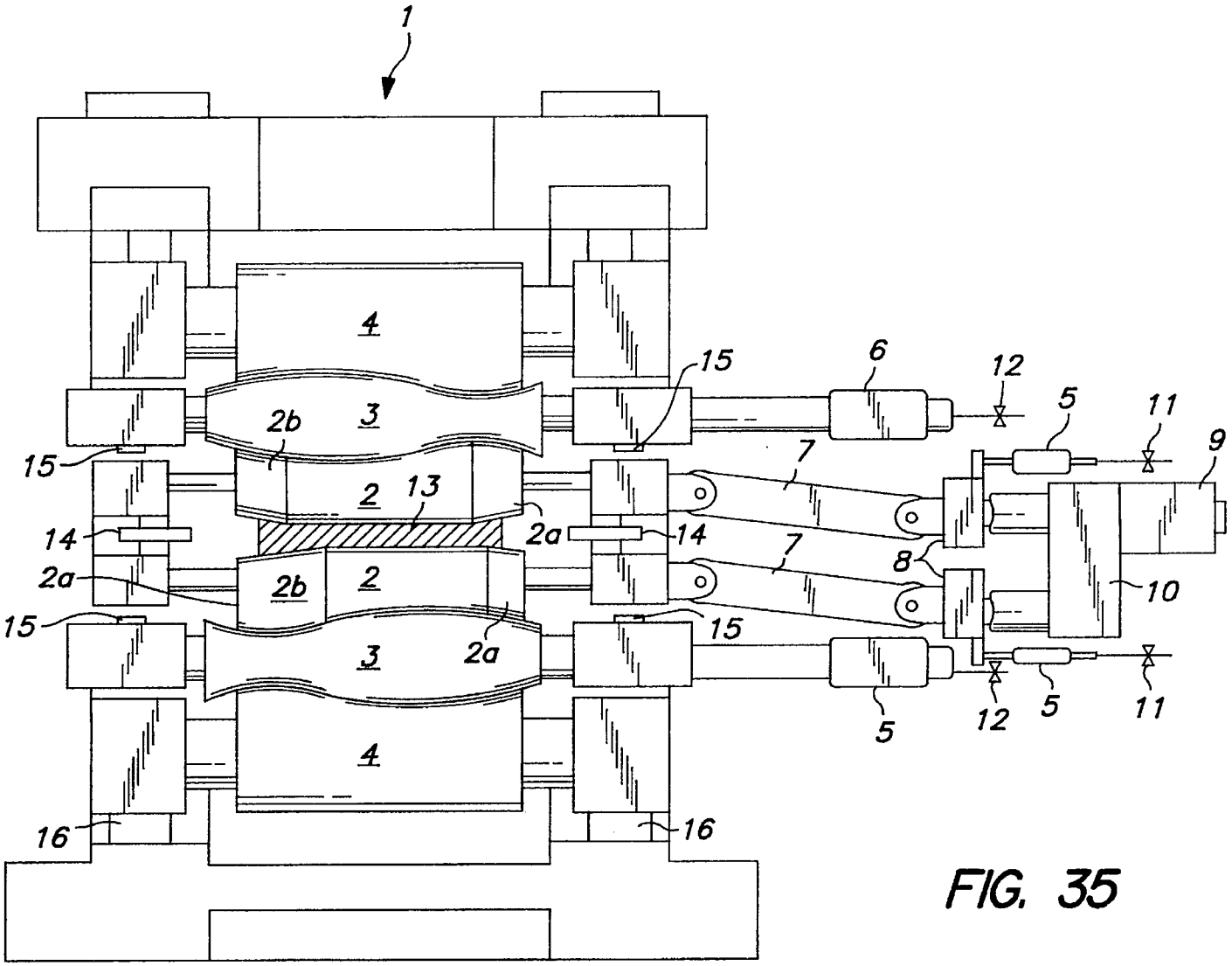
FIG. 35 is a schematic front view illustrating a rolling mill.

FIG. 35 illustrates a rolling mill similar to the six high rolling mill shown in FIG. 30, except that each of the work rolls 2 is provided with a roll crown tapered toward opposite ends.

A comparative test was carried out in which a crown distribution with respect to the number of rolled sheets and others were investigated in a case using a rolling mill according to the present invention and also in a case using a conventional rolling mill.

Rolling Mill of the Present Invention

In a hot finish rolling mill train in which the six high rolling mills structured as shown in FIG. 35 were arranged in three rolling stands in the rear stage, sheet bars were rolled under the same conditions as in the aforementioned Example 8, and then the sheet crown was measured every 5 coils at a position spaced from the edge by 25 mm.

In this case, the opposite tapered barrel portions 2*a* and 2*b* of the work roll were tapered by $0.4\times10^{-3}$ (0.08 mm/200 mm per diameter). Also, a difference between the maximum and minimum diameters of the intermediate roll was 0.8 mm, and the intermediate roll was shifted within a range from 0 mm to 700 mm. It is noted that a specification of the conventional rolling mill used in this comparative test is the same as in the case of the Example 8.

RESULTS OF EXPERIMENTS

Figure 36:
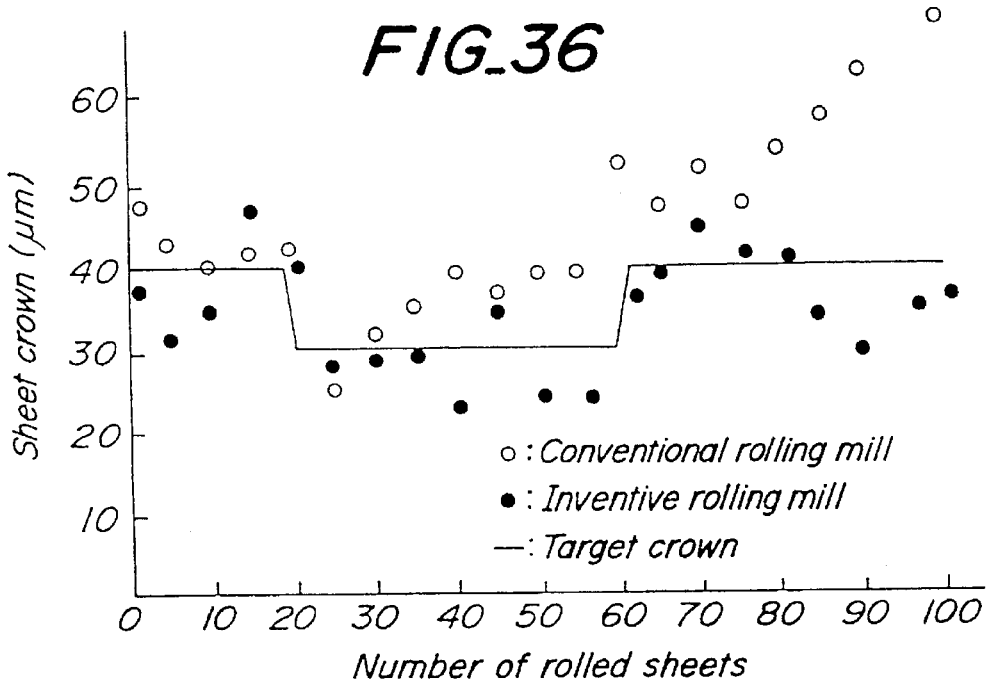
FIG. 36 is a graph showing a distribution of sheet crown with respect to the number of rolled sheets.

Results of measurement are shown in the graph of FIG. 36. According to the results shown in FIG. 36, when the rolling mill of the present invention was used, it is apparent that a highly accurate sheet rolling operation to obtain a sheet crown extremely close to a target sheet crown was able to be carried out even when the target crown was changed.

The frequency of occurring of reduction ears, accuracy of sheet thickness, and average value of sheet crown are shown in Table 11 in the case where 100,000 tons of sheets were rolled in a thin cycle rolling schedule using the aforementioned rolling mills of the invention and conventional rolling mills. According to this table, both the sheet thickness accuracy and the pass property (decrease in the occurrence of reduction ears) of the rolling mill of the invention are far superior to those of the conventional rolling mill.

TABLE 11

| | Average Crown $E_{25}$ (μm) | Sheet thickness accuracy 1σ (μm) | Amount of edge drop (μm) | Frequency of ears (time) |
|---|---|---|---|---|
| Inventive rolling mill | 40 | ±40 | 28 | 7 |
| Conventional rolling mill | 50 | ±60 | 39 | 12 |

EXAMPLE 11

Figure 37:
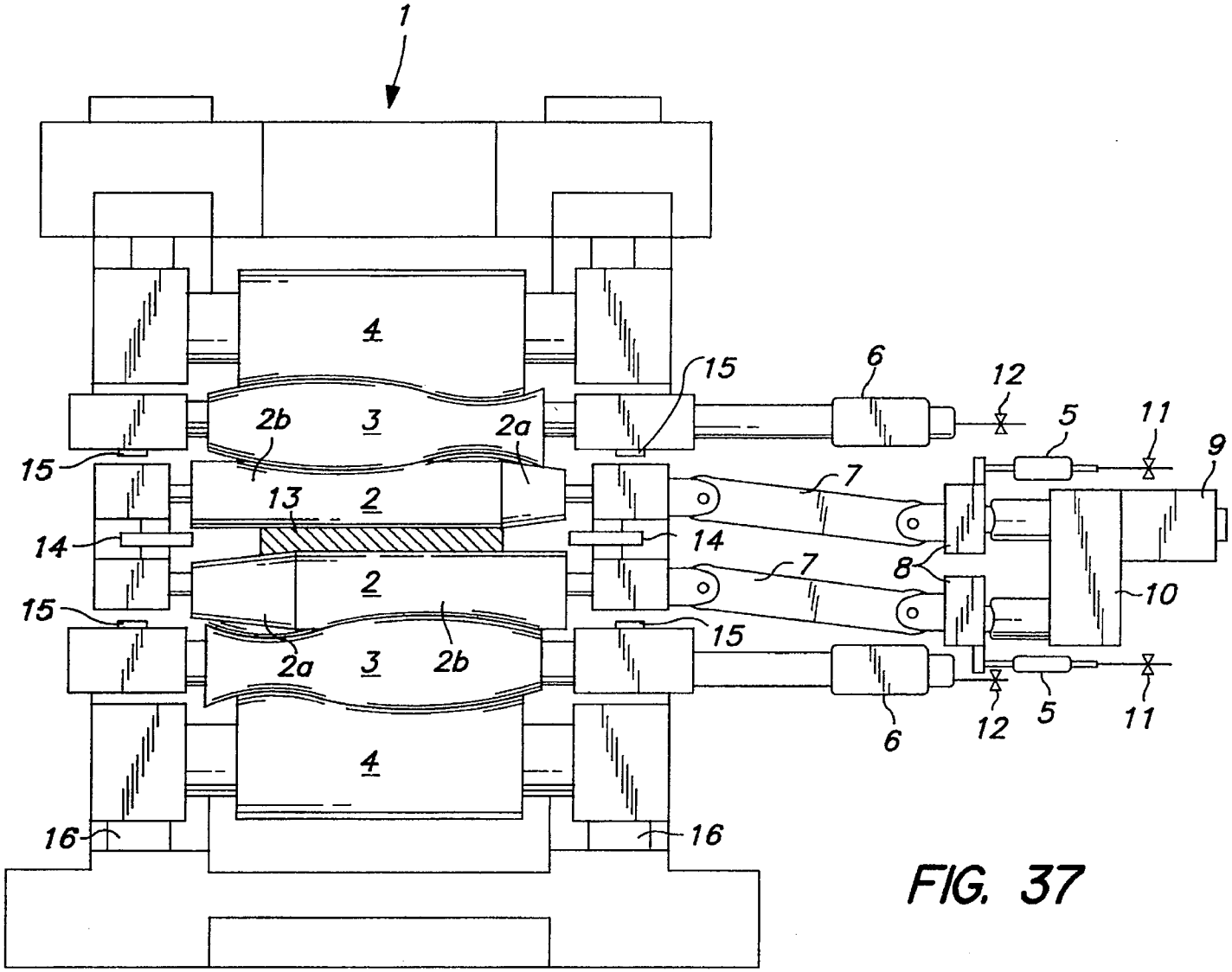
FIG. 37 is a schematic front view illustrating a rolling mill.

FIG. 37 illustrates a rolling mill similar to the six high rolling mill shown in FIG. 35, except that the barrel length of the work roll 2 is longer than that of the intermediate roll 3.

A comparative test was carried out in which a crown distribution with respect to the number of rolled sheets and others were investigated in a case using a rolling mill according to the present invention and also in a case using a conventional rolling mill.

Rolling Mill of the Present Invention

In a hot finish rolling mill train in which the six high rolling mills structured as shown in FIG. 37 were arranged in three rolling stands in the rear stage, sheet bars were rolled under the same condition as in the aforementioned Example 10, and then the sheet crown was measured every 5 coils at a position spaced from the edge by 25 mm.

In this case, the barrel length of the work roll was 3400 mm, that of the intermediate roll was 3000 mm, and that of the backup roll was 2300 mm. Also, the intermediate roll is provided with the same taper shaped crown as in the Example 4, and the intermediate roll was shifted within a range from 0 mm to 700 mm. It is noted that a specification of the conventional rolling mill used in this comparative test is the same as in the case of the Example 4.

RESULTS OF EXPERIMENTS

Figure 38:
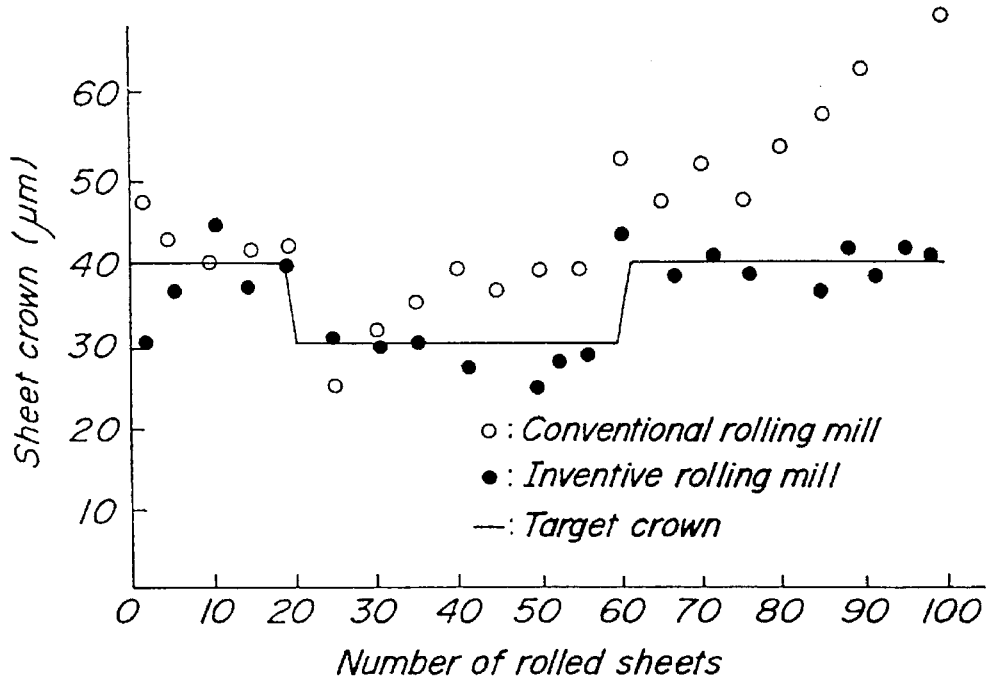
FIG. 38 is a graph showing a distribution of sheet crown with respect to the number of rolled sheets.

Results of measurement for the sheet crown are shown in the graph of FIG. 38. According to the results shown in FIG. 38, when the rolling mill of the present invention was used, it is apparent that a highly accurate sheet rolling operation to obtain a sheet crown extremely close to a target sheet crown was able to be carried out even when the target crown was changed.

The frequency of occurring of reduction ears, accuracy of sheet thickness, and average value of sheet crown are shown in Table 12 in the case where 100,000 tons of sheets were rolled by using the aforementioned rolling mills of the invention and conventional rolling mills. According to this table, both the sheet thickness accuracy and the pass property (decrease in the occurrence of reduction ears) of the rolling mill of the invention are far superior to those of the conventional rolling mill.

TABLE 12

| | Average Crown $E_{25}$ (μm) | Sheet thickness accuracy 1σ (μm) | Amount of edge drop (μm) | Frequency of ears (time) |
|---|---|---|---|---|
| Inventive rolling mill | 41 | ±42 | 25 | 5 |
| Conventional rolling mill | 50 | ±60 | 39 | 12 |

EXAMPLE 12

Figure 39:
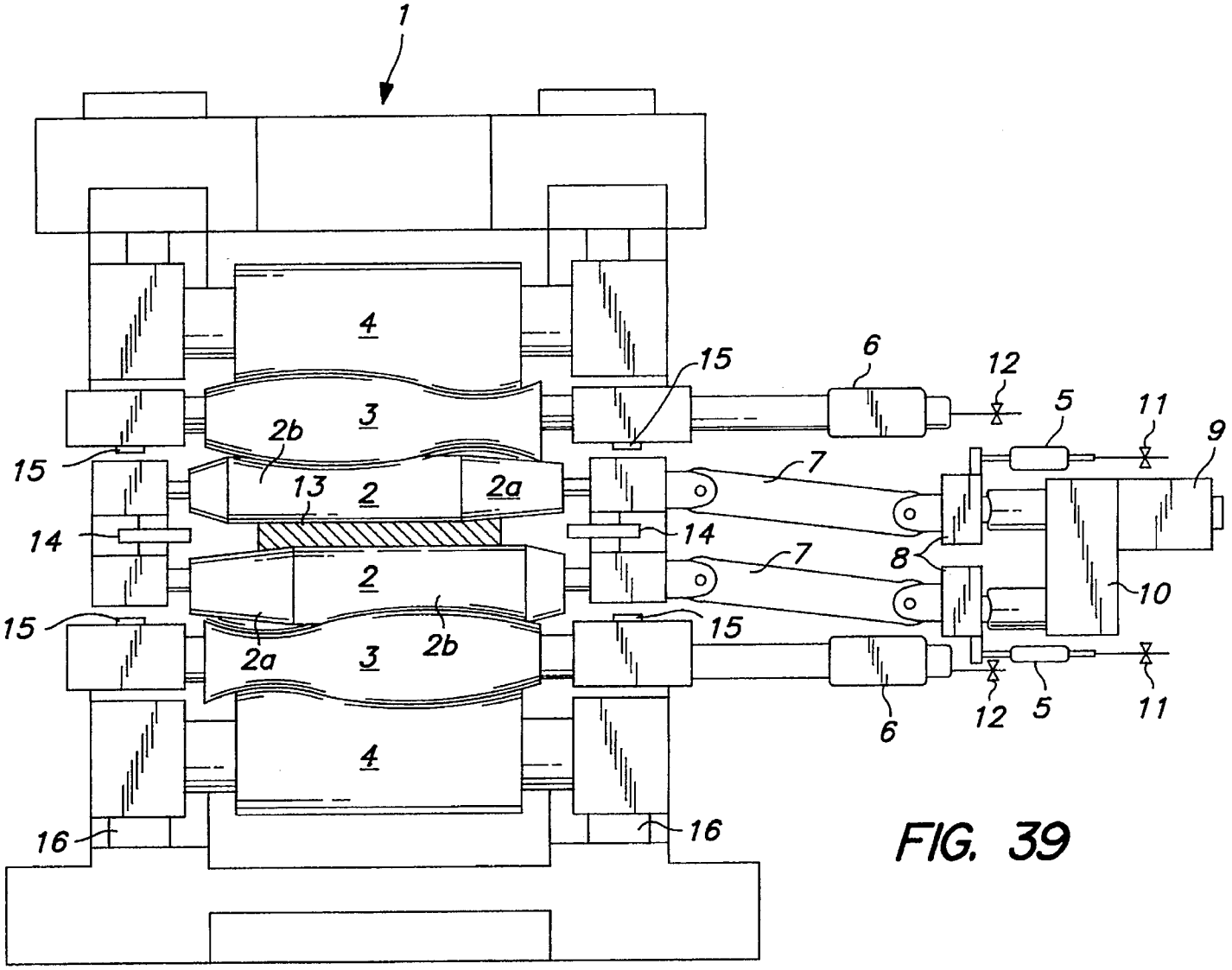
FIG. 39 is a schematic front view illustrating a rolling mill.

FIG. 39 illustrates a rolling mill similar to the six high rolling mill shown in FIG. 37, except that each of the work rolls 2 is provided with a roll crown tapered toward opposite ends.

A comparative test was carried out in which a crown distribution with respect to the number of rolled sheets and others were investigated in a case using a rolling mill according to the present invention and also in a case using a conventional rolling mill.

Rolling Mill of the Present Invention

In a hot finish rolling mill train in which the six high rolling mills structured as shown in FIG. 39 were arranged in three rolling stands in the rear stage, sheet bars were rolled under the same conditions as in the aforementioned Example 11, and then the sheet crown was measured every 5 coils at a position spaced from the edge by 25 mm.

In this case, the opposite tapered barrel portions 2*a* and 2*b* of the work roll were tapered by $0.8\times10^{-3}$ (0.16 mm/200 mm per diameter) and $0.01\times10^{-3}$ (0.02 mm/200 mm per diameter), respectively, and the intermediate roll was shifted within a range from 0 mm to 700 mm. It is noted that a specification of the conventional rolling mill used in this comparative test is the same as in the case of the Example 11.

RESULTS OF EXPERIMENTS

Figure 40:
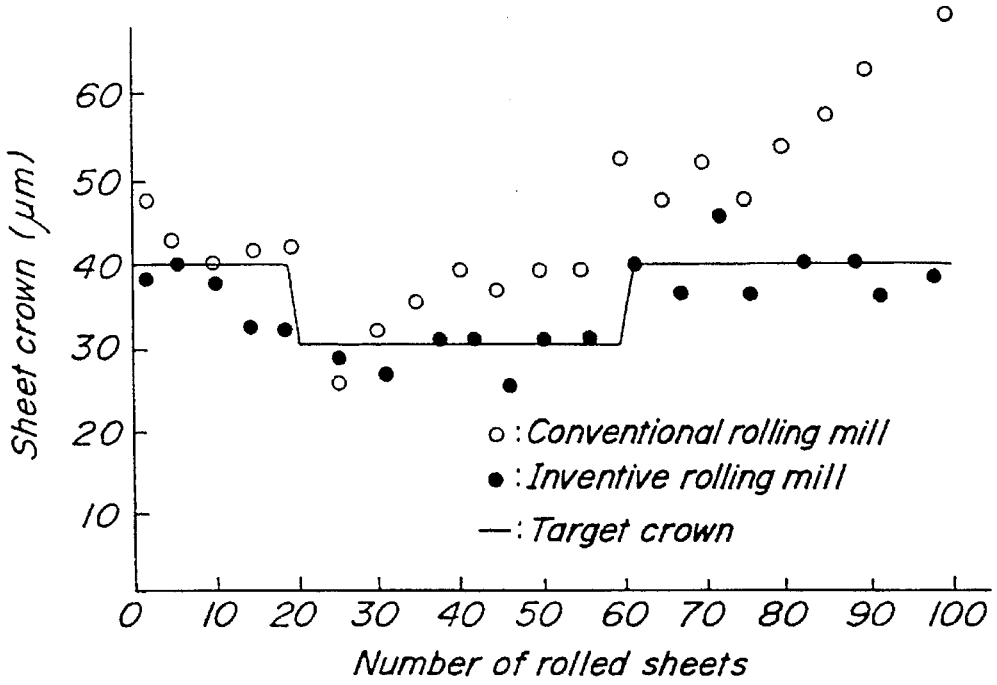
FIG. 40 is a graph showing a distribution of sheet crown with respect to the number of rolled sheets.

Results of measurement are shown in the graph of FIG. 40. According to the results shown in FIG. 40, when the rolling mill of the present invention was used, it is apparent that a highly accurate sheet rolling operation to obtain a sheet crown extremely close to a target sheet crown was able to be carried out even when the target crown was changed.

The frequency of occurring of reduction ears, accuracy of sheet thickness, and average value of sheet crown are shown in Table 13 in the case where 100,000 tons of sheets were rolled in a thin cycle rolling schedule using the aforementioned rolling mills of the invention and conventional rolling mills. According to this table, both the sheet thickness accuracy and the pass property (decrease in the occurrence of reduction ears) of the rolling mill of the invention are far superior to those of the conventional rolling mill.

TABLE 13

| | Average Crown $E_{25}$ (μm) | Sheet thickness accuracy 1σ (μm) | Amount of edge drop (μm) | Frequency of ears (time) |
|---|---|---|---|---|
| Inventive rolling mill | 40 | ±46 | 24 | 2 |
| Conventional rolling mill | 45 | ±60 | 39 | 11 |

EXAMPLE 13

Figure 41:
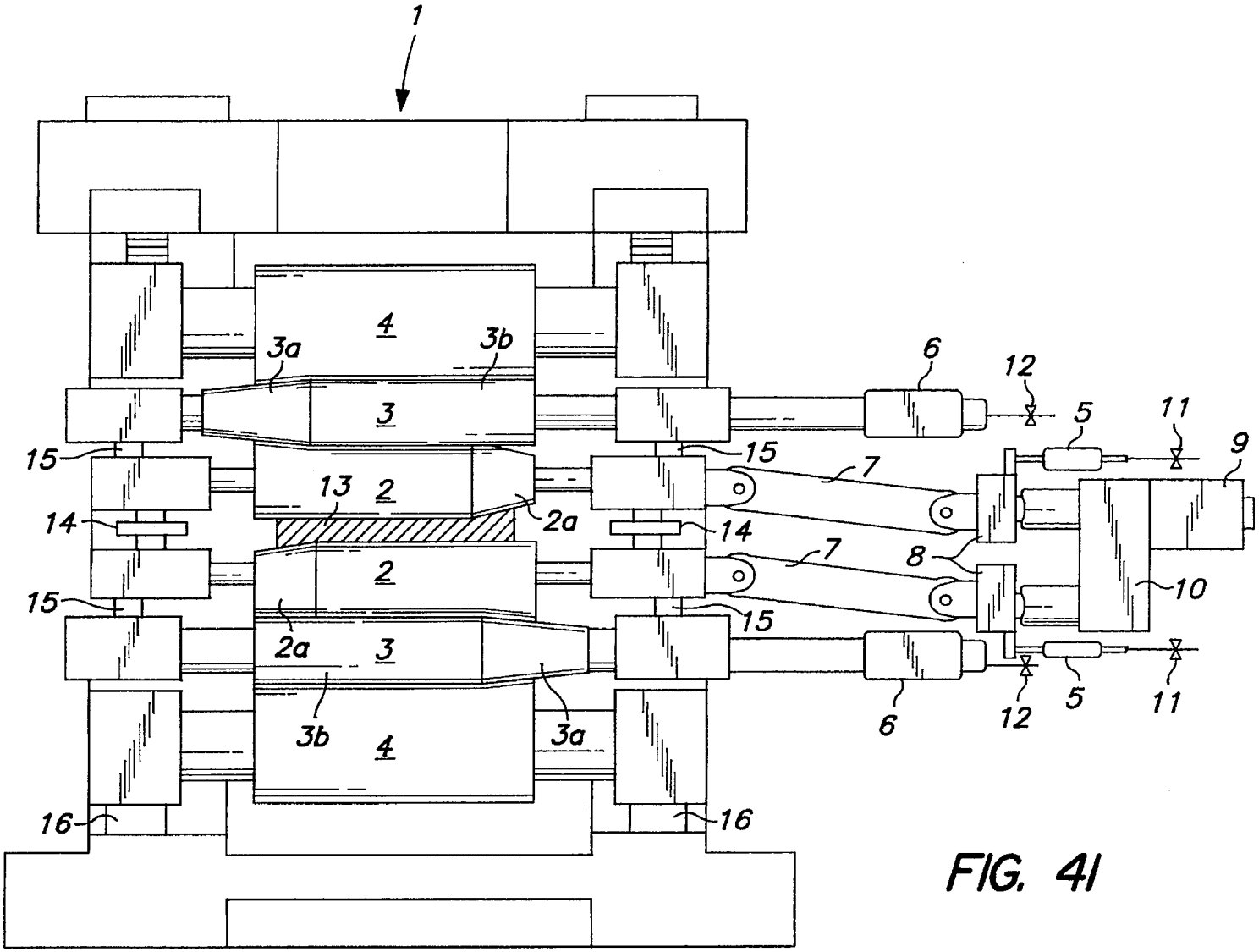
FIG. 41 is a schematic front view illustrating a rolling mill.

FIG. 41 illustrates an example of the six high rolling mill, wherein each of the intermediate rolls 3 and the work rolls is provided with a roll crown tapered toward one end of the roll barrel.

A comparative test is carried out in which a crown distribution with respect to the number of rolled sheets and others were investigated in a case using a rolling mill according to the present invention and also in a case using a conventional rolling mill.

Rolling Mill of the Present Invention

In a rolling mill train in which the six high rolling mills structured as shown in FIG. 41 were arranged in three rolling stands in the rear stage, sheet bars of 900 to 1600 mm width and 40 mm thickness, were rolled to a low carbon steel thin sheet of 1.6 to 3.2 mm finished thickness, and then the sheet crown was measured every 5 coils at a position spaced from the edge by 25 mm.

In this case, the barrel lengths of the work roll and backup roll were 2300 mm, and that of the intermediate roll was 3000 mm. Also, the tapered portion 3*a* of the intermediate roll is tapered by $1.6\times10^{-3}$ (0.32 mm/200 mm per diameter) and the tapered portion 2*a* of the work roll is tapered by $0.8\times10^{-3}$ (0.16 mm/200 mm per diameter) and the intermediate roll was shifted within a range from 0 mm to 700 mm.

Rolling Mill of the Prior Art

In a rolling mill train in which six high mills were arranged in three rolling stands in the rear stage including the final rolling stand, provided with work rolls, intermediate rolls and backup rolls, all of them being plain rolls and the barrel length of them being 2300 mm while the intermediate rolls were being shifted, rolling operations were carried out in the same manner as the rolling mill of the invention, and the sheet crown was measured in the same manner.

RESULTS OF EXPERIMENTS

Figure 42:
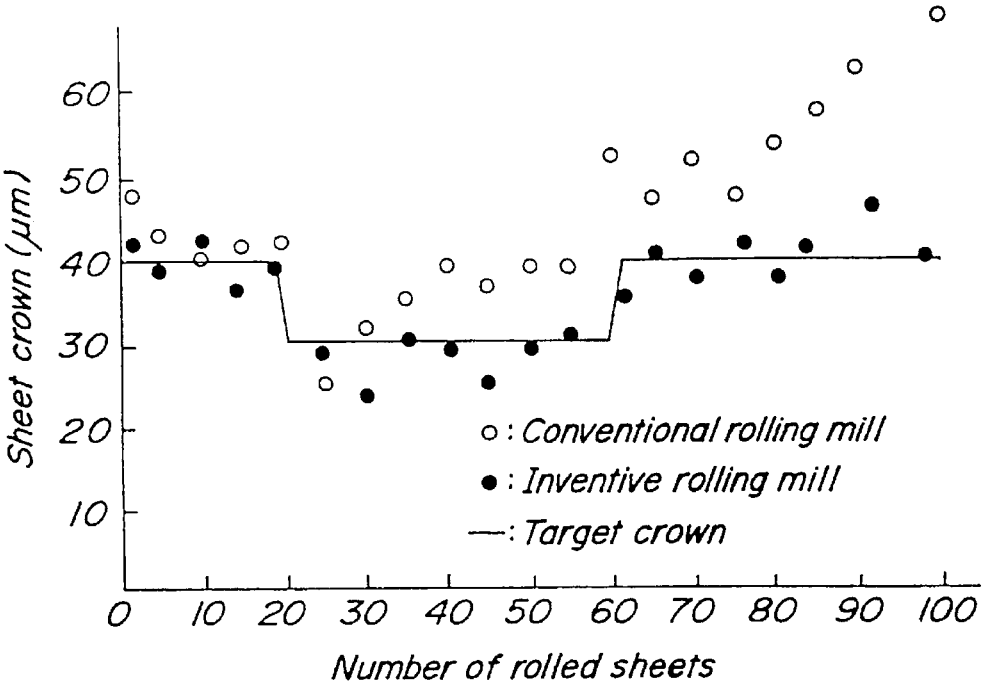
FIG. 42 is a graph showing a distribution of sheet crown with respect to the number of rolled sheets.

Results of measurement are shown in the graph of FIG. 42. According to the results shown in FIG. 42 when the rolling mill of the present invention was used, it is apparent that a highly accurate sheet rolling operation to obtain a sheet crown extremely close to a target sheet crown was able to be carried out even when the target crown was changed. In this case, the rolling schedule with respect to the sheet width of the rolling mill of the present invention was set to be the same as that of the rolling mill of the prior art.

The frequency of occurring of reduction ears, accuracy of sheet thickness, and average value of sheet crown are shown in Table 14 in the case where 100,000 tons of sheets were rolled in a thin cycle rolling schedule using the aforementioned rolling mills of the invention and conventional rolling mills. According to this table, both the sheet thickness accuracy and the pass property (decrease in the occurrence of reduction ears) of the rolling mill of the invention are far superior to those of the conventional rolling mill.

TABLE 14

| | Average Crown $E_{25}$ (μm) | Sheet thickness accuracy 1σ (μm) | Amount of edge drop (μm) | Frequency of ears (time) |
|---|---|---|---|---|
| Inventive rolling mill | 36 | ±45 | 26 | 8 |
| Conventional rolling mill | 50 | ±60 | 39 | 12 |

EXAMPLE 14

Figure 43:
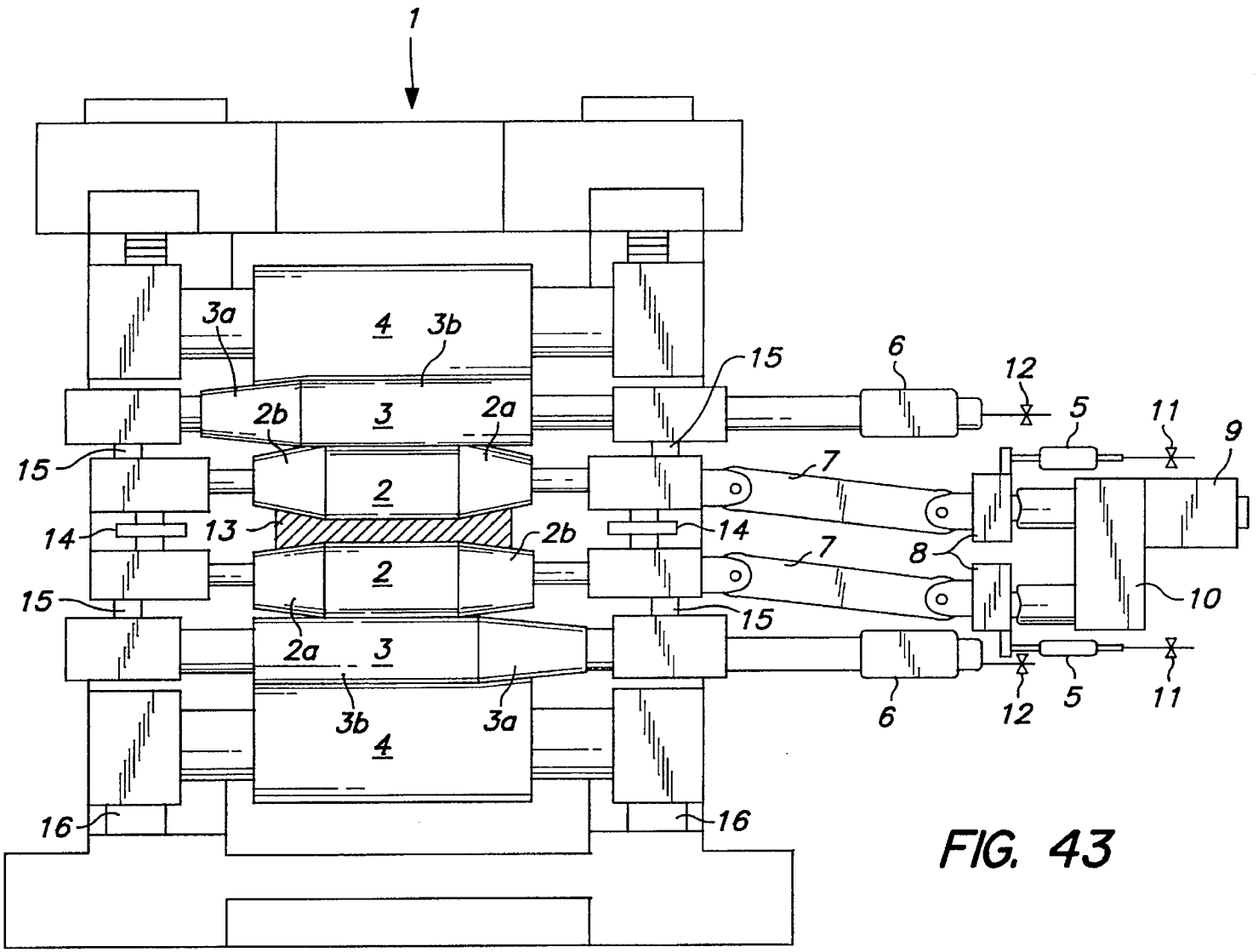
FIG. 43 is a schematic front view illustrating a rolling mill.

FIG. 43 illustrates a rolling mill having a construction similar to that of the six high rolling mill shown in FIG. 41, except that each of the work rolls is provided with a roll crown tapered at the opposite end portions.

A comparative test is carried out in which a crown distribution with respect to the number of rolled sheets and others were investigated in a case using a rolling mill according to the present invention and also in a case using a conventional rolling mill.

Rolling Mill of the Present Invention

In a hot finish rolling mill train in which the six high rolling mills structured as shown in FIG. 43 were arranged in three rolling stands in the rear stage, sheet bars were rolled under the same conditions as in the Example 12, and then the sheet crown was measured every 5 coils at a position spaced from the edge by 25 mm.

In this case, the size of the rolls is the same as that of the Example 14 and the shape of the intermediate rolls is the same as that of the Example 13, but the work roll 2 has tapered barrel portions 2*a* and 2*b* tapered by $0.4\times10^{-3}$ (0.8 mm/200 mm per diameter), and the intermediate roll was shifted within a range from 0 mm to 700 mm. A specification of the conventional rolling mill used in this comparative test is the same as in the case of the Example 13.

RESULTS OF EXPERIMENTS

Figure 44:
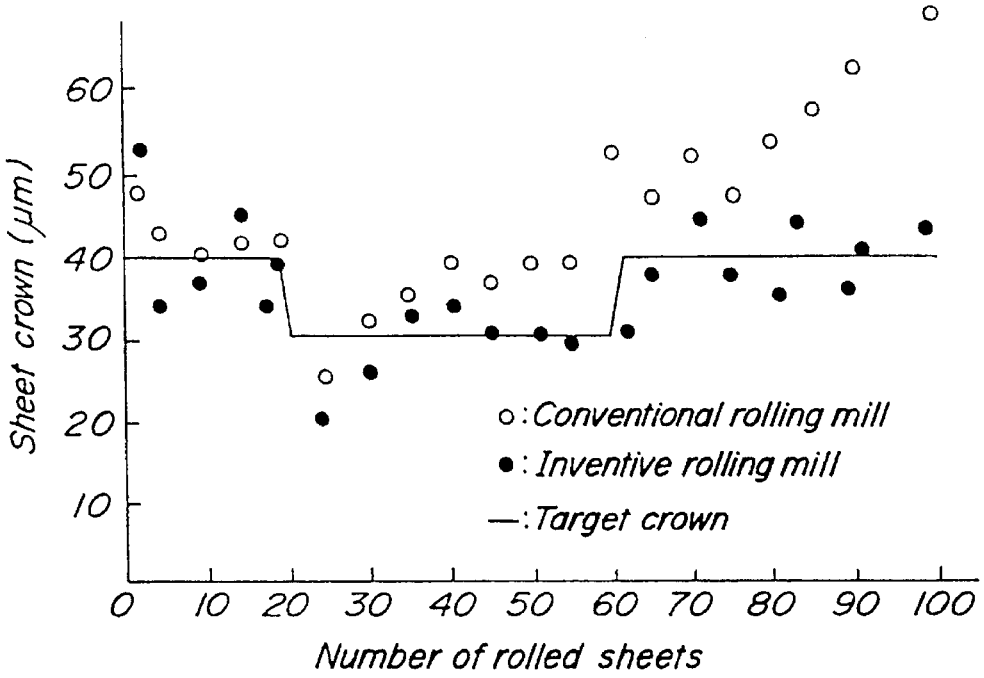
FIG. 44 is a graph showing a distribution of sheet crown with respect to the number of rolled sheets.

Results of measurement are shown in the graph of FIG. 44. According to the results shown in FIG. 44 when the rolling mill of the present invention was used, it is apparent that a highly accurate sheet rolling operation to obtain a sheet crown extremely close to a target sheet crown was able to be carried out even when the target crown was changed. In this case, the rolling schedule with respect to the sheet width of the rolling mill of the present invention was set to be the same as that of the rolling mill of the prior art.

The frequency of occurring of reduction ears, accuracy of sheet thickness, and average value of sheet crown are shown in Table 15 in the case where 100,000 tons of sheets were rolled in a thin cycle rolling schedule using the aforementioned rolling mills of the invention and conventional rolling mills. According to this table, both the sheet thickness accuracy and the pass property (decrease in the occurrence or reduction ears) of the rolling mill of the invention are far superior to those of the conventional rolling mill.

TABLE 15

| | Average Crown $E_{25}$ (μm) | Sheet thickness accuracy 1σ (μm) | Amount of edge drop (μm) | Frequency of ears (time) |
|---|---|---|---|---|
| Inventive rolling mill | 37 | ±47 | 27 | 7 |
| Conventional rolling mill | 50 | ±60 | 39 | 12 |

EXPERIMENT 15

Figure 45:
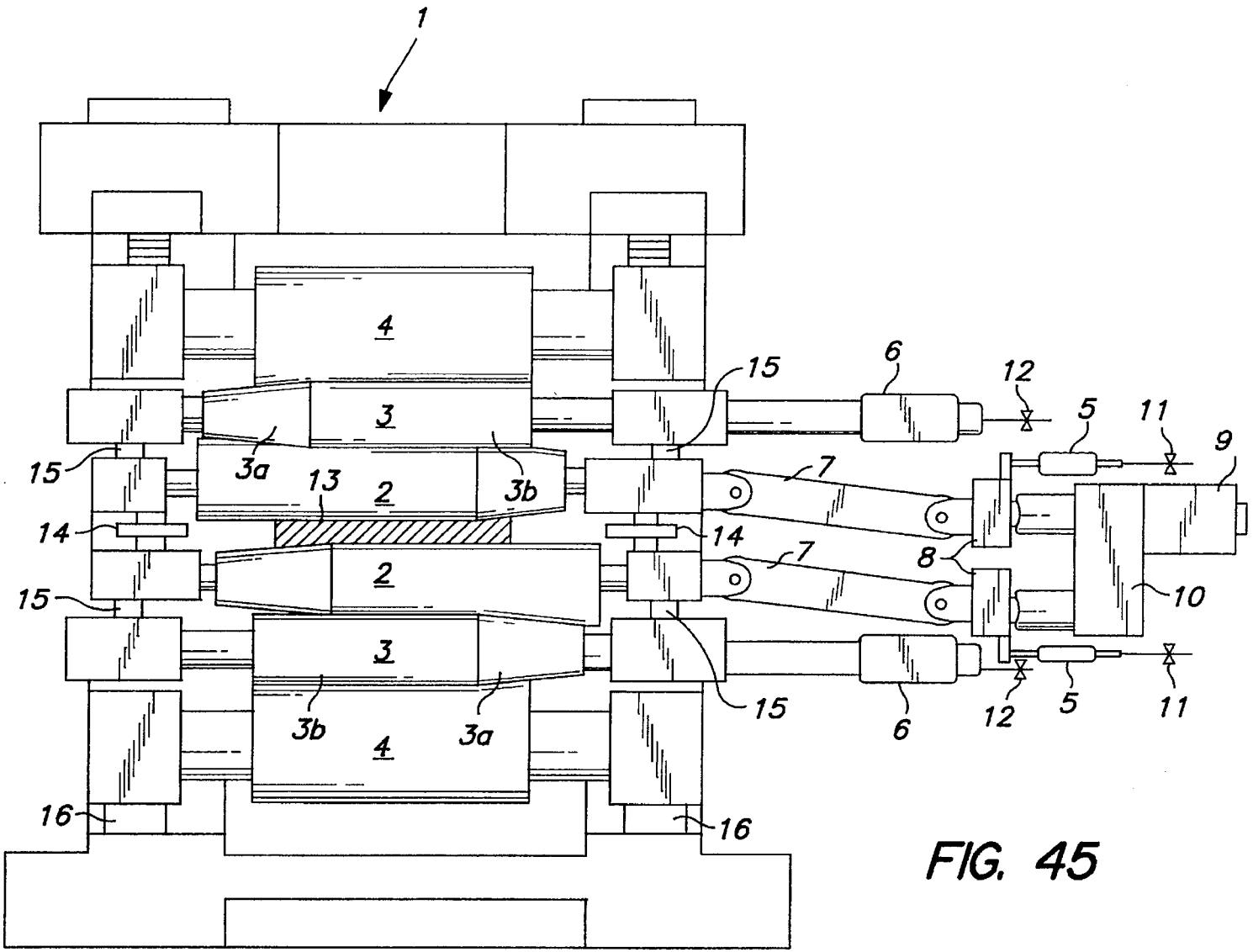
FIG. 45 is a schematic front view illustrating a rolling mill.

FIG. 45 illustrates a rolling mill similar to the six high rolling mill shown in FIG. 41, except that the barrel length of the work roll 2 is longer than that of the intermediate roll 3.

A comparative test was carried out as follows in which a sheet crown distribution with respect to the number of rolled sheets and others were investigated in a case using a rolling mill according to the present invention and also in a case using a conventional rolling mill.

Rolling Mill of the Present Invention

In a hot finish rolling mill train in which the six high rolling mills structured as shown in FIG. 45 were arranged in three rolling stands in the rear stage, sheet bars were rolled under the same condition as in the aforementioned Example 1. The sheet crown of rolled sheet was measured every 5 coils at a position spaced from the edge by 25 mm.

In this case, the barrel length of the work roll was 3400 mm, that of the intermediate roll was 3000 mm, and that of the backup roll was 2300 mm. Also, each of the intermediate and work rolls is provided with a roll crown tapered toward one end of the roll barrel similar to that of the Example 11, and the intermediate roll was shifted within a range from 0 mm to 700 mm. It is noted that a specification of the conventional rolling mill used in this comparative test is the same as in the case of Example 13.

RESULTS OF EXPERIMENTS

Figure 46:
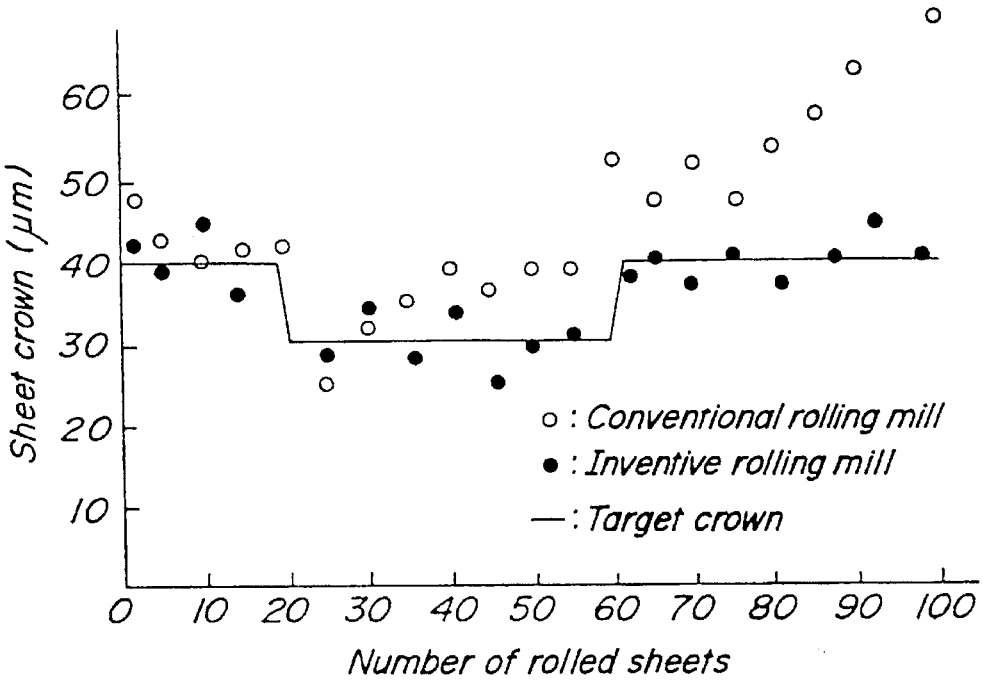
FIG. 46 is a graph showing a distribution of sheet crown with respect to the number of rolled sheets.

Results of measurement are shown in the graph of FIG. 46. According to the results shown in FIG. 46 when the rolling mill of the present invention was used, it is apparent that a highly accurate sheet rolling operation to obtain a sheet crown extremely close to a target sheet crown was able to be carried out even when the target crown was changed. In this case, the rolling schedule with respect to the sheet width of the rolling mill of the present invention was set to be the same as that of the rolling mill of the prior art.

The frequency of occurring of reduction ears, accuracy of sheet thickness, and average value of sheet crown are shown in Table 16 in the case where 100,000 tons of sheets were rolled in a thin cycle rolling schedule using the aforementioned rolling mills of the invention and conventional rolling mills. According to this table, both the sheet thickness accuracy and the pass property (decrease in the occurrence of reduction ears) of the rolling mill of the invention are far superior to those of the conventional rolling mill.

TABLE 16

| | Average Crown $E_{25}$ (μm) | Sheet thickness accuracy 1σ (μm) | Amount of edge drop (μm) | Frequency of ears (time) |
|---|---|---|---|---|
| Inventive rolling mill | 35 | ±46 | 22 | 3 |
| Conventional rolling mill | 50 | ±60 | 39 | 12 |

TABLE 17

| | Average Crown $E_{25}$ (μm) | Sheet thickness accuracy 1σ (μm) | Amount of edge drop (μm) | Frequency of ears (time) |
|---|---|---|---|---|
| Inventive rolling mill | 38 | ±45 | 26 | 4 |
| Conventional rolling mill | 50 | ±60 | 39 | 12 |

EXAMPLE 16

Figure 47:
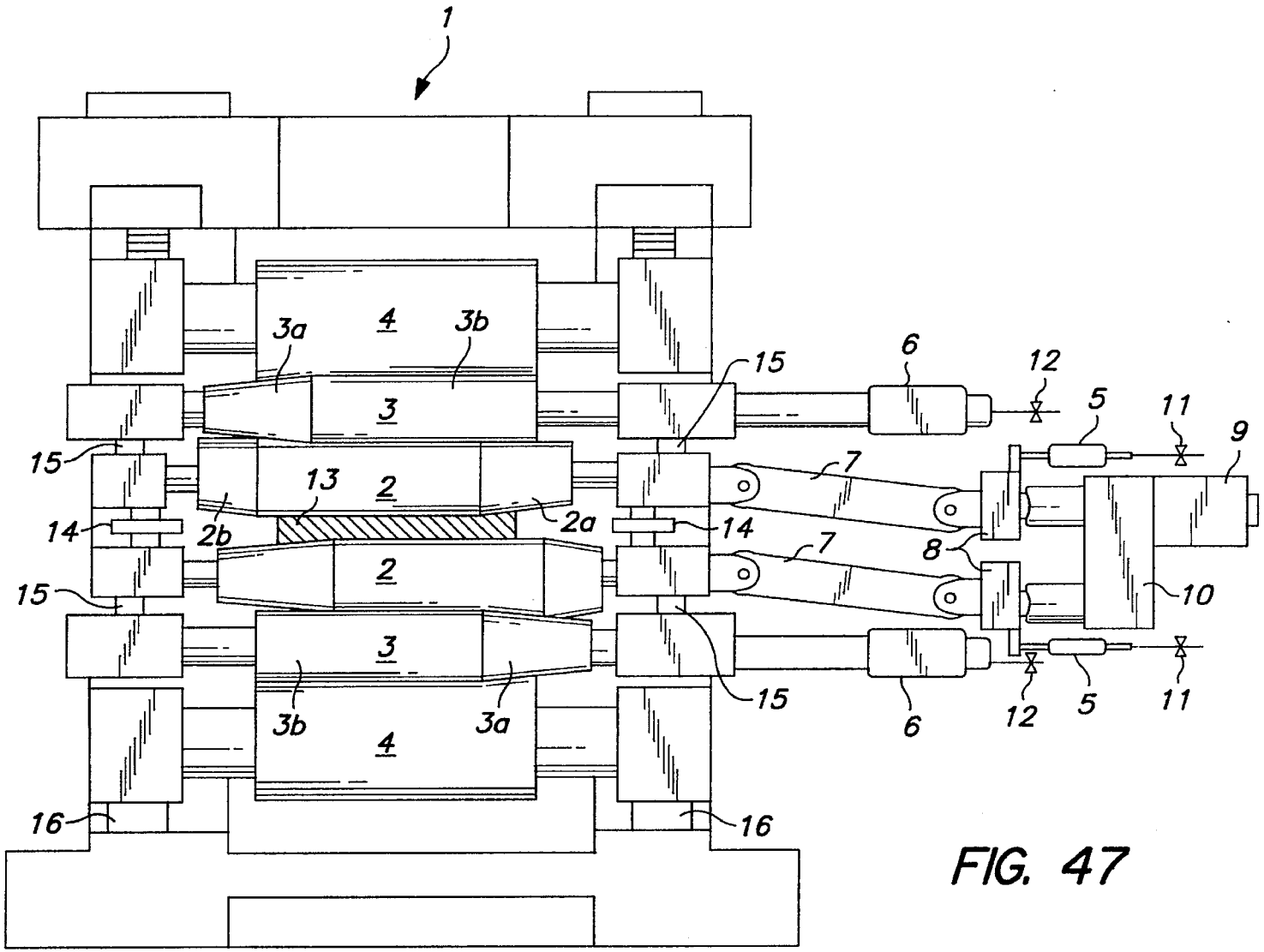
FIG. 47 is a graph showing a distribution of sheet crown with respect to the number of rolled sheets.

FIG. 47 illustrates a rolling mill having a construction similar to that of the six high rolling mill shown in FIG. 43, except that each of the work rolls is provided with a roll crown tapered at the opposite end portions thereof.

A comparative test is carried out in which a sheet crown distribution with respect to the number of rolled sheets and others were investigated in a case using a rolling mill according to the present invention and also in a case using a conventional rolling mill.

Rolling Mill of the Present Invention

In a hot finish rolling mill train in which the six high rolling mills structured as shown in FIG. 47 were arranged in three rolling stands in the rear stage, sheet bars were rolled under the same conditions as in the Example 13, and then the sheet crown was measured every 5 coils at a position spaced from the edge by 25 mm.

In this case, the size and shape of the rolls are the same as those of the Example 15 and the work roll 2 has tapered barrel portions 2*a* and 2*b* tapered by $0.8\times10^{-3}$ (0.16 mm/200 mm per diameter) and $0.1\times10^{-3}$ (0.02 mm/200 mm per diameter), respectively. The intermediate roll was shifted within a range from 0 mm to 700 mm. A specification of the conventional rolling mill used in this comparative test is the same as those in the case of the Example 13.

RESULTS OF EXPERIMENTS

Figure 48:
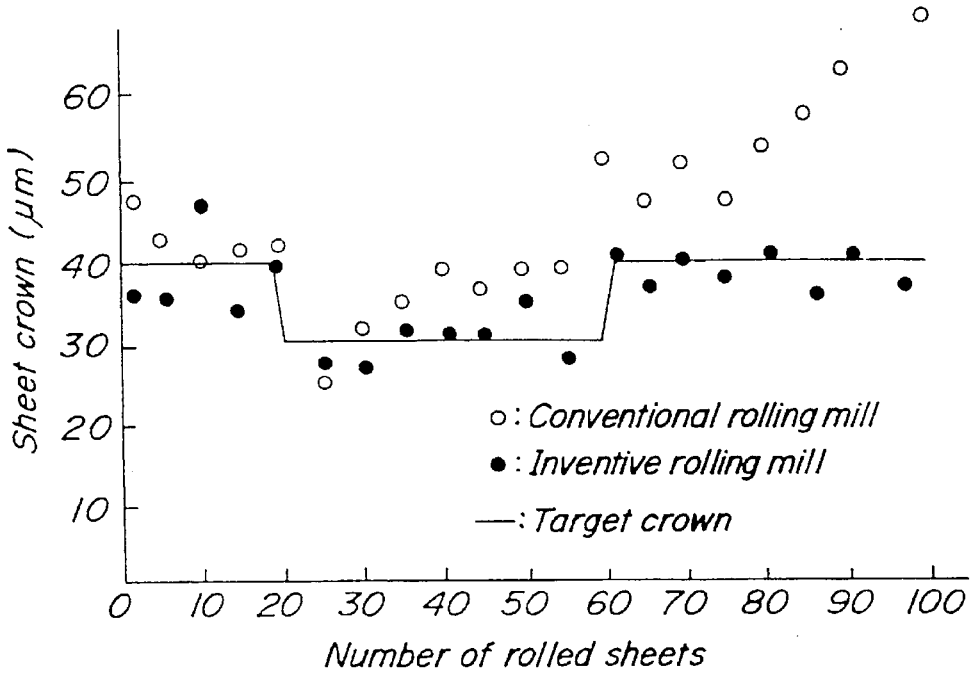
FIG. 48 is a graph showing a distribution of sheet crown with respect to the number of rolled sheets.

Results of measurement of the sheet crown are shown in the graph of FIG. 48. According to the results shown in FIG. 48 when the rolling mill of the present invention was used, it is apparent that a highly accurate sheet rolling operation to obtain a sheet crown extremely close to a target sheet crown was able to be carried out even when the target crown was changed. In this case, the rolling schedule with respect to the sheet width of the rolling mill of the present invention was set to be the same as that of the rolling mill of the prior art.

The frequency of occurring of reduction ears, accuracy of sheet thickness, and average value of sheet crown are shown in Table 17 in the case where 100,000 tons of sheets were rolled in a thin cycle rolling schedule using the aforementioned rolling mills of the invention and conventional rolling mills. According to this table, both the sheet thickness accuracy and the pass property (decrease in the occurrence of reduction ears) of the rolling mill of the invention are far superior to those of the conventional rolling mill.

EXAMPLE 17

Figure 49:
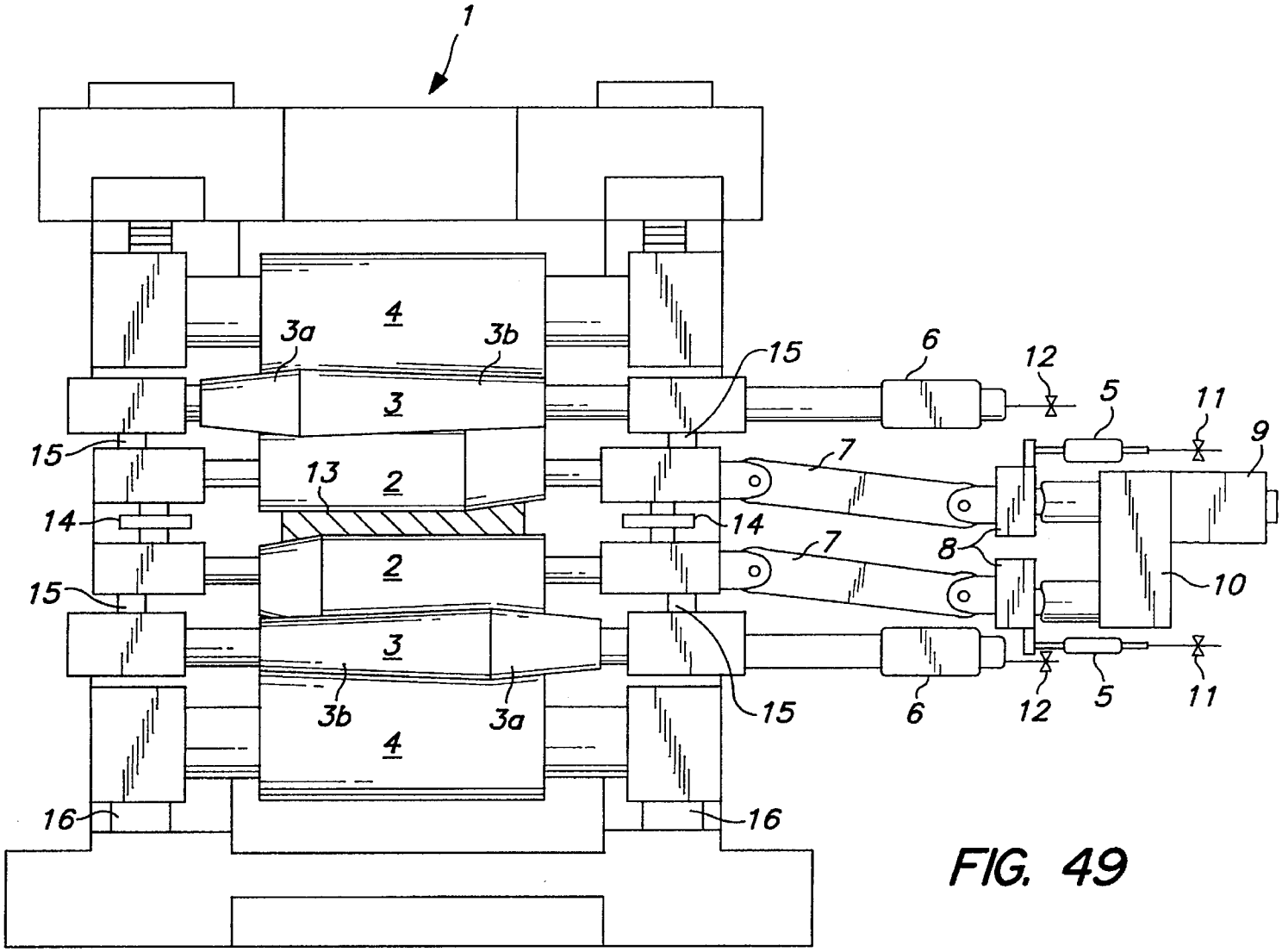
FIG. 49 is a schematic front view illustrating a rolling mill.

FIG. 49 illustrates an embodiment of the six high rolling mill having intermediate rolls 3 provided with the roll crown tapered toward to the opposite ends of the roll barrel and work rolls 2 provided with the roll crown tapered at one end portion of the roll barrel.

A comparative test was carried out as follows in which a sheet crown distribution with respect to the number of rolled sheets and others were investigated in a case using a rolling mill according to the present invention and also in a case using a conventional rolling mill.

Rolling Mill of the Present Invention

In a rolling mill train in which the six high rolling mills structured as shown in FIG. 49 were arranged in three rolling stands in the rear stage, sheet bars of 900 to 1600 mm width and 40 mm thickness, were rolled to a low carbon steel thin sheet of 1.6 to 3.2 mm finished thickness, and then the sheet crown was measured every 5 coils at a position spaced from the edge by 25 mm.

In this case, the barrel length of the work roll was 2300 mm, that of the intermediate rolls as 3000 mm, and that of the backup roll was 2300 mm. Also, the tapered portion 3*a* and 3*b* of the roll barrel of the intermediate roll are tapered by $1.6\times10^{-3}$ (0.32 mm/200 mm per diameter) and $0.1\times10^{-3}$ (0.02 mm/200 mm per diameter), respectively, and the tapered portion 2*a* of the roll barrel of the work roll is tapered by $0.8\times10^{-3}$ (0.16 mm/200 mm per diameter). The intermediate roll was shifted within a range from 0 mm to 700 mm.

Rolling Mill of the Prior Art

In a rolling mill train in which six high mills were arranged in three rolling stands in the rear stage including the final rolling stand, provided with work rolls, intermediate rolls and backup rolls, all of them being plain rolls and the barrel length of them being 2300 mm while the intermediate rolls were being shifted, rolling operations were carried out in the same manner as the rolling mill of the invention, and the sheet crown was measured in the same manner.

RESULTS OF EXPERIMENTS

Figure 50:
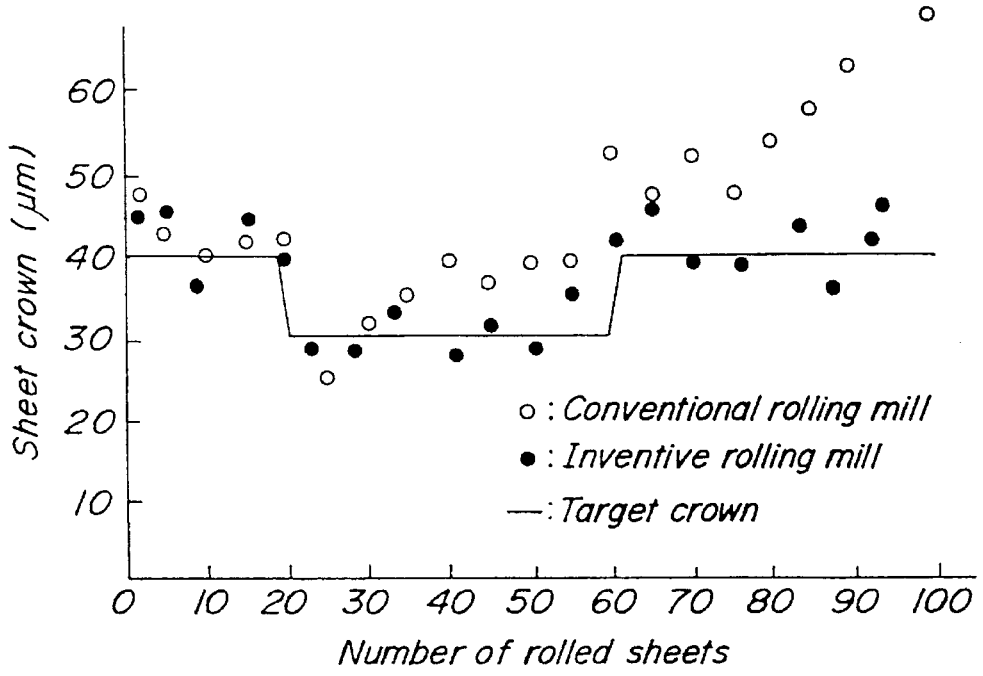
FIG. 50 is a graph showing a distribution of sheet crown with respect to the number of rolled sheets.

Results of measurement are shown in the graph of FIG. 50. According to the results shown in FIG. 50 when the rolling mill of the present invention was used, it is apparent that a highly accurate sheet rolling operation to obtain a sheet crown extremely close to a target sheet crown was able to be carried out even when the target crown was changed. In this case, the rolling schedule with respect to the sheet width of the rolling mill of the present invention was set to be the same as that of the rolling mill of the prior art.

The frequency of occurring of reduction ears, accuracy of sheet thickness, and average value of sheet crown are shown in Table 18 in the case where 100,000 tons of sheets were rolled in a thin cycle rolling schedule using the aforementioned rolling mills of the invention and conventional rolling mills. According to this table, both the sheet thickness accuracy and the pass property (decrease in the occurrence of reduction ears) of the rolling mill of the invention are far superior to those of the conventional rolling mill.

TABLE 18

| | Average Crown $E_{25}$ (μm) | Sheet thickness accuracy 1σ (μm) | Amount of edge drop (μm) | Frequency of ears (time) |
|---|---|---|---|---|
| Inventive rolling mill | 39 | ±49 | 23 | 7 |
| Conventional rolling mill | 50 | ±60 | 39 | 12 |

EXPERIMENT 18

Figure 51:
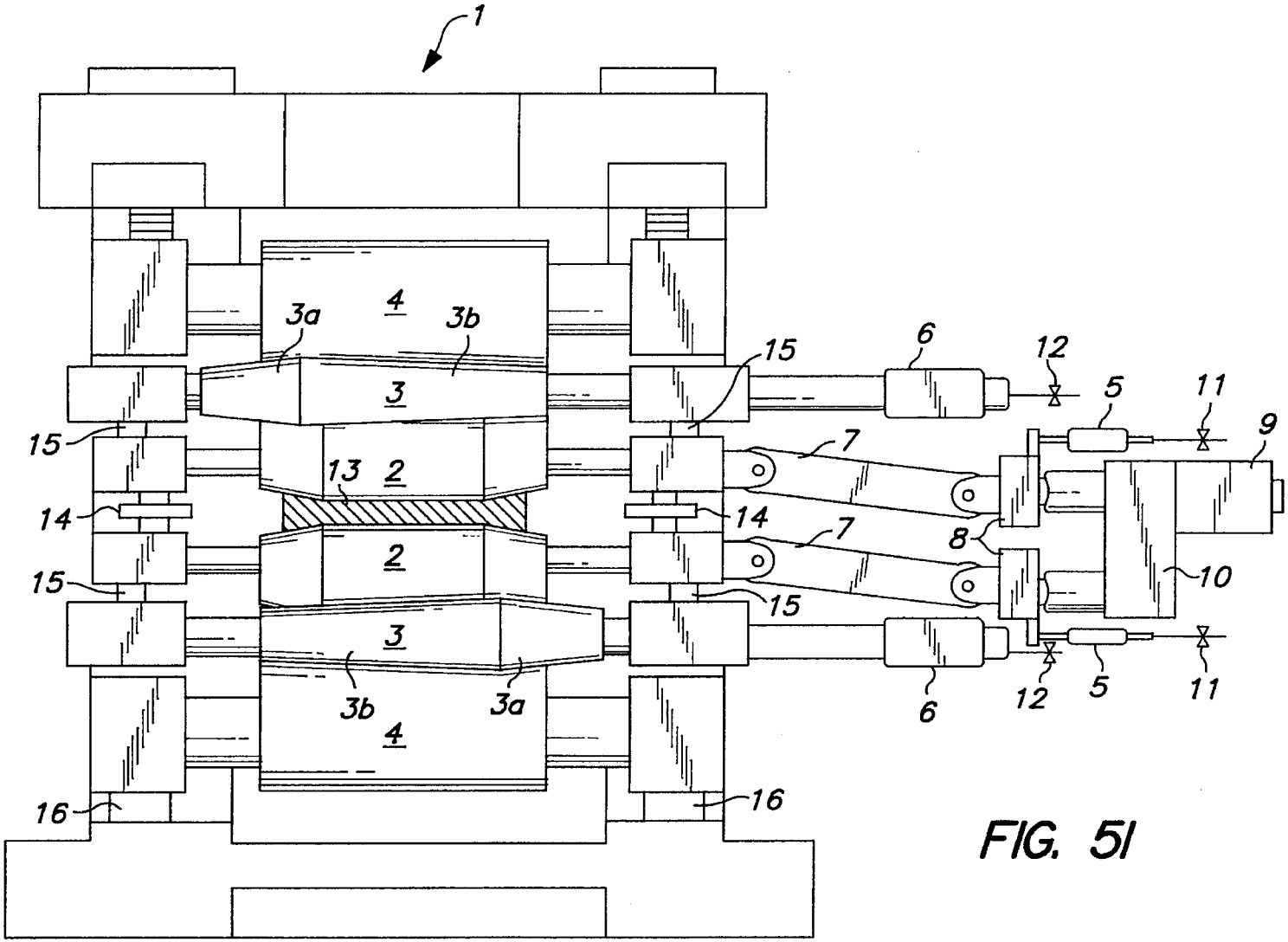
FIG. 51 is a schematic front view illustrating a rolling mill.

FIG. 51 illustrates a rolling mill having a construction similar to that of the six high rolling mill shown in FIG. 49, except that each of the work rolls 2 is provided with a roll crown tapered at the opposite end portions.

A comparative test was carried out as follows in which a sheet crown distribution with respect to the number of rolled sheets and others were investigated in a case using a rolling mill according to the present invention and also in a case using a conventional rolling mill.

Rolling Mill of the Present Invention

In a hot finish rolling mill train in which the six high rolling mills structured as shown in FIG. 51 were arranged in three rolling stands in the rear stage, sheet bars were rolled under the same conditions as in the Example 17, and then the sheet crown was measured very 5 coils at a position spaced from the edge by 25 mm.

In this case, the tapered portions 3*a* and 3*b* of the intermediate roll 3 and the tapered portion 2*a* of the work roll are tapered similarly as in the aforementioned Example 17 and the other tapered portion 2*b* of the work roll 2 is tapered by $0.4\times10^{-3}$ (0.08 mm/200 mm per diameter). The intermediate roll was shifted within a range from 0 mm to 700 mm. A specification of the conventional rolling mill used in this comparative test is the same as in the case of the Example 17.

RESULTS OF EXPERIMENTS

Figure 52:
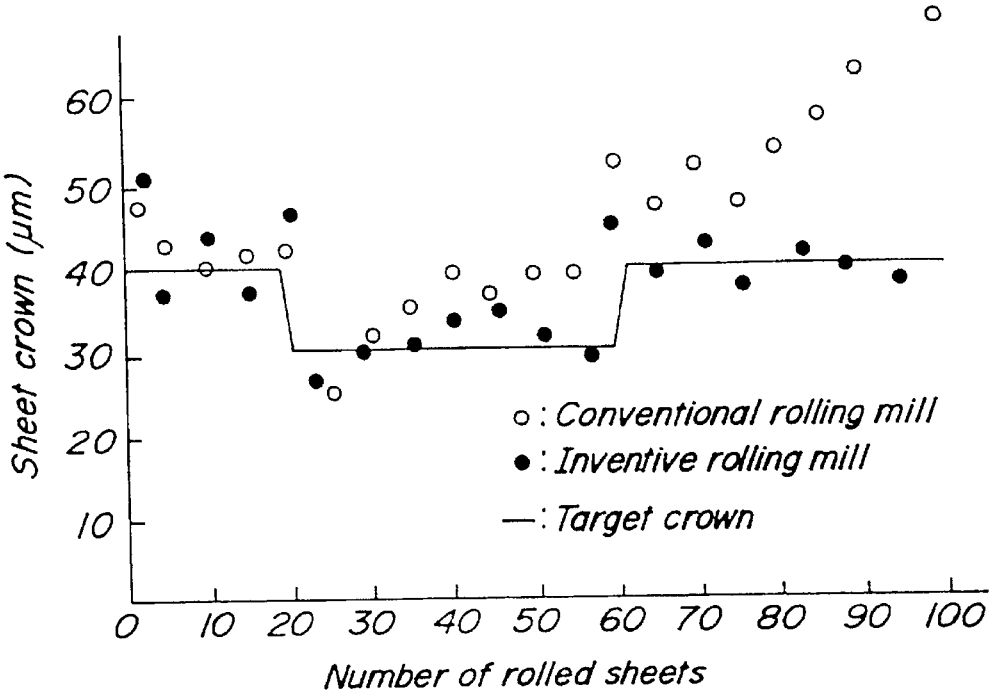
FIG. 52 is a graph showing a distribution of sheet crown with respect to the number of rolled sheets.

Results of measurement are shown in the graph of FIG. 52. According to the results shown in FIG. 52 when the rolling mill of the present invention was used, it is apparent that a high accurate sheet rolling operation to obtain a sheet crown extremely close to a target sheet crown was able to be carried out even when the target crown was changed. In this case, the rolling schedule with respect to the sheet width of the rolling mill of the present invention was set to be the same as that of the rolling mill of the prior art.

The frequency of occurring of reduction ears, accuracy of sheet thickness, and average value of sheet crown are shown in Table 19 in the case where 100,000 tons of sheets were rolled in a thin cycle rolling schedule using the aforementioned rolling mills of the invention and conventional rolling mills. According to this table, both the sheet thickness accuracy and the pass property (decrease in the occurrence of reduction ears) of the rolling mill of the invention are far superior to those of the conventional rolling mill.

TABLE 19

| | Average Crown $E_{25}$ (μm) | Sheet thickness accuracy 1σ (μm) | Amount of edge drop (μm) | Frequency of ears (time) |
|---|---|---|---|---|
| Inventive rolling mill | 35 | ±46 | 26 | 9 |
| Conventional rolling mill | 50 | ±60 | 39 | 12 |

EXAMPLE 19

Figure 53:
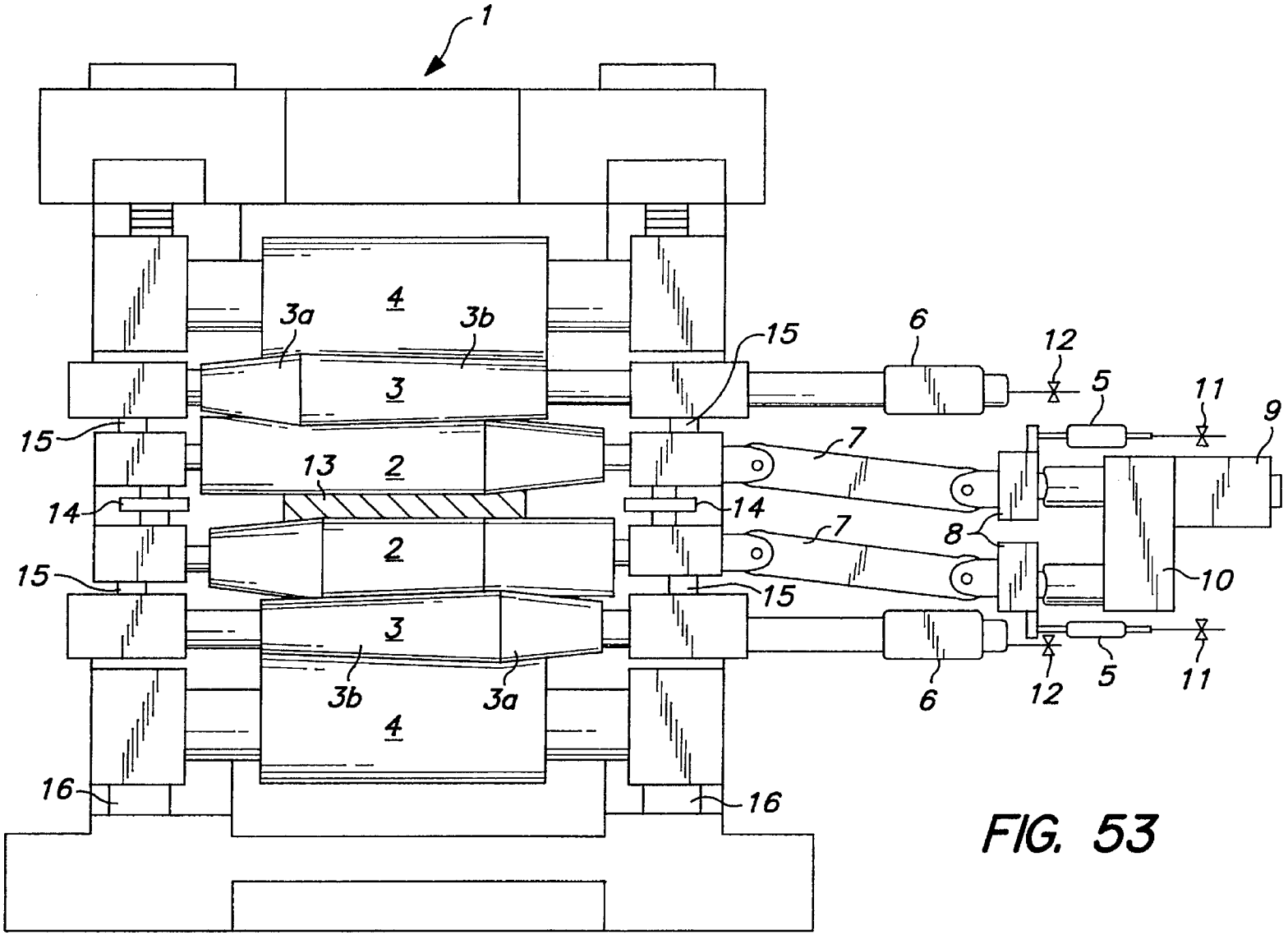
FIG. 53 is a schematic front view illustrating a rolling mill.

FIG. 53 illustrates a rolling mill similar to the six high rolling mill shown in FIG. 49, except that the barrel length of the work roll 2 is longer than that of the intermediate roll 3.

A comparative test was carried out as follows in which a sheet crown distribution with respect to the number of rolled sheets and others were investigated in a case using a rolling mill according to the present invention and also in a case using a conventional rolling mill.

Rolling Mill of the Present Invention

In a hot finish rolling mill train in which the six high rolling mills structured as shown in FIG. 53 were arranged in three rolling stands in the rear stage, sheet bars were rolled under the same condition as in the aforementioned Example 17. The sheet crown of rolled sheet was measured every 5 coils at a position spaced from the edge by 25 mm.

In this case, the barrel length of the work roll was 3400 mm, that of the intermediate roll was 3000 mm, and that of the backup roll was 2300 mm. Also, each of the intermediate rolls is provided with a roll crown tapered toward opposite ends of the roll barrel similar to that of the Example 17 and each of the work rolls is provided with a roll crown tapered toward one end of the roll barrel similar to that of the Example 17. The intermediate roll was shifted within a range from 0 mm to 700 mm. It is noted that a specification of the conventional rolling mill used in this comparative test is the same as that in the case of Example.

RESULTS OF EXPERIMENTS

Figure 54:
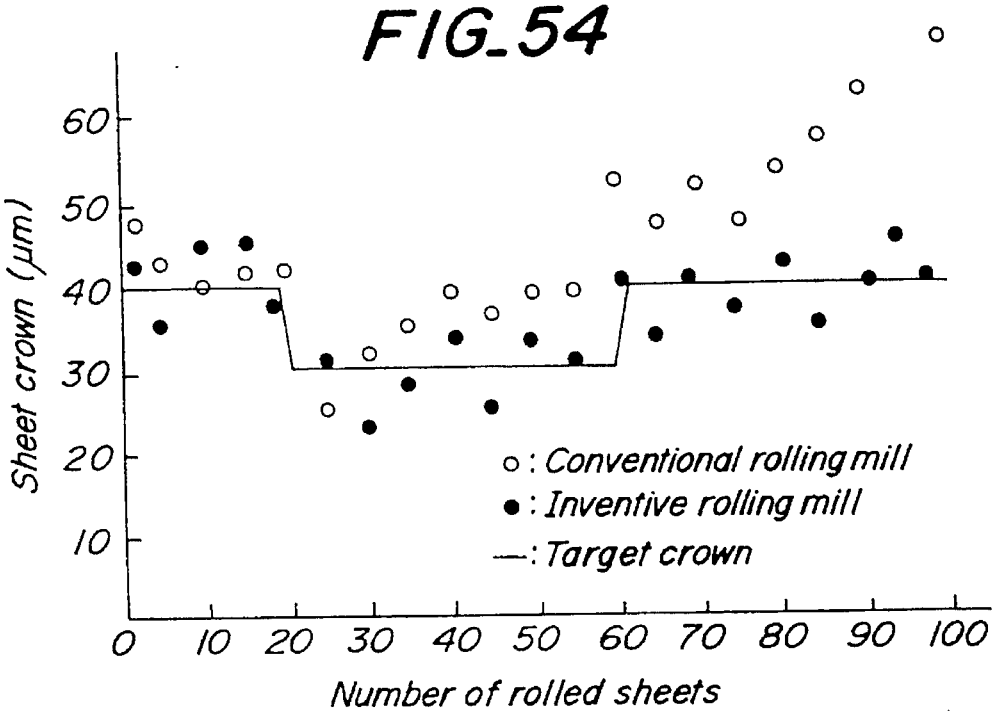
FIG. 54 is a graph showing a distribution of sheet crown with respect to the number of rolled sheets.

Results of measurement are shown in the graph of FIG. 54. According to the results shown in FIG. 54 when the rolling mill of the present invention was used, it is apparent that a highly accurate sheet rolling operation to obtain a sheet crown extremely close to a target sheet crown was able to be carried out even when the target crown was changed. In this case, the rolling schedule with respect to the sheet width of the rolling mill of the present invention was set to be the same as that of the rolling mill of the prior art.

The frequency of occurring of reduction ears, accuracy of sheet thickness, and average value of sheet crown are shown in Table 20 in the case where 100,000 tons of sheets were rolled in a thin cycle rolling schedule using the aforementioned rolling mills of the invention and conventional rolling mills. According to this table, both the sheet thickness accuracy and the pass property (decrease in the occurrence of reduction ears) of the rolling mill of the invention are far superior to those of the conventional rolling mill.

TABLE 20

| | Average Crown $E_{25}$ (μm) | Sheet thickness accuracy 1σ (μm) | Amount of edge drop (μm) | Frequency of ears (time) |
|---|---|---|---|---|
| Inventive rolling mill | 39 | ±49 | 22 | 5 |
| Conventional rolling mill | 50 | ±60 | 39 | 12 |

EXAMPLE 20

Figure 55:
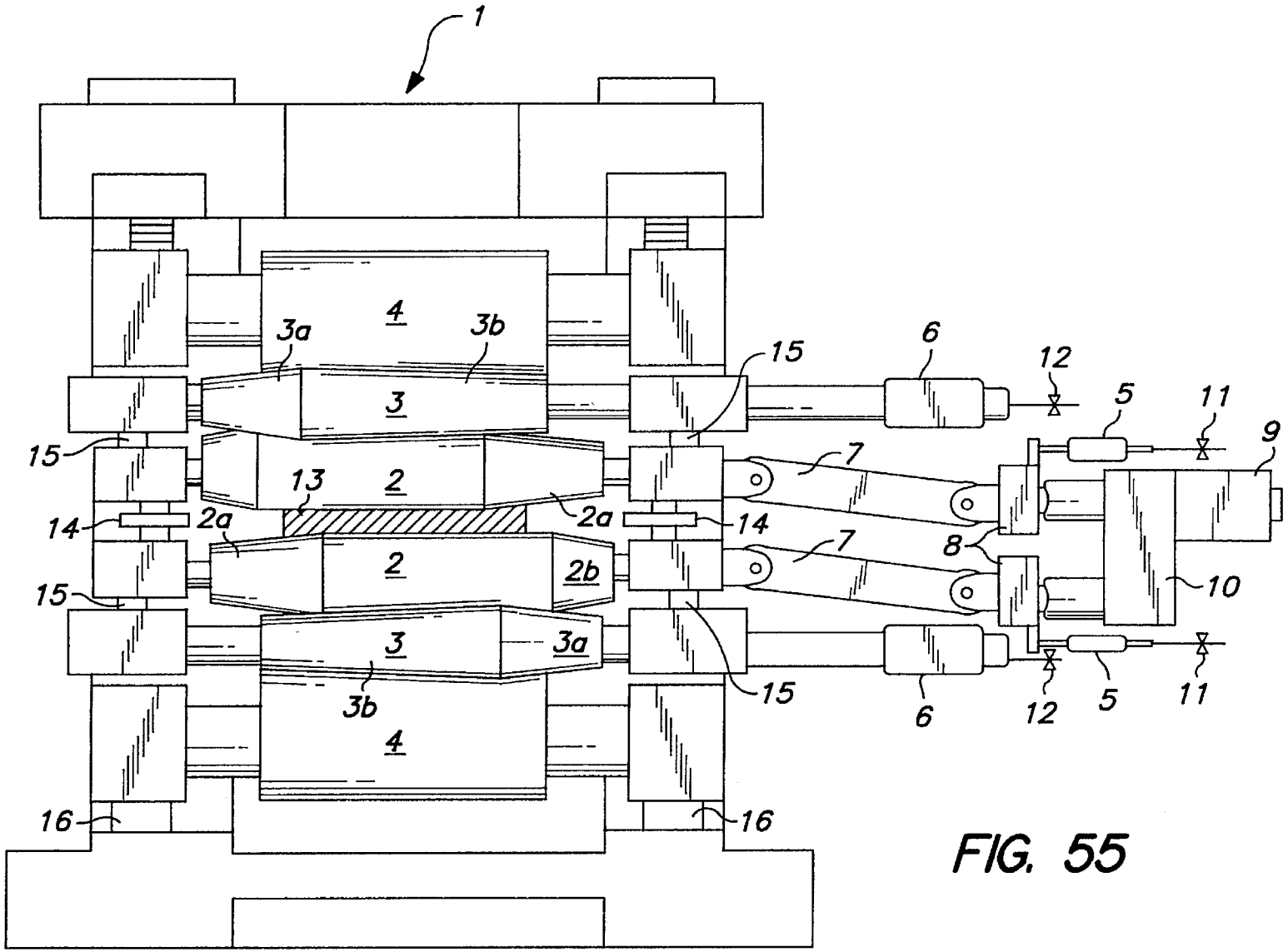
FIG. 55 is a schematic front view illustrating a rolling mill.

FIG. 55 illustrates a rolling mill having a construction similar to that of the six high rolling mill shown in FIG. 51, except that each of the work rolls is provided with a roll crown tapered at the opposite end portions thereof.

A comparative test is carried out in which a sheet crown distribution with respect to the number of rolled sheets and others were investigated in a case using a rolling mill according to the present invention and also in a case using a conventional rolling mill.

Rolling Mill of the Present Invention

In a hot finish rolling mill train in which the six high rolling mills structured as shown in FIG. 55 were arranged in three rolling stands in the rear stage, sheet bars were rolled under the same conditions as in the Example 17. The sheet crown of rolled sheet was measured every 5 coils at a position spaced from the edge by 25 mm.

In this case, the size and shape of the intermediate rolls are the same as those of the Example 19 and the work roll 2 has tapered barrel portions 2*a* and 2*b* tapered by $0.8\times10^{-3}$ (0.16 mm/200 mm per diameter) and $0.1\times10^{-3}$ (0.02 mm/200 mm per diameter), respectively. The intermediate roll was shifted within a range from 0 mm to 700 mm. A specification of the conventional rolling mill used in this comparative test is the same as those in the case of the Example 17.

RESULTS OF EXPERIMENTS

Figure 56:
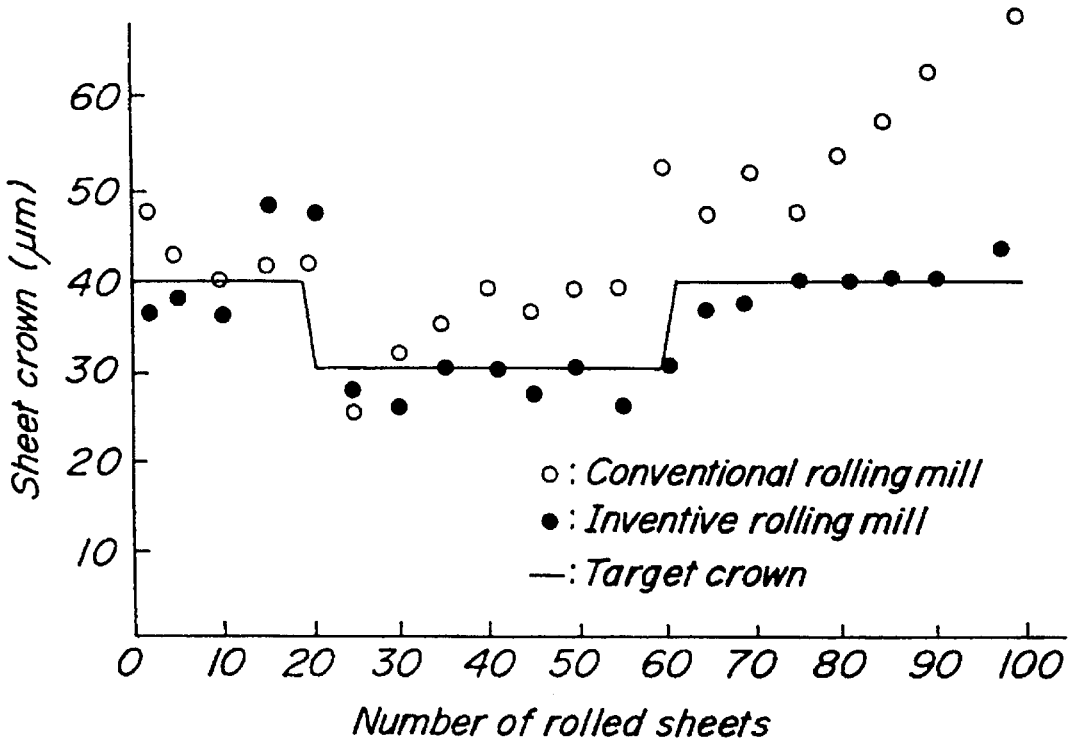
FIG. 56 is a graph showing a distribution of sheet crown with respect to the number of rolled sheets.

Results of measurement are shown in the graph of FIG. 56. According to the results shown in FIG. 56 when the rolling mill of the present invention was used, it is apparent that a highly accurate sheet rolling operation to obtain a sheet crown extremely close to a target sheet crown was able to be carried out even when the target crown was changed.

The frequency of occurring of reduction ears, accuracy of sheet thickness, and average value of sheet crown are shown in Table 21 in the case where 100,000 tons of sheets were rolled in a thin cycle rolling schedule using the aforementioned rolling mills of the invention and conventional rolling mills. According to this table, both the sheet thickness accuracy and the pass property (decrease in the occurrence of reduction ears) of the rolling mill of the invention are far superior to those of the conventional rolling mill.

TABLE 21

| | Average Crown $E_{25}$ (μm) | Sheet thickness accuracy 1σ (μm) | Amount of edge drop (μm) | Frequency of ears (time) |
|---|---|---|---|---|
| Inventive rolling mill | 35 | ±46 | 26 | 7 |
| Conventional rolling mill | 50 | ±60 | 39 | 12 |

Industrial Utilizability

According to the present invention, rolled sheets having a target sheet shape of desired sheet crown and edge drop can be rolled in high accuracy. Thus, the yield in the after process can be improved and the rolling operation can be carried out in stable condition. Furthermore, the life of the intermediate roll and the work roll can be improved.

We claim:

1. A six-high rolling mill for rolling steel sheet and having a vertical and parallel rigidity comprising: a pair of upper and lower work rolls, each rotatably mounted about a parallel axis in a common plane and defining therebetween a nip for said steel sheet to be rolled therebetween, a pair of upper and lower intermediate rolls, each rotatably mounted about a barrel center extending along a parallel longitudinal axis within said common plane and respectively backing said upper and lower work rolls, and a pair of upper and lower backup rolls, each rotatably mounted about a parallel axis within said common plane and respectively backing said upper and lower intermediate rolls, said intermediate and said work rolls being adapted for shifting in axial directions thereof, wherein each of the intermediate rolls has a barrel length longer than that of each of the backup rolls such that a barrel end of each of the intermediate rolls extends beyond a barrel end of each of the backup rolls even after a maximum and minimum axial shifting of each of the intermediate rolls, each of said work rolls provided with a like cylindrical roll profile, the upper and lower intermediate rolls each provided with a like roll crown profile in point symmetry relationship, said roll crown profile defined by a third order equation, which said equation determines that the barrel length of each intermediate roll is to be 1.2–2.5 times longer than that of each backup roll, so that fish and continuous contact is maintained between said intermediate roll and said work and backup rolls so as to preserve mill rigidity, and to reduce sheet rolling forces interacting between said rolls, whereby a fluctuation of sheet crown and end thickness inaccuracies such as edge drop, meandering and ears are reduced, wherein said third order equation of said lower intermediate roll is expressed as $$y_1(x)=-a[\{x-(\delta+OF)\}/L]^3+b(x/L)$$

where y: is the generating line that defines the roll crown profile;

where a: is a coefficient of the third order;

where b: is a coefficient of the first order;

x: is a coordinate of the lower intermediate roll barrel center relative to the longitudinal axis of the lower intermediate roll being coincidental with the x axis of an x-y coordinate system, the center point being at x=0, y=0 of the coordinate system, where L: is ½ of the barrel length of the intermediate roll measured along the x-coordinate;

where δ: is the axial shift amount of the intermediate roll along the longitudinal axis relative to the center point (0,0) of the coordinate system; and where OF: is defined as the difference between the barrel length L and the length LB, which is half the backup roll barrel length; and wherein the roll profile of the upper intermediate roll defined by a similar third order equation is in point symmetry relationship to the lower roll profile with respect to a point thereon and is expressed as $$y_2(x)=-a[\{x+(\delta+OF)\}/L]^3+b(x/L).$$

2. The six high rolling mill claimed in claim 1, wherein the barrel length of each work roll is 1.4–2.5 times as long as that of each backup roll.

3. The six high rolling mill claimed in claim 1, wherein each work roll has a barrel diameter in a range of 400–700 mm.

4. The six high rolling mill claimed in claim 1, wherein the barrel length of each work roll is not less than that of each intermediate roll.

5. A six-high tolling mill for rolling steel sheet and having a vertical and parallel rigidity comprising: a pair of upper and lower work rolls, each rotatably mounted about a parallel axis in a common plane and defining therebetween a nip for said steel sheet to be rolled therebetween, a pair of upper and lower intermediate rolls, each rotatably mounted about a barrel center extending along a parallel longitudinal axis within said common plane and respectively backing said upper and lower work rolls, and a pair of upper and lower backup rolls, each rotably mounted about a parallel axis within said common plane and respectively backing said upper and lower intermediate rolls, said intermediate and said work rolls being adapted for shifting in axial directions thereof, whereto each of the intermediate rolls has a barrel length defined by a respective first and second barrel end, said intermediate barrel length longer than that of each of the backup rolls such that a barrel end of each of the intermediate rolls extends beyond a barrel end of each of the backup rolls even after a maximum and minimum axial shifting of each of the intermediate rolls, each of said work rolls provided with a like one-sides tapered roll profile, said one-sided tapered profile defined as a continuous taper from one of the barrel ends towards the other, the upper and lower intermediate rolls each provided with a like roll crown in point symmetry relationship, said roll crown profile defined b a third order equation, which said equation determines that the barrel length of each intermediate roll is to be 1.2–2.5 times longer than that of each backup roll, so that full and continuous contact is maintained between said intermediate roll and said work and backup rolls so as to preserve mill rigidity, and to reduce sheet rolling forces interacting between said rolls, whereby a fluctuation of sheet crown and end thickness inaccuracies such as edge drop, meandering and ears are reduced, wherein said third order equation of said lower intermediate roll is expressed as $$y_1(x)=-a[\{x-(\delta+OF)\}/L]^3+b(x/L);$$

where y: is the generating line that defines the roll crown profile;

where a: is a coefficient of the third order;

where b: is a coefficient of the first order;

where x: is a coordinate of the lower intermediate roll barrel center relative to the longitudinal axis of the lower intermediate roll being coincidental with the x axis of an x-y coordinate system, the center point being at the X=0, Y=0 of the coordinate system, where L: is ½ of the barrel length of the intermediate roll measured along, the x-coordinate;

where δ: is the axial shift amount of the intermediate roll along the longitudinal axis relative to the center point (0,0) of the coordinate system; and where OF: is defined as the difference between the barrel length L and the length LB, which is half the backup roll barrel length; and wherein the roll profile of the upper intermediate roll defined by a similar third order equation is in point symmetry relationship to the lower roll profile with respect to a point thereon and is expressed as $$y_2(x)=-a[\{x+(\delta+OF)\}/L]^3+b(x/L).$$

6. A six-high rolling mill for rolling steel sheet and having a vertical and parallel rigidity comprising: a pair of upper and lower work rolls, each rotatably mounted about a parallel axis in a common plane and defining therebetween a nip for said steel sheet to be rolled therebetween, a pair of upper and lower intermediate rolls, each rotatably mounted about a parallel and within said common plane and respectively backing said upper and lower work rolls, and a pair of upper and lower backup rolls, each rotatably mounted about a parallel axis within said common plane and respectively backing said upper and lower intermediate rolls, said intermediate and said work rolls being adapted for shifting in axial directions thereof, wherein each of the intermediate rolls has a barrel length defined by a respective first and second barrel and, said intermediate barrel length longer than that of each of the backup rolls such that one of said first and second barrel ends of each of the intermediate rolls is always relatively exterior to a barrel end of each of the backup rolls even after a maximum and minimum axial shifting of each of the intermediate rolls, the upper and lower intermediate rolls each provided with a like roll crown profile in point symmetry relationship, said roll crown profile defined by a third order equation, which said equation determine that the barrel length of each intermediate roll is to be 1.2–2.5 times longer than that of each backup roll, so that full and continuous contact is maintained between said intermediate roll and said work and backup rolls so as to preserve mill rigidity, and to reduce sheet rolling forces interacting between said rolls, whereby a fluctuation of sheet crown and end thickness inaccuracies such as edge drop, meandering and ears are reduced, wherein said third order equation of said lower intermediate roll is expressed as $$y_1(x)=-a[\{x-(\delta+OF)\}/L]^3+b(x/L);$$

where y: is the generating line that defines the roll crown profile;

where a: is a coefficient of the third order;

where b: is a coefficient of the first order;

where x: is a coordinate of the lower intermediate roll barrel center relative to the longitudinal axis of the lower intermediate roll being coincidental with the x axis of an x-y coordinate system, the center point being at x=0, y=0 of the coordinate system;

where L: is ½ of the barrel length of the intermediate roll measured along the x-coordinate;

where δ: is the axial shift amount of the intermediate roll along the longitudinal axis relative to the center point (0,0) of the coordinate system; and where OF: is defined as the difference between the barrel length L and the length LB, which is half the backup roll barrel length; and wherein the roll profile of the upper intermediate roll defined by a similar third order equation is in point symmetry relationship to the lower roll profile with respect to a point thereon and is expressed as $$y_2(x)=-a[\{x+(\delta+OF)\}/L]^3+b(x/L).$$

7. A six high rolling mill for rolling steel sheet and having a vertical and parallel rigidity comprising: a pair of upper and lower work rolls, each rotably mounted about a parallel axis in a common plane and defining therebetween a nip for said steel to be rolled therebetween, a pair of upper and lower intermediate rolls, each rotably mounted about a barrel center extending along a parallel longitudinal axis within said common plane and respectively backing said upper and lower work rolls, and a pair of upper and lower backup rolls, each rotably mounted about a parallel axis within said common plane and respectively backing said upper and lower intermediate rolls, the work rolls and intermediate rolls being adapted for shifting in axial directions thereof, wherein each of the intermediate rolls has a barrel length longer than that of each of the backup rolls such that a barrel end of each of the intermediate rolls extends beyond a barrel end of each of the backup rolls even after a maximum and minimum axial shifting of each of the intermediate rolls, each of said work rolls provided with a like two-side taper roll profile, said profile defined as a continuous taper extending from a midpoint of the work roll barrel, outwardly towards both of the barrel ends, and the upper and lower intermediate rolls are each provided with a like roll crown profile in point symmetry relationship, said roll crown profile defined by a third order equation, which said equation determines that the barrel length of each intermediate roll is to be 1.2–2.5 times longer than that of each backup roll so that full and continuous contact is maintained between said intermediate roll and said work and backup rolls so as to preserve mill rigidity and to reduce sheet rolling forces interacting between said rolls, whereby a fluctuation of sheet roll crown and end thickness inaccuracies such as edge drop, meandering, and ears, are reduced, wherein said third order equation of said lower intermediate roll is expressed as $$y_1(x)=-a[\{x-(\delta+OF)\}/L]^3+b(x/L);$$

where y: is the generating line that defines the roll crown profile;

where a: is a coefficient of the third order;

where b: is a coefficient of the first order;

where x: is a coordinate of the lower intermediate roll barrel center relative to the longitudinal axis of the lower intermediate roll being coincidental with the x axis of an x-y coordinate system, the center point being at x=0, y=0 of the coordinate system;

where L: is ½ of the barrel length of the intermediate roll measured along the x-coordinate;

where δ: is the axial shift amount of the intermediate roll along the longitudinal axis relative to the center point (0,0) of the coordinate system; and where OF: is defined as the difference between the barrel length L and the length LB, which is half the backup roll barrel length; and wherein the roll profile of the upper intermediate roll defined by a similar third order equation is in point symmetry relationship to the lower roll profile with respect to a point thereon and is expressed as $$y_2(x)=-a[\{x+(\delta+OF)\}/L]^3+b(x/L).$$

8. The six high rolling mill claimed in claim 7, wherein the barrel length of each work roll is not less than that of each intermediate roll.

9. The six high rolling mill claimed in claim 7, wherein the barrel length of each work roll is 1.4–2.5 times as long as that of each backup roll.

* * * * *